US010049530B2

(12) United States Patent
Arnone et al.

(10) Patent No.: US 10,049,530 B2
(45) **Date of Patent: *Aug. 14, 2018**

(54) SECOND CHANCE LOTTERY SKILL WAGERING INTERLEAVED GAME SYSTEM

(71) Applicant: Gamblit Gaming, LLC, Glendale, CA (US)

(72) Inventors: Miles Arnone, Sherborn, MA (US); Frank Cire, Pasadena, CA (US); Clifford Kaylin, Pasadena, CA (US); Eric Meyerhofer, Pasadena (CA); John Lucier, Cranston, RI (US); David Chang, San Gabriel, CA (US); Caitlyn Ross, Wataertown, MA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/605,705

(22) Filed: May 25, 2017

(65) Prior Publication Data

US 2017/0263075 A1 Sep. 14, 2017

Related U.S. Application Data

(63) Continuation of application No. 15/074,999, filed on Mar. 18, 2016, now Pat. No. 9,672,698, which is a continuation of application No. PCT/US2014/056418, filed on Sep. 18, 2014.

(60) Provisional application No. 61/879,658, filed on Sep. 18, 2013.

(51) Int. Cl.
*G07F 17/32* (2006.01)
*A63F 3/08* (2006.01)

(52) U.S. Cl.
CPC ..... *G07F 17/329* (2013.01); *A63F 3/081* (2013.01); *G07F 17/3225* (2013.01); *A63F 2003/088* (2013.01)

(58) Field of Classification Search
CPC ..... G07F 17/329; G07F 17/3225; A63F 3/081
See application file for complete search history.

(56) References Cited

U.S. PATENT DOCUMENTS 4,582,324 A * 4/1986 Koza ..... A63F 13/12 463/16
4,652,998 A * 3/1987 Koza ..... G06Q 50/34 273/274
5,413,357 A 5/1995 Schulze et al.
(Continued)

OTHER PUBLICATIONS

U.S. Appl. No. 14/205,303 Arnone, et al., filed Mar. 11, 2014.
(Continued)

*Primary Examiner* — Corbett B Coburn
(74) *Attorney, Agent, or Firm* — Caitlyn Ross

(57) ABSTRACT

A lottery skill wagering interleaved game system. Responsive to a scanned code provided by an entertainment game module, a random number generation result is generated based on the scanned code. A wager outcome is determined based on the scanned code and the random result. The skill wagering interleaved game interleaves a gambling game with an interactive entertainment game. A second chance skill-based game is provided on a user device based on a wager outcome.

5 Claims, 23 Drawing Sheets

(56) References Cited

U.S. PATENT DOCUMENTS 5,709,603 A * 1/1998 Kaye ..... G07F 17/32 273/138.2
5,718,429 A 2/1998 Keller
5,785,592 A 7/1998 Jacobsen
5,853,324 A 12/1998 Kami et al.
5,963,745 A 10/1999 Collins et al.
6,050,895 A 4/2000 Luciano
6,165,071 A 12/2000 Weiss
6,227,974 B1 5/2001 Eilat
6,267,669 B1 7/2001 Luciano
6,685,563 B1 2/2004 Meekins et al.
6,712,693 B1 3/2004 Hettinger
6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,931,531 B2 4/2011 Oberberger
7,938,727 B1 5/2011 Konkle
7,950,993 B2 5/2011 Oberberger
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton, et al.
8,135,648 B2 3/2012 Oram
8,137,193 B1 3/2012 Kelly et al.
8,142,272 B2 3/2012 Walker
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,192,268 B1 * 6/2012 Karpe ..... G07F 17/329 463/16
8,206,210 B2 6/2012 Walker
8,292,719 B2 * 10/2012 Englman ..... G07F 17/32 463/16
8,308,544 B2 11/2012 Friedman
8,357,039 B2 * 1/2013 Anderson ..... G07F 17/32 463/29
8,398,475 B2 * 3/2013 De Waal ..... A63F 7/02 463/16
8,430,735 B2 4/2013 Oberberger
8,475,266 B2 7/2013 Amone
8,480,470 B2 7/2013 Napolitano et al.
8,622,809 B1 1/2014 Arora et al.
8,864,564 B2 10/2014 Oberberger
9,070,257 B1 6/2015 Scalise
2001/0004609 A1 6/2001 Walker et al.
2001/0019965 A1 9/2001 Ochi
2002/0022509 A1 2/2002 Nicastro et al.
2002/0082070 A1 * 6/2002 Macke ..... G07F 17/32 463/16
2002/0090990 A1 7/2002 Joshi et al.
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0092313 A1 5/2004 Saito et al.
2004/0097610 A1 5/2004 Saito
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0064488 A1 3/2008 Oh
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108406 A1 5/2008 Oberberger
2008/0108425 A1 5/2008 Oberberger
2008/0113704 A1 5/2008 Jackson
2008/0119283 A1 5/2008 Baerlocher
2008/0146308 A1 6/2008 Okada
2008/0161081 A1 7/2008 Berman
2008/0176619 A1 7/2008 Kelly
2008/0191418 A1 8/2008 Lutnick et al.
2008/0195481 A1 8/2008 Lutnick
2008/0248850 A1 10/2008 Schugar
2008/0254893 A1 10/2008 Patel

(56) References Cited

U.S. PATENT DOCUMENTS

2008/0274796 A1 11/2008 Lube
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0061975 A1 3/2009 Ditchev
2009/0061991 A1 3/2009 Popovich
2009/0061997 A1 3/2009 Popovich
2009/0061998 A1 3/2009 Popovich
2009/0061999 A1 3/2009 Popovich
2009/0082093 A1 3/2009 Okada
2009/0088239 A1 4/2009 Iddings
2009/0098934 A1 4/2009 Amour
2009/0117989 A1* 5/2009 Arezina ..... G07F 17/32 463/20
2009/0118006 A1 5/2009 Kelly et al.
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1 6/2009 Strause et al.
2009/0156297 A1 6/2009 Andersson et al.
2009/0176560 A1 7/2009 Herrmann et al.
2009/0176566 A1 7/2009 Kelly
2009/0181777 A1 7/2009 Christiani
2009/0221355 A1 9/2009 Dunaevsky et al.
2009/0239610 A1 9/2009 Olive
2009/0247272 A1 10/2009 Abe
2009/0270164 A1 10/2009 Seelig
2009/0275393 A1 11/2009 Kisenwether
2009/0291755 A1 11/2009 Walker et al.
2009/0309305 A1 12/2009 May
2009/0312093 A1 12/2009 Walker et al.
2009/0325686 A1 12/2009 Davis
2010/0004058 A1 1/2010 Acres
2010/0016056 A1 1/2010 Thomas et al.
2010/0029373 A1 2/2010 Graham et al.
2010/0035674 A1 2/2010 Slomiany
2010/0056247 A1 3/2010 Nicely
2010/0056260 A1 3/2010 Fujimoto
2010/0062836 A1 3/2010 Young
2010/0093420 A1 4/2010 Wright
2010/0093444 A1 4/2010 Biggar et al.
2010/0105454 A1 4/2010 Weber
2010/0120525 A1 5/2010 Baerlocher et al.
2010/0124983 A1 5/2010 Gowin et al.
2010/0137047 A1 6/2010 Englman et al.
2010/0174593 A1 7/2010 Cao
2010/0184509 A1 7/2010 Sylla et al.
2010/0203940 A1 8/2010 Alderucci et al.
2010/0210344 A1 8/2010 Edidin et al.
2010/0227672 A1 9/2010 Amour
2010/0227688 A1 9/2010 Lee
2010/0240436 A1 9/2010 Wilson et al.
2010/0285869 A1 11/2010 Walker
2010/0304825 A1 12/2010 Davis
2010/0304839 A1 12/2010 Johnson
2010/0304842 A1 12/2010 Friedman et al.
2011/0009177 A1 1/2011 Katz
2011/0009178 A1 1/2011 Gerson
2011/0045896 A1 2/2011 Sak et al.
2011/0070945 A1 3/2011 Walker
2011/0077087 A1 3/2011 Walker et al.
2011/0082571 A1 4/2011 Murdock et al.
2011/0105206 A1 5/2011 Rowe et al.
2011/0107239 A1 5/2011 Adoni
2011/0109454 A1 5/2011 McSheffrey
2011/0111820 A1 5/2011 Filipour
2011/0111837 A1 5/2011 Gagner
2011/0111841 A1 5/2011 Tessmer
2011/0118011 A1 5/2011 Filipour et al.
2011/0201413 A1 8/2011 Oberberger
2011/0207523 A1 8/2011 Filipour et al.
2011/0212766 A1 9/2011 Bowers
2011/0212767 A1 9/2011 Barclay
2011/0218028 A1 9/2011 Acres
2011/0218035 A1 9/2011 Thomas
2011/0230258 A1 9/2011 Van Luchene
2011/0230260 A1 9/2011 Morrow et al.
2011/0230267 A1 9/2011 Van Luchene
2011/0244944 A1 10/2011 Baerlocher
2011/0263312 A1 10/2011 De Waal
2011/0269522 A1 11/2011 Nicely et al.
2011/0275440 A1 11/2011 Faktor
2011/0287828 A1 11/2011 Anderson et al.
2011/0287841 A1 11/2011 Watanabe
2011/0312408 A1 12/2011 Okuaki
2011/0319169 A1 12/2011 Lam
2012/0004747 A1 1/2012 Kelly
2012/0028718 A1 2/2012 Barclay et al.
2012/0058814 A1 3/2012 Lutnick
2012/0077569 A1 3/2012 Watkins
2012/0108323 A1 5/2012 Kelly
2012/0135793 A1 5/2012 Antonopoulos
2012/0178514 A1* 7/2012 Schulzke ..... G07F 17/3295 463/17
2012/0202587 A1 8/2012 Allen
2012/0302311 A1 11/2012 Luciano
2012/0322545 A1 12/2012 Amone et al.
2013/0029760 A1 1/2013 Wicket
2013/0131848 A1 5/2013 Amone et al.
2013/0178269 A1* 7/2013 Shaw ..... G07F 17/3244 463/16
2013/0190074 A1 7/2013 Amone et al.
2013/0260869 A1 10/2013 Leandro et al.
2014/0087801 A1 3/2014 Nicely et al.
2014/0087808 A1 3/2014 Leandro et al.
2014/0087809 A1 3/2014 Leupp et al.
2014/0357350 A1 12/2014 Weingardt et al.
2016/0189467 A1* 6/2016 Onorato ..... G07F 17/329 463/17

OTHER PUBLICATIONS

U.S. Appl. No. 14/205,306 Arnone, et al., filed Mar. 11, 2014.
U.S. Appl. No. 14/209,485 Arnone, et al., filed Mar. 13, 2014.
U.S. Appl. No. 14/214,310 Arnone, et al., filed Mar. 14, 2014.
U.S. Appl. No. 14/.222,520 Arnone, et al., filed Mar. 21, 2014.
U.S. Appl. No. 14/253,813 Arnone, et al., filed Apr. 15, 2014.
U.S. Appl. No. 14/255,253 Arnone, et al., filed Apr. 17, 2014.
U.S. Appl. No. 14/255,919 Arnone, et al. filed Apr. 17, 2014.
U.S. Appl. No. 14/263,988 Arnone, et al. filed Apr. 28, 2014.
U.S. Appl. No. 14/270,335 Arnone, et al. filed May 5, 2014.
U.S. Appl. No. 14/271,360 Arnone, et al. filed May 6, 2014.
U.S. Appl. No. 13/961,849 Arnone, et al. filed Aug. 7, 2013.
U.S. Appl. No. 13/746,850 Arnone, et al. filed Jan. 22, 2013.
U.S. Appl. No. 14/288,169 Arnone, et al. filed May 27, 2014.
U.S. Appl. No. 14/304,027 Arnone, et al. filed Jun. 13, 2014.
U.S. Appl. No. 14/306,187 Arnone, et al. filed Jun. 16, 2014.
U.S. Appl. No. 14/312,623 Arnone, et al. filed Jun. 23, 2014.
U.S. Appl. No. 14/330,249 Arnone, et al. filed Jul. 14, 2014.
U.S. Appl. No. 14/339,142 Arnone, et al. filed Jul. 23, 2014.
U.S. Appl. No. 14/458,206 Arnone, et al. filed Aug. 12, 2014.
U.S. Appl. No. 14/461,344 Arnone, et al. filed Aug. 15, 2014.
U.S. Appl. No. 14/462,516 Arnone, et al. filed Aug. 18, 2014.
U.S. Appl. No. 14/467,646 Meyerhofer, et al. filed Aug. 25, 2014.
U.S. Appl. No. 14/474,023 Arnone, et al. filed Aug. 29, 2014.
U.S. Appl. No. 14/486,895 Arnone, et al. filed Sep. 15, 2014.
U.S. Appl. No. 14/507,206 Arnone, et al. filed Oct. 6, 2014.
U.S. Appl. No. 14/521,338 Arnone, et al. filed Oct. 22, 2014.
U.S. Appl. No. 14/535,808 Arnone, et al. filed Nov. 7, 2014.
U.S. Appl. No. 14/535,816 Arnone, et al. filed Nov. 7, 2014.
U.S. Appl. No. 14/536,231 Arnone, et al. filed Nov. 7, 2014.
U.S. Appl. No. 14/536,280 Arnone, et al. filed Nov. 7, 2014.
U.S. Appl. No. 14/549,137 Arnone, et al. filed Nov. 20, 2014.
U.S. Appl. No. 14/550,802 Arnone, et al. filed Nov. 21, 2014.
U.S. Appl. No. 14/555,401 Arnone, et al. filed Nov. 26, 2014.

(56) References Cited

OTHER PUBLICATIONS

U.S. Appl. No. 14/559,840 Arnone, et al. filed Dec. 3, 2014.
U.S. Appl. No. 14/564,834 Arnone, et al. filed Dec. 9, 2014.
U.S. Appl. No. 14/570,746 Arnone, et al. filed Dec. 15, 2014.
U.S. Appl. No. 14/570,857 Arnone, et al. filed Dec. 15, 2014.
U.S. Appl. No. 14/586,626 Arnone, et al. filed Dec. 30, 2014.
U.S. Appl. No. 14/586,639 Arnone, et al. filed Dec. 30, 2014.
U.S. Appl. No. 15/362,214 Arnone, et al. filed Nov. 28, 2016.
U.S. Appl. No. 15/063,365 Arnone, et al. filed Mar. 7, 2016.
U.S. Appl. No. 15/063,496 Arnone, et al. filed Mar. 7, 2016.
U.S. Appl. No. 15/073,602 Arnone, et al. filed Mar. 17, 2016.
U.S. Appl. No. 15/074,999 Arnone, et al. filed Mar. 18, 2016.
U.S. Appl. No. 15/077,574 Arnone, et al. filed Mar. 22, 2016.
U.S. Appl. No. 15/083,284 Arnone, et al. filed Mar. 28, 2016.
U.S. Appl. No. 15/091,395 Arnone, et al. filed Apr. 5, 2016.
U.S. Appl. No. 15/093,685 Arnone, et al. filed Apr. 7, 2016.
U.S. Appl. No. 15/098,287 Arnone, et al. filed Apr. 13, 2016.
U.S. Appl. No. 15/098,313 Arnone, et al. filed Apr. 13, 2016.
U.S. Appl. No. 15/130,101 Arnone, et al. filed Apr. 15, 2016.
U.S. Appl. No. 15/133,624 Arnone, et al. filed Apr. 20, 2016.
U.S. Appl. No. 15/134,852 Arnone, et al. filed Apr. 21, 2016.
U.S. Appl. No. 15/139,148 Arnone, et al. filed Apr. 26, 2016.
U.S. Appl. No. 15/141,784 Arnone, et al. filed Apr. 29, 2016.
U.S. Appl. No. 15/155,107 Arnone, et al. filed May 16, 2016.
U.S. Appl. No. 15/156,222 Arnone, et al. filed May 16, 2016.
U.S. Appl. No. 15/158,530 Arnone, et al. filed May 18, 2016.
U.S. Appl. No. 15/161,174 Arnone, et al. filed May 20, 2016.
U.S. Appl. No. 15/170,773 Arnone, et al. filed Jun. 1, 2016.
U.S. Appl. No. 15/174,995 Arnone, et al. filed Jun. 6, 2016.
U.S. Appl. No. 15/179,940 Arnone, et al. filed Jun. 10, 2016.
U.S. Appl. No. 15/189,797 Arnone, et al. filed Jun. 22, 2016.
U.S. Appl. No. 15/190,745 Arnone, et al. filed Jun. 23, 2016.
U.S. Appl. No. 15/191,050 Arnone, et al. filed Jun. 23, 2016.
U.S. Appl. No. 15/219,257 Arnone, et al. filed Jul. 25, 2016.
U.S. Appl. No. 15/227,881 Arnone, et al. filed Aug. 3, 2016.
U.S. Appl. No. 151241,683 Arnone, et al. filed Aug. 19, 2016.
U.S. Appl. No. 15/245,040 Arnone, et al. filed Aug. 23, 2016.
U.S. Appl. No. 15/233,294 Arnone, et al. filed Aug. 24, 2016.
U.S. Appl. No. 15/252,190 Arnone, et al. filed Aug. 30, 2016.
U.S. Appl. No. 15/255,789 Arnone, et al. filed Sep. 2, 2016.
U.S. Appl. No. 15/261,858 Arnone, et al. filed Sep. 9, 2016.
U.S. Appl. No. 15/264,521 Arnone, et al. filed Sep. 13, 2016.
U.S. Appl. No. 15/264,557 Arnone, et al. filed Sep. 13, 2016.
U.S. Appl. No. 15/271,214 Arnone, et al. filed Sep. 20, 2016.
U.S. Appl. No. 15/272,318 Arnone, et al. filed Sep. 21, 2016.
U.S. Appl. No. 15/273,260 Arnone, et al. filed Sep. 22, 2016.
U.S. Appl. No. 15/276,469 Arnone, et al. filed Sep. 26, 2016.
U.S. Appl. No. 15/280,255 Arnone, et al. filed Sep. 29, 2016.
U.S. Appl. No. 15/286,922 Arnone, et al. filed Oct. 6, 2016.
U.S. Appl. No. 15/287,129 Arnone, et al. filed Oct. 6, 2016.
U.S. Appl. No. 15/289,648 Arnone, et al. filed Oct. 10, 2016.
U.S. Appl. No. 15/297,019 Arnone, et al. filed Oct. 18, 2016.
U.S. Appl. No. 15/298,533 Arnone, et al. filed Oct. 20, 2016.
U.S. Appl. No. 15/336,696 Arnone, et al. filed Oct. 27, 2016.
U.S. Appl. No. 15/339,898 Arnone, et al. filed Oct. 31, 2016.
U.S. Appl. No. 15/345,451 Arnone, et al. filed Nov. 7, 2016.
U.S. Appl. No. 14/799,481 Arnone, et al. filed Jul. 14, 2015.
U.S. Appl. No. 14/586,645 Arnone, et al. filed Dec. 30, 2014.
U.S. Appl. No. 14/598,151 Arnone, et al. filed Jan. 15, 2015.
U.S. Appl. No. 14/601,063 Arnone, et al. filed Jan. 20, 2015.
U.S. Appl. No. 14/601,108 Arnone, et al. filed Jan. 20, 2015.
U.S. Appl. No. 14/608,000 Arnone, et al. filed Jan. 28, 2015.
U.S. Appl. No. 14/608,087 Arnone, et al. filed Jan. 28, 2015.
U.S. Appl. No. 14/608,093 Arnone, et al. filed Jan. 28, 2015.
U.S. Appl. No. 14/610,897 Arnone, et al. filed Jan. 30, 2015.
U.S. Appl. No. 14/611,077 Arnone, et al. filed Jan. 30, 2015.
U.S. Appl. No. 14/604,629 Arnone, et al. filed Jan. 23, 2015.
U.S. Appl. No. 14/625,475 Arnone, et al. filed Feb. 18, 2015.
U.S. Appl. No. 14/617,852 Arnone, et al. filed Feb. 9, 2015.
U.S. Appl. No. 14/627,428 Arnone, et al. filed Feb. 20, 2015.
U.S. Appl. No. 14/642,427 Arnone, et al. filed Mar. 9, 2015.
U.S. Appl. No. 14/665,991 Arnone, et al. filed Mar. 23, 2015.
U.S. Appl. No. 14/666,010 Arnone, et al. filed Mar. 23, 2015.
U.S. Appl. No. 14/666,022 Arnone, et al. filed Mar. 23, 2015.
U.S. Appl. No. 14/642,623 Arnone, et al. filed Mar. 9, 2015.
U.S. Appl. No. 14/663,337 Arnone, et al. filed Mar. 19, 2015.
U.S. Appl. No. 14/666,284 Arnone, et al. filed Mar. 23, 2015.
U.S. Appl. No. 14/679,885 Arnone, et al. filed Apr. 6, 2015.
U.S. Appl. No. 14/685,378 Arnone, et al. filed Apr. 13, 2015.
U.S. Appl. No. 14/686,675 Arnone, et al. filed Apr. 14, 2015.
U.S. Appl. No. 14/686,678 Arnone, et al. filed Apr. 14, 2015.
U.S. Appl. No. 14/701,430 Arnone, et al. filed Apr. 30, 2015.
U.S. Appl. No. 14/703,721 Arnone, et al. filed May 4, 2015.
U.S. Appl. No. 14/708,138 Arnone, et al. filed May 8, 2015.
U.S. Appl. No. 14/708,141 Arnone, et al. filed May 8, 2015.
U.S. Appl. No. 14/708,160 Arnone, et al. filed May 8, 2015.
U.S. Appl. No. 14/708,161 Arnone, et al. filed May 8, 2015.
U.S. Appl. No. 14/708,162 Arnone, et al. filed May 8, 2015.
U.S. Appl. No. 14/710,483 Arnone, et al. filed May 12, 2015.
U.S. Appl. No. 14/714,084 Arnone, et al. filed May 15, 2015.
U.S. Appl. No. 14/715,463 Arnone, et al. filed May 18, 2015.
U.S. Appl. No. 14/720,620 Arnone, et al. filed May 22, 2015.
U.S. Appl. No. 14/720,624 Arnone, et al. filed May 22, 2015.
U.S. Appl. No. 14/720,626 Arnone, et al. filed May 22, 2015.
U.S. Appl. No. 14/727,726 Arnone, et al. filed Jun. 1, 2015.
U.S. Appl. No. 14/730,183 Arnone, et al. filed Jun. 3, 2015.
U.S. Appl. No. 14/731,321 Arnone, et al. filed Jun. 4, 2015.
U.S. Appl. No. 14/740,078 Arnone, et al. filed Jun. 15, 2015.
U.S. Appl. No. 14/742,517 Arnone, et al. filed Jun. 17, 2015.
U.S. Appl. No. 14/743,708 Arnone, et al. filed Jun. 18, 2015.
U.S. Appl. No. 14/746,731 Arnone, et al. filed Jun. 22, 2015.
U.S. Appl. No. 14/748,122 Arnone, et al. filed Jun. 23, 2015.
U.S. Appl. No. 14/788,581 Arnone, et al. filed Jun. 30, 2015.
U.S. Appl. No. 14/793,685 Arnone, et al. filed Jul. 7, 2015.
U.S. Appl. No. 14/793,704 Arnone, et al. filed Jul. 7, 2015.
U.S. Appl. No. 14/797,016 Arnone, et al. filed Jul. 10, 2015.
U.S. Appl. No. 15/362,660 Arnone, et al. filed Nov. 28, 2016.
U.S. Appl. No. 15/365,628 Arnone, et al. filed Nov. 30, 2016.
U.S. Appl. No. 15/367,541 Arnone, et al. filed Dec. 2, 2016.
U.S. Appl. No. 15/369,394 Arnone, et al. filed Dec. 5, 2016.
U.S. Appl. No. 15/370,425 Arnone, et al. filed Dec. 6, 2016.
U.S. Appl. No. 15/375,711 Arnone, et al. filed Dec. 12, 2016.
U.S. Appl. No. 15/387,117 Arnone, et al. filed Dec. 21, 2016.
U.S. Appl. No. 15/392,887 Arnone, et al. filed Dec. 28, 2016.
U.S. Appl. No. 15/393,212 Arnone, et al. filed Dec. 28, 2016.
U.S. Appl. No. 15/394,257 Arnone, et al. filed Dec. 29, 2016.
U.S. Appl. No. 15/396,352 Arnone, et al. filed Dec. 30, 2016.
U.S. Appl. No. 15/396,354 Arnone, et al. filed Dec. 30, 2016.
U.S. Appl. No. 15/396,365 Arnone, et al. filed Dec. 30, 2016.
U.S. Appl. No. 15/406,474 Arnone, et al. filed Jan. 13, 2017.
U.S. Appl. No. 15/413,322 Arnone, et al. filed Jan. 23, 2017.
U.S. Appl. No. 15/415,833 Arnone, et al. filed Jan. 25, 2017.
U.S. Appl. No. 15/417,030 Arnone, et al. filed Jan. 26, 2017.
U.S. Appl. No. 15/422,453 Arnone, et al. filed Feb. 1, 2017.
U.S. Appl. No. 15/431,631 Arnone, et al. filed Feb. 13, 2017.
U.S. Appl. No. 151434,843 Arnone, et al. filed Feb. 16, 2017.
U.S. Appl. No. 15/439,499 Arnone, et al. filed Feb. 22, 2017.
U.S. Appl. No. 15/449,249 Arnone, et al. filed Mar. 3, 2017.
U.S. Appl. No. 15/449,256 Arnone, et al. filed Mar. 3, 2017.
U.S. Appl. No. 15/450,287 Arnone, et al. filed Mar. 6, 2017.
U.S. Appl. No. 15/456,079 Arnone, et al. filed Mar. 10, 2017.
U.S. Appl. No. 15/457,827 Arnone, et al. filed Mar. 13, 2017.
U.S. Appl. No. 15/458,490 Arnone, et al. filed Mar. 14, 2017.
U.S. Appl. No. 15/460,195 Arnone, et al. filed Mar. 15, 2017.
U.S. Appl. No. 15/463,725 Arnone, et al. filed Mar. 20, 2017.
U.S. Appl. No. 15/464,282 Arnone, et al. filed Mar. 20, 2017.
U.S. Appl. No. 15/465,521 Arnone, et al. filed Mar. 21, 2017.
U.S. Appl. No. 15/470,869 Arnone, et al. filed Mar. 27, 2017.
U.S. Appl. No. 15/473,523 Arnone, et al. filed Mar. 29, 2017.
U.S. Appl. No. 15/483,773 Arnone, et al. filed Apr. 10, 2017.
U.S. Appl. No. 15/489,343 Arnone, et al. filed Apr. 17, 2017.
U.S. Appl. No. 15/491,617 Arnone, et al. filed Apr. 19, 2017.
U.S. Appl. No. 15/583,295 Arnone, et al. filed May 1, 2017, 2017.

(56) References Cited

OTHER PUBLICATIONS

U.S. Appl. No. 15/589,780 Arnone, et al. filed May 8, 2017.
U.S. Appl. No. 14/185,847 Arnone, et al., filed Feb. 20, 2014.
U.S. Appl. No. 14/203,459 Arnone, et al., filed Mar. 10, 2014.
U.S. Appl. No. 14/205,272 Arnone, et al., filed Mar. 11, 2014.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.
U.S. Appl. No. 14/815,764 Arnone, et al. filed Jul. 31, 2015.
U.S. Appl. No. 14/815,774 Arnone, et al. filed Jul. 31, 2015.
U.S. Appl. No. 14/817,032 Arnone, et al. filed Aug. 3, 2015.
U.S. Appl. No. 14/822,890 Arnone, et al. filed Aug. 10, 2015.
U.S. Appl. No. 14/823,951 Arnone, et al. filed Aug. 11, 2015.
U.S. Appl. No. 14/823,987 Arnone, et al. filed Aug. 11, 2015.
U.S. Appl. No. 14/825,056 Arnone, et al. filed Aug. 12, 2015.
U.S. Appl. No. 14/835,590 Arnone, et al. filed Aug. 25, 2015.
U.S. Appl. No. 14/836,902 Arnone, et al. filed Aug. 26, 2015.
U.S. Appl. No. 14/839,647 Arnone, et al. filed Aug. 28, 2015.
U.S. Appl. No. 14/842,684 Arnone, et al. filed Sep. 1, 2015.
U.S. Appl. No. 14/842,785 Arnone, et al. filed Sep. 1, 2015.
U.S. Appl. No. 14/854,021 Arnone, et al. filed Sep. 14, 2015.
U.S. Appl. No. 14/855,322 Arnone, et al. filed Sep. 15, 2015.
U.S. Appl. No. 14/859,065 Arnone, et al. filed Sep. 18, 2015.
U.S. Appl. No. 14/865,422 Arnone, et al. filed Sep. 25, 2015.
U.S. Appl. No. 14/867,809 Arnone, et al. filed Sep. 28, 2015.
U.S. Appl. No. 14/868,287 Arnone, et al. filed Sep. 28, 2015.
U.S. Appl. No. 14/868,364 Arnone, et al. filed Sep. 28, 2015.
U.S. Appl. No. 14/869,809 Arnone, et al. filed Sep. 29, 2015.
U.S. Appl. No. 14/869,819 Arnone, et al. filed Sep. 29, 2015.
U.S. Appl. No. 14/885,894 Arnone, et al. filed Oct. 16, 2015.
U.S. Appl. No. 14/919,665 Arnone, et al. filed Oct. 21, 2015.
U.S. Appl. No. 14/942,844 Arnone, et al. filed Nov. 16, 2015.
U.S. Appl. No. 14/942,883 Arnone, et al. filed Nov. 16, 2015.
U.S. Appl. No. 14/949,759 Arnone, et al. filed Nov. 23, 2015.
U.S. Appl. No. 14/952,758 Arnone, et al. filed Nov. 25, 2015.
U.S. Appl. No. 14/952,769 Arnone, et al. filed Nov. 25, 2015.
U.S. Appl. No. 14/954,922 Arnone, et al. filed Nov. 30, 2015.
U.S. Appl. No. 14/954,931 Arnone, et al. filed Nov. 30, 2015.
U.S. Appl. No. 14/955,000 Arnone, et al. filed Nov. 30, 2015.
U.S. Appl. No. 14/956,301 Arnone, et al. filed Dec. 1, 2015.
U.S. Appl. No. 14/965,231 Arnone, et al. filed Dec. 10, 2015.
U.S. Appl. No. 14/965,846 Arnone, et al. filed Dec. 10, 2015.
U.S. Appl. No. 14/981,640 Arnone, et al. filed Dec. 28, 2015.
U.S. Appl. No. 14/981,775 Arnone, et al. filed Dec. 28, 2015.
U.S. Appl. No. 14/984,943 Arnone, et al. filed Dec. 30, 2015.
U.S. Appl. No. 14/984,965 Arnone, et al. filed Dec. 30, 2015.
U.S. Appl. No. 14/984,978 Arnone, et al. filed Dec. 30, 2015.
U.S. Appl. No. 14/985,107 Arnone, et al. filed Dec. 30, 2015.
U.S. Appl. No. 14/995,151 Arnone, et al. filed Jan. 13, 2016.
U.S. Appl. No. 14/974,432 Arnone, et al. filed Dec. 18, 2015.
U.S. Appl. No. 14/997,413 Arnone, et al. filed Jan. 15, 2016.
U.S. Appl. No. 15/002,233 Arnone, et al. filed Jan. 20, 2016.
U.S. Appl. No. 15/005,944 Arnone, et al. filed Jan. 25, 2016.
U.S. Appl. No. 15/011,322 Arnone, et al. filed Jan. 29, 2016.
U.S. Appl. No. 15/051,535 Arnone, et al. filed Feb. 23, 2016.
U.S. Appl. No. 15/053,236 Arnone, et al. filed Feb. 25, 2016.
U.S. Appl. No. 15/057,095 Arnone, et al. filed Feb. 29, 2016.
U.S. Appl. No. 15/060,502 Arnone, et al. filed Mar. 3, 2016.
International Search Report and Written Opinion, PCT/US2014/056418, dated Dec. 29, 2014.

* cited by examiner

SECOND CHANCE LOTTERY SKILL WAGERING INTERLEAVED GAME SYSTEM

CROSS REFERENCE TO RELATED APPLICATIONS

The current application is a continuation of U.S. patent application Ser. No. 15/074,999 filed Mar. 18, 2016, and issued as U.S. Pat. No. 9,672,698 on Jun. 6, 2017, which is a continuation of Patent Cooperation Treaty Application No. PCT/US14/56418, filed Sep. 18, 2014, which claims the benefit of U.S. Provisional Patent Application No. 61/879,658, filed Sep. 18, 2013, the disclosure of which is incorporated by reference herein in its entirety.

This application references Patent Cooperation Treaty Application No. PCT/US11/26768, filed Mar. 1, 2011, now U.S. Pat. No. 8,632,395, issued Jan. 21, 2014, Patent Cooperation Treaty Application No. PCT/US11/63587, filed Dec. 6, 2011, published as U.S. Patent Application Publication No. 2013/0296021 A1, and Patent Cooperation Treaty Application No. PCT/US12/58156, filed Sep. 29, 2012, now U.S. Pat. No. 8,790,170, issued Jul. 29, 2014, the contents of each of which are hereby incorporated by reference.

FIELD

Embodiments of the present disclosure are generally related to communication and processing of data, and more specifically to the communication and processing of lottery data.

BACKGROUND

The gaming machine manufacturing industry has traditionally developed gaming machines with a gambling game. A gambling game is typically a game of chance, which is a game where the outcome of the game is generally dependent solely on chance (such as a slot machine). A game of chance can be contrasted with a game of skill where the outcome of the game can depend upon a player's skill with the game. Gambling games are typically not as interactive and do not include graphics as sophisticated as an entertainment game, which is a game of skill such as a video game.

SUMMARY

Devices, systems, methods and processor-readable storage media in accordance with embodiments provide a lottery skill wagering interleaved game (SWig) system.

In an example embodiment, a skill wagering interleaved game system including a player's gaming device constructed to: scan a code of a lottery ticket; communicate, to an electromechanical gaming machine by a network, the scanned code of the lottery ticket; provide a second chance skill-based game; generate a user interface display that depicts a representation of the second chance skill-based; and the electromechanical gaming machine coupled to the player's gaming device by the network and constructed to receive credit from a player, comprising: a real credit controller configured to determine a wager outcome of a gambling game for a wager of an amount of credit; and a game world controller coupled to the real credit controller, wherein the game world controller is configured to: receive, from the player's gaming device, the scanned code of the lottery ticket; determine the amount of credit for the wager using the scanned code of the lottery ticket; trigger the wager of the amount of credit in the real credit controller; receive, from the wager controller the wager outcome for the wager; communicate to the player's gaming device by the network the wager outcome; determine whether the second chance skill-based game should be provided; and communicate to the player's device via the network instructions to provide the second chance skill-based game.

In a further embodiment, the wager outcome determines game world resources available in the second chance skill-based game.

In another embodiment, the game world controller is further constructed to provide a reward to a player based on a winning wager outcome.

In some embodiments, the game world controller is further constructed to provide player loyalty points to the player based on a losing wager outcome.

In another embodiment, the second chance skill-based game provides a second amount of credits based on the amount of credit used for the wager.

DETAILED DESCRIPTION

Figure 1:
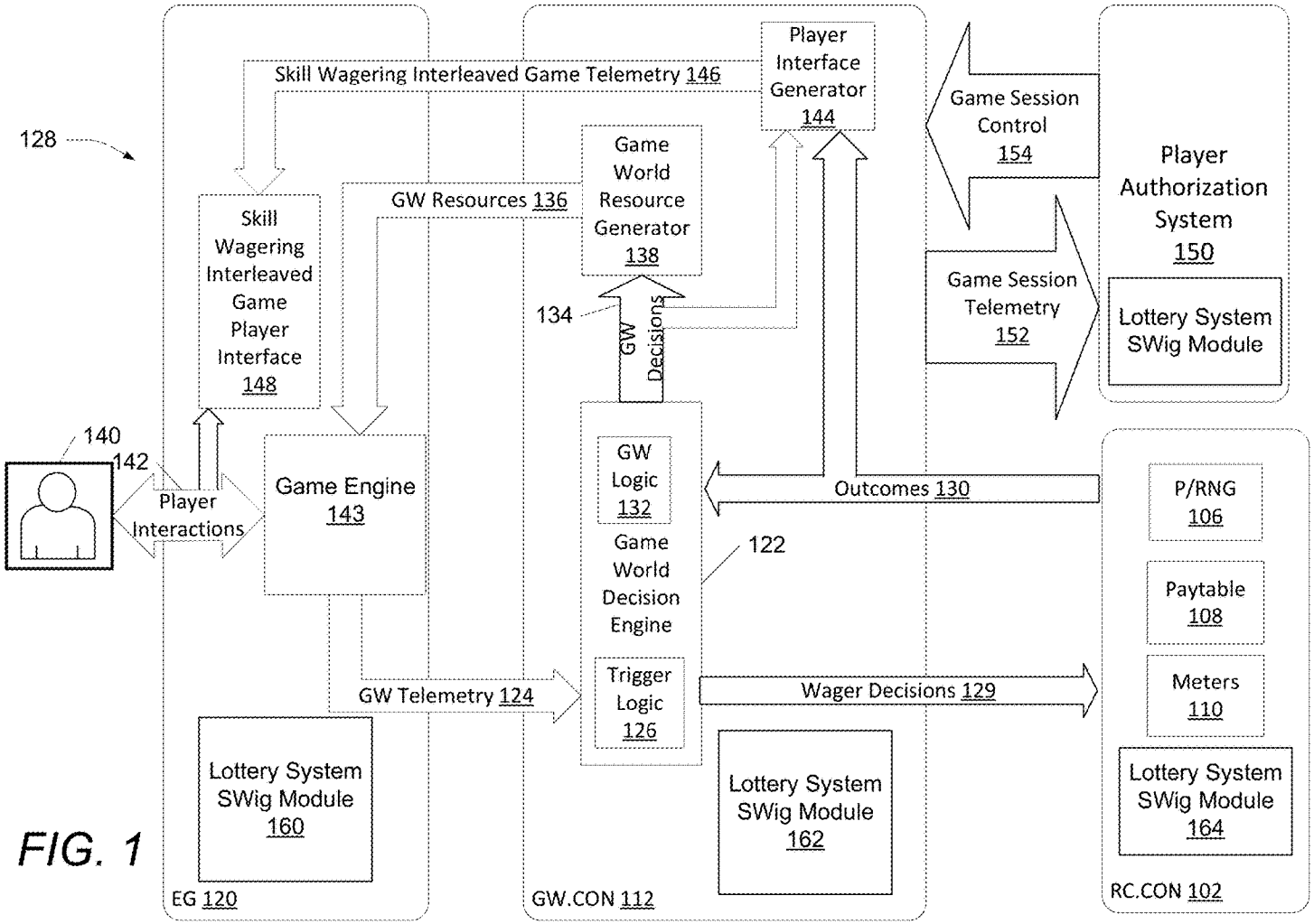
FIG. 1 illustrates a system diagram of a lottery SWig system providing a skill wagering interleaved game in accordance with an embodiment.

Turning now to the drawings, systems and methods for operation of lottery SWig systems are illustrated. In several embodiments, a lottery SWig system provides a form of a combined skill and wagering game that integrates both a gambling game and a skill-based entertainment game creating a skill wagering interleaved game (SWig). The gambling game is provided by a real credit controller (RC.CON) that manages the gambling game. An entertainment game system (Eg) executes the skill-based components of the lottery SWig system entertainment game for user entertainment. The Eg is operatively coupled to the RC.CON by a game world controller (GW.CON). The GW.CON manages the configuration of the lottery SWig system entertainment game. In certain embodiments, the lottery SWig system also includes a player interface that is associated with either one or both of the RC.CON providing the gambling game and the Eg providing the interactive entertainment game. For purposes of the discussion, a player or player interactions are represented in a lottery SWig system by the electronic representation of interactions between the player and the game, typically received via the player interface, and a player profile of the lottery SWig system associated with the player.

In operation of a lottery SWig system, a player acts upon various types of elements (E) of an interactive entertainment game in a game world environment. Elements are game world resources utilized within the interactive entertainment game to advance entertainment game gameplay. Wagers can be made in accordance with a gambling proposition on the outcome of gambling events in the gambling game as triggered by the player's use of one or more elements of the interactive entertainment game. The wagers may be made using real world credits (RC). The real world credits can be credits in a real world currency, or can be credits in a virtual currency that may or may not have a real world value. The outcomes of gambling events in the gambling game can cause consumption, loss or accrual of RC. In accordance with some embodiments, the outcomes of gambling events in the gambling game can influence elements in the interactive entertainment game such as, but not limited to: restoring a consumed element; causing the loss of an element; and restoration or placement of a fixed element.

In many embodiments, during gameplay of the interactive entertainment game using the elements, a player can optionally consume and/or accrue game world credits (GWC) within the interactive entertainment game. These GWC credits can be in the form of, but are not limited to, game world credits, experience points, and points generally. In many embodiments, a gambling proposition of a gambling game includes a wager of GWC for a randomly generated payout of interactive entertainment game GWC or elements on the outcome of a gambling event in a gambling game. The payout for a wager of entertainment game GWC or elements may include a randomly generated payout of elements in accordance with some embodiments. In a number of embodiments, an amount of GWC and/or elements used as part of a wager can have a RC value if cashed out during and/or at the end of a lottery SWig system gameplay session.

Example elements (E) in an interactive entertainment game include enabling elements (EE) that are game world resources utilized during the player's play of the interactive entertainment game and whose consumption by the player while playing the interactive entertainment game can trigger a wager in a gambling game. Another, non-limiting, example of an element in an interactive entertainment game is a reserve enabling element (REE), which is an element that converts into one or more enabling elements (EE) upon occurrence of a release event during lottery SWig system gameplay. Yet another, non-limiting, example of element of an interactive entertainment game is an actionable element (AE) which is an element that is acted upon during gameplay of the interactive entertainment game to trigger a wager in the gambling game; and may or may not be restorable during normal play of the interactive entertainment game. Still another, non-limiting, example of an element in an interactive entertainment game is a common enabling element (CEE) which is an element that may be shared by two or more players and causes a gambling event and associated wager to be triggered in the gambling game when used by one of the players during play of the interactive entertainment game. In progressing through interactive entertainment game gameplay, elements can be utilized by a player during interactions with a controlled entity (CE). A CE is a character, entity, inanimate object, device or other object under control of a player.

In accordance with some embodiments of a lottery SWig system, gameplay of the interactive entertainment game progresses triggering gambling events and associated wagers on the outcome of the gambling event in a gambling game. The triggering of the gambling event and/or wager can be dependent upon a game world variable such as, but not limited to: a required game object (RGO), a required environmental condition (REC), or a controlled entity characteristic (CEC). A RGO is a specific game object in an interactive entertainment game acted upon for an AE to be completed. A non-limiting example of an RGO is a specific key needed to open a door. A REC is a game state present within an interactive entertainment game for an AE to be completed. A non-limiting example of an REC is daylight whose presence enables a character to walk through woods. A CEC is a status of the CE within an interactive entertainment game for an AE to be completed. A non-limiting example of a CEC is requirement that a CE have full health points before entering battle. Although various gameplay resources such as, but not limited to, GWC, RC and elements (E) as discussed above may be used to trigger a gambling event and/or wager in a gambling game, one skilled in the art will recognize that any gameplay resource can be utilized to advance lottery SWig system gameplay as well as form the basis for a trigger of a wager as appropriate to the specification of a specific application in accordance with various embodiments. Various skill wagering interleaved games are discussed in Patent Cooperation Treaty Application No. PCT/US11/26768, filed Mar. 1, 2011, now U.S. Pat. No. 8,632,395, issued Jan. 21, 2014, and Patent Cooperation Treaty Application No. PCT/US11/63587, filed Dec. 6, 2011, published as US Patent Application Publication No. 2013/0296021 A1, each disclosure of which is hereby incorporated by reference in its entirety.

In many embodiments, a lottery SWig system integrates an interactive entertainment game with a gambling game. In several embodiments, a lottery SWig system can utilize a GW.CON to monitor gameplay of the interactive entertainment game executed by an Eg for a trigger of a gambling event. The trigger for gambling event can be detected from the skillful execution of the interactive entertainment game in accordance with at least one gambling event occurrence rule. The trigger of the gambling event can be communicated to a RC.CON. In response to notification of the trigger, the RC.CON triggers a gambling event and a RC wager on the outcome of the gambling event that is made in accordance with a wager trigger rule within the gambling game executed by the RC.CON. The wager can produce a wager payout as a randomly generated payout of both RC and gameplay resources. In addition, gameplay of an interactive entertainment game in a lottery SWig system can be modified by the GW.CON upon the wager payout. In various embodiments, interactive entertainment game gameplay can advance through the performance of lottery SWig system player actions. For purposes of this discussion, a game player action is an action during lottery SWig system gameplay that can be performed by a player or to a player.

In several embodiments, a gambling event occurrence can be determined from one or more game world variables within an interactive entertainment game that are used to trigger a gambling event and/or associated wager in a gambling game. Game world variables can include, but are not limited to, passage of a period of time during lottery SWig system entertainment game gameplay; a result from a lottery SWig system entertainment game gameplay session (such as, but not limited to, achieving a goal or a particular score); a player action that is a consumption of an element; or a player action that achieves a combination of elements to be associated with a player profile.

In numerous embodiments, an interactive entertainment game modification is an instruction of how to modify interactive entertainment game gameplay resources based upon one or more of a gambling game payout and game world variables. An interactive entertainment game modification can modify any aspect of an interactive entertainment game, such as, but is not limited to, an addition of a period of time available for a current gameplay session for the interactive entertainment game of lottery SWig system, an addition of a period of time available for a future lottery SWig system entertainment game gameplay session or any other modification to the interactive entertainment game elements that can be utilized during entertainment game gameplay. In some embodiments, an interactive entertainment game modification can modify a type of element whose consumption triggers a gambling event occurrence. In many embodiments, an interactive entertainment game modification can modify a type of element whose consumption is not required in a gambling event occurrence.

In a number of embodiments, a player interface can be utilized that depicts a status of the interactive entertainment game in the lottery SWig system. A player interface can depict any aspect of an interactive entertainment game including, but not limited to, an illustration of lottery SWig system entertainment game gameplay advancement as a player plays the lottery SWig system.

In some embodiments, a player authorization system 150 is used to authorize a lottery SWig system gaming session. The player authorization system receives game session information 152 that may include, but is not limited to, player, Eg, GW.CON and RC.CON information from the GW.CON 112. The player authorization system uses the player, Eg, GW.CON and RC.CON information to regulate a lottery SWig system gaming session. In some embodiments, the player authorization system may also assert control of a lottery SWig system game session 154. Such control may include, but is not limited to, ending a lottery SWig system game session, initiating gambling in a lottery SWig system game session, ending gambling in a lottery SWig system game session but not ending a player's play of the entertainment game portion of the lottery SWig system game, and changing from real credit wagering in a lottery SWig system to virtual credit wagering, or vice versa.

Lottery SWig Systems

In many embodiments, a lottery SWig system integrates high-levels of entertainment content from an interactive entertainment game (game of skill) and a gambling experience from a game of chance (gambling game). A lottery SWig system provides for random gambling game outcomes that are independent of player skill while providing a gaming experience (as measured by obstacles/challenges encountered, time of play and other factors) shaped by the player's skill. A lottery SWig system in accordance with an embodiment is illustrated in FIG. 1. The lottery SWig system 128 includes a RC.CON 102, a GW.CON 112, and an Eg 120. The RC.CON 102 is communicatively coupled with the GW.CON 112. The Eg 120 is also communicatively coupled with the GW.CON 112.

In many embodiments, the Eg includes a lottery SWig system module 160 that implements one or more features of a lottery SWig system as described herein.

In several embodiments, the RC.CON 102 is an operating system for one or more gambling games provided by the lottery SWig system 128 and controls and operates the gambling games. The one or more gambling games consume wagers in the form of RC. A gambling game can increase or decrease an amount of RC based on random gambling game outcomes, where the gambling proposition of a gambling game is typically regulated by gaming control bodies. In many embodiments, the RC.CON 120 includes a pseudo random or random number generator (P/RNG) 106; one or more real-world credit pay tables 108; RC meters 110; and other software constructs that enable a game of chance to offer a fair and transparent gambling proposition, and the auditable systems and functions that can enable the game to obtain gaming regulatory body approval.

The P/RNG 106 includes software and/or hardware performing processes that can generate random or pseudo random outcomes. The one or more pay tables 108 are tables that can be used in conjunction with the P/RNG 106 to determine an amount of RC earned as a function of lottery SWig system gameplay. Examples of a pay table include, but are not limited to pay tables used in a conventional slot machine. There can be one or more pay tables 108 in the RC.CON 102. The pay tables 108 are used to implement one or more gambling propositions for the one or more gambling games. In some embodiments, selection of the pay table 108 to use to resolve a gambling event and/or wager can be based on factors including, but not limited to, game progress a player has earned through skillful play of the interactive entertainment game; and eligibility of the player for bonus rounds. RCs can be decremented and/or augmented based on the outcome of the P/RNG 106 according to a pay table 108 independent of player skill. In certain embodiments, an amount of RC can be used as criteria in order to enter higher levels of the interactive entertainment game provided by the lottery SWig system interleaved game. In accordance with some embodiments, RC can be carried forward to higher game levels or paid out if a cash-out is opted for by a player. The amount of RC used to enter a specific level of the game level need not be the same for each level.

In many embodiments, the RC.CON 102 includes a lottery SWig system module 164 that implements one or more features of a lottery SWig system as described herein.

In many embodiments, the GW.CON 112 includes a lottery SWig system module 162 that implements one or more features of a lottery SWig system as described herein.

In many embodiments, the GW.CON 112 manages the overall lottery SWig system operation, with the RC.CON 102 and the Eg 120 being support units to the GW.CON 112. In several embodiments, the GW.CON 112 may include mechanical, electronic and/or software systems for a lottery SWig system entertainment game. The GW.CON 112 provides an interface between the interactive entertainment game provided by the Eg 120 and the gambling game provided by RC.CON 102. The GW.CON 112 includes a game world decision engine 122 that receives game world information (e.g., game world telemetry) 124 from the Eg 120. The game world decision engine 122 uses the game world information 124, along with trigger logic 126 to generate gambling and/or wagering information (e.g., wager decisions) 129 about triggering a gambling event and/or an associated wager of RC in the RC.CON 102. In some embodiments, the game world information 124 includes, but is not limited to, game world variables from the Eg 120 that indicate the state of the Eg and the interactive entertainment game that is being played by a player 140; and player actions and interactions 142 between the player and entertainment game provided by the Eg 120. The gambling and/or wager information 129 may include, but is not limited to, an amount of RC to be wagered, a trigger of a gambling game, and a selection of a pay table 108 to be used by the gambling game.

In some embodiments, the game world decision engine 122 also receives gambling game outcome information 130 from the RC.CON 102. The decision engine 122 uses the gambling game outcome information 130, in conjunction with the game world information 124 and game world logic 132 to generate game world update information (game world decisions) 134 about what kind of game world resources 136 are to be provided to the Eg 120. A game world resource generator 138 generates the game world resources 136 based on the game world update information 134 provided by the game world decision engine 122 and transmits the generated resources to the Eg 120.

In various embodiments, the game world decision engine 122 also calculates the amount of GWC to award to the player 140 based at least in part on the player's skillful execution of the interactive entertainment game of the lottery SWig system as determined from the game world information 124. In some embodiments, gambling game outcome information 130 may also be used to determine the amount of GWC that should be awarded to the player.

In some embodiments, the game world update information 134 and gambling game outcome information 130 are provided to a player interface generator 144. The player interface generator 144 receives the game world update information 134 and gambling game outcome information 130 and generates lottery SWig system information 146 describing the state of the lottery SWig system. In some embodiments, the lottery SWig system information 146 may include, but is not limited to, GWC amounts earned, lost or accumulated by the player through skillful execution of the interactive entertainment game; and RC amounts won, lost or accumulated as determined from the gambling game outcome information 130 and the RC meters 110.

The GW.CON 112 can further couple to the RC.CON 102 to determine the amount of RC available in the game and other wagering metrics of the gambling game. Thus, the GW.CON 112 may potentially affect the amount of RC in play for participation in the gambling events of a gambling game provided by the RC.CON 102 in some embodiments. The GW.CON 112 may additionally include various audit logs and activity meters. In some embodiments, the GW.CON 112 can also couple to a centralized server for exchanging various data related to the player and the activities of the player during game play of a lottery SWig system.

In some embodiments, the GW.CON 112 operatively couples to the Eg 120 to manage the interactive entertainment game provided. In several embodiments, game world credits (GWC) are player points earned or depleted as a function of player skill as a function of player performance in the context of the game. GWC may be analogous to the score in a typical video game. A lottery SWig system entertainment game can have one or more scoring criteria embedded within the GW.CON 112 and/or the Eg 120 that reflect player performance against goal(s) of an interactive entertainment game. In some embodiments, GWC can be carried forward from one level of sponsored gameplay of the entertainment to another level. In many embodiments, GWC can be used within the Eg to purchase in-game items, including but not limited to, elements (E) that have particular properties, power ups for existing items, and other item enhancements. In many embodiments, GWC may be used to earn entrance into a sweepstakes drawing; to earn entrance in a tournament with prizes; to score in the tournament; and/or to participate and/or score in any other game event. In many embodiments, GWC can be stored on a player tracking card or in a network-based player tracking system where the GWC is attributed to a specific player.

In some embodiments, the operation of the GW.CON 112 does not affect the provision of the gambling game by the RC.CON 102 except for player choice parameters that are allowable in a gambling game. Examples of player choice parameters include, but not limited to, wager terms such as but not limited to a wager amount; speed of game play (for example, by pressing a button or pulling a handle of a slot machine); and/or agreement to wager into a bonus round. In accordance with these embodiments, the RC.CON 102 provides a fair and transparent, non-skill based gambling proposition co-processor to the GW.CON 112. In the illustrated embodiment, the transfer of gambling game outcome information 130 shown between the GW.CON 112 and the RC.CON 102 allows the GW.CON 112 to obtain information from the RC.CON 102 as to the amount of RC available in the gambling game. In various embodiments, the communication link can also be used to convey a status operation of the RC.CON 102. In a number of embodiments, the communication link used to provide the gambling and/or wagering information 129 between the RC.CON 102 and the GW.CON 112 can further be used to communicate the various gambling control factors which the RC.CON 102 uses as input. Examples of gambling control factors include, but are not limited to, the number of RC consumed per gambling event; and/or the player's election to enter a jackpot round. In FIG. 1, the GW.CON 112 is also shown as communicatively coupling to the player's player interface 148 directly, as the GW.CON 112 can utilize the player interface 148 to communicate certain interactive entertainment game information including but not limited to, club points; player status; control of the selection of choices; and messages which a player can find useful in order to adjust the interactive entertainment game experience or understand the gambling status of the player in the gambling game in the RC.CON 102.

In various embodiments, the Eg 120 manages and controls the visual, audio, and player control for the interactive entertainment game. In certain embodiments, the Eg 120 accepts input from a player through a set of hand controls, and/or head, gesture, and/or eye tracking systems and outputs video, audio and/or other sensory output to a player interface. In many embodiments, the Eg 120 can exchange data with, and accept control information from, the GW.CON 112. In several embodiments, the Eg 120 can be implemented using a processing device executing a specific entertainment game software program. Examples of processing devices that may host the Eg 120 include, but are not limited to, electronic gaming machines, personal computers such as tablet computers, desktop computers and laptop computers, gaming consoles, smartphones, and personal digital assistants. In numerous embodiments, the Eg 120 can be an electromechanical game system that provides an electromechanical skill wagering interleaved game. An electromechanical skill wagering interleaved game executes an electromechanical entertainment game for player entertainment. The electromechanical entertainment game can be any game that utilizes both mechanical and electrical components, where the game operates as a combination of mechanical motions performed by at least one player or the electromechanical game itself. Various electromechanical skill wagering interleaved games are discussed in Patent Cooperation Treaty Application No. PCT/US12/58156, filed Sep. 29, 2012, now U.S. Pat. No. 8,790,170, issued Jul. 29, 2014, the contents of which are hereby incorporated by reference in their entirety.

In the shown embodiment of FIG. 1, the Eg 120 operates mostly independently from the GW.CON 112 via the transfer of game world resources 136, however, the GW.CON 112 can communicate certain interactive entertainment game resources including control parameters to the Eg 120 to affect the Eg's execution, such as (but not limited to) changing the difficulty level of the game. In various embodiments, these interactive entertainment game control parameters can be based on a gambling outcome of a gambling game that was triggered by an element (E) in the interactive entertainment game being acted upon by the player. The Eg 120 can accept this input from the GW.CON 112, make adjustments, and continue interactive entertainment game gameplay all the while running seamlessly from the player's perspective.

The execution of the interactive entertainment game by the Eg 120 is mostly skill-based, except for where the processes performed by the Eg 120 can inject complexities into the game by chance in the normal operation of gameplay to create unpredictability in the interactive entertainment game. The Eg 120 can also communicate player choices made in the game to the GW.CON 112, included in the game world information 124, such as but not limited to the player's utilization of the elements of the interactive entertainment game during the player's skillful execution of the interactive entertainment game. In this architecture, the GW.CON is interfaced to the Eg 120 in order to allow the transparent coupling of an interactive entertainment game to a fair and transparent random chance gambling game, providing a seamless perspective to the player that they are playing a typical popular interactive entertainment game (which is skill based).

In several embodiments, the RC.CON 102 can accept a trigger to resolve a gambling event in a gambling game in response to actions taken by the player in the interactive entertainment game as conveyed by the Eg 120 to the GW.CON 112. The GW.CON 112 triggers the gambling event in the gambling game using trigger logic 126, and the RC.CON 102 resolves the gambling event in the background of the overall lottery SWig system from the player's perspective and provides information about the outcome of the gambling event to the GW.CON 112 to expose the player to certain aspects of the gambling game. Examples of aspects of the gambling game that may be exposed to the player include, but are not limited to, odds of certain outcomes, amount of RC in play, and amount of RC available. In a number of embodiments, the RC.CON 102 can accept modifications in the amount of RC wagered on each individual gambling event, in the number of gambling events per minute the RC.CON 102 can resolve entrance into a bonus round, and other factors. One skilled in the art will note that these factors can take a different form than that of a typical slot machine. An example of a varying wager amount that the player can choose can include, but is not limited to, gameplay using a more difficult interactive entertainment game level. These factors can increase or decrease the amount wagered per individual gambling game in the same manner that a standard slot machine player can decide to wager more or less credits for each pull of the handle. In several embodiments, the RC.CON 102 can communicate a number of factors back and forth to the GW.CON 112, via an interface, such that an increase/decrease in a wagered amount can be related to the change in player profile of the player in the interactive entertainment game. In this manner, a player can control a wager amount per gambling event in the gambling game with the change mapping to a parameter or component that is applicable to the interactive entertainment game experience.

In many embodiments, a lottery SWig system integrates a video game style gambling game provided by a gambling machine where the gambling game (including an RC.CON 102 and RC) may not be player skill based. In some embodiments, the gambling game may allow players to use their skills to earn club points which a gaming establishment operator can translate into rewards including, but not limited to, tournament opportunities and prizes for the players. The actual exchange of monetary funds earned or lost directly from gambling against a game of chance in a gambling game, such as a slot machine, is preserved. At the same time, a rich environment of rewards to stimulate gamers can be established within the interactive entertainment game. In several embodiments, the lottery SWig system can leverage entertainment game titles popular with gamers and provide a sea change in a gaming establishment environment to attract players with games that are more akin to the type of entertainment that a younger generation desires. In various embodiments, players can use their skill in the interactive entertainment game towards building and banking GWC. The GWC may then by be used to win tournaments and various prizes as a function of skills of the gamer. In a number of embodiments, the lottery SWig system minimizes the underlying changes applied to the aforementioned entertainment software for the skill wagering interleaved game to operate within an interactive entertainment game construct.

Therefore, a plethora of complex game titles and environments can be rapidly and may be inexpensively deployed in a gambling environment.

In certain embodiments, lottery SWig systems also allow players to gain entry into subsequent competitions through the accumulation of game world credits (GWC) as a function of the user's demonstrated skill at the game. These competitions can pit individual players or groups of players against one another and/or against the operator of a gambling game (such as but not limited to a gaming establishment) to win prizes based upon a combination of chance and skill. These competitions can be asynchronous events whereby players participate at a time and/or place of their choosing or synchronized events whereby players participate at a specific time and/or venue.

In many embodiments, one or more players can be engaged in playing a skill based interactive entertainment game executed by the Eg 120. In various embodiments, a lottery SWig system can include an interactive entertainment game that includes head to head play between a single player and the computer; between two or more players against one another; or multiple players playing against the computer and/or each other as well as a process by which a player can bet on the outcome of an interactive entertainment game. In some embodiments, the interactive entertainment game can be a game where the player is not playing against the computer or any other player such as games where the player is effectively playing against himself or herself.

Figure 2:
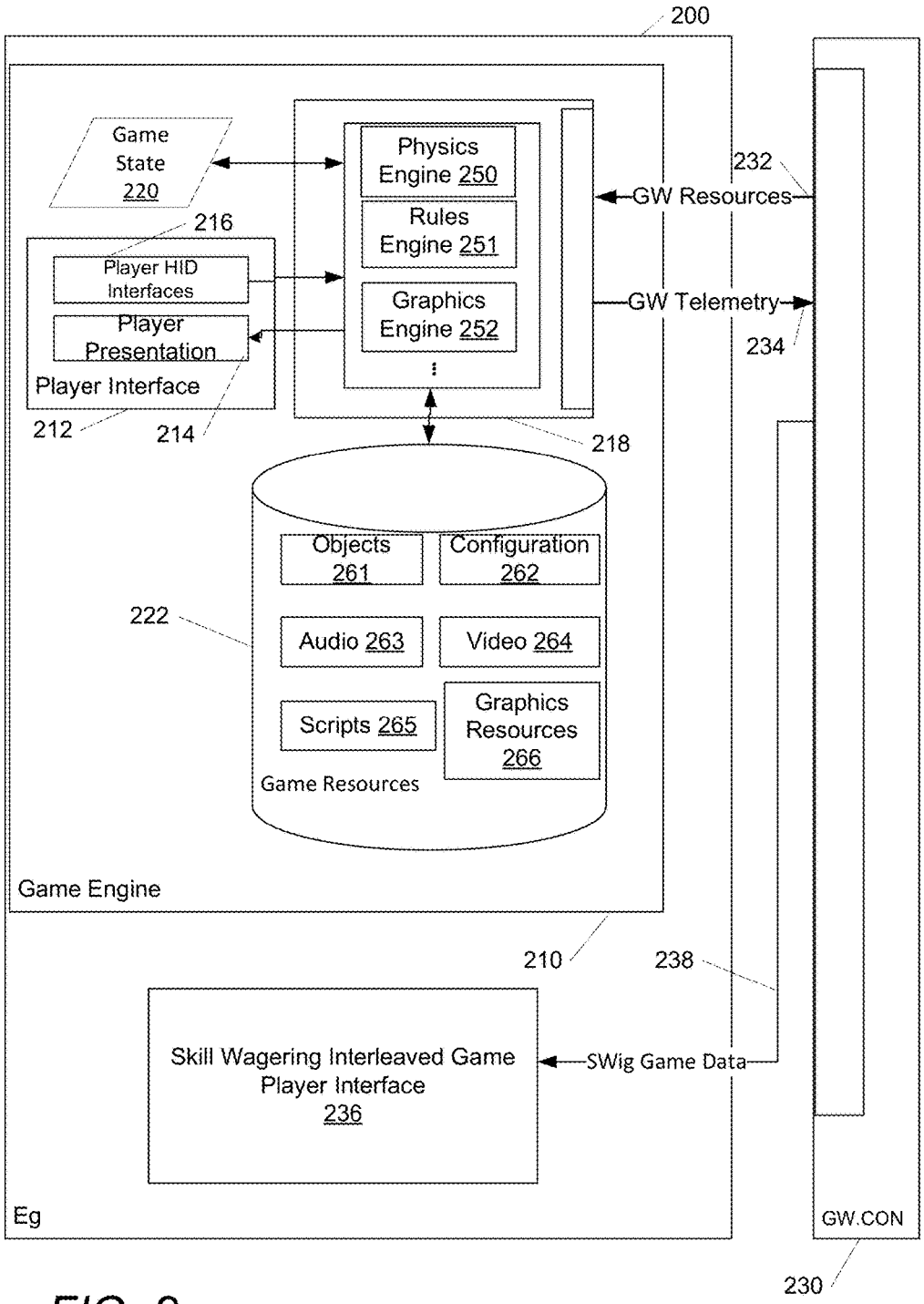
FIG. 2 illustrates a block diagram of components of an interactive entertainment game in accordance with an embodiment.

The components of an Eg in accordance with an embodiment are shown in FIG. 2. The Eg 200 may be part of the interactive entertainment game system itself, may be a software module that is executed by the interactive entertainment game system, or may provide an execution environment for the interactive entertainment game on a particular host entertainment game system. The Eg 200 and an associated interactive entertainment game are hosted by a processing device. Embodiments of processing devices include, but are not limited to, electronic gaming machines, video game consoles, smart phones, personal computers, tablet computers, or the like. In several embodiments, an Eg 200 of a lottery SWig system includes a game engine 210 that generates a player interface 212 for interaction with a player. The player interface includes a player presentation 214 that is presented to a player through the player interface. The player presentation may include audio features, visual features or tactile features, or any combination of these preceding features. The player interface 212 further includes one or more human input devices (HIDs) 216 that the player can use to interact with the lottery SWig system. Various components or sub-engines 218 of the game engine can read data from a game state 220 in order to implement the features of the Eg. In some embodiments, components or sub-engines 218 of the game engine 210 can include, but are not limited to, a physics engine 250, a rules engine 251, and/or a graphics engine 252. The physics engine 250 is used to simulate physical interactions between virtual objects in the game state. The rules engine 251 implements the rules of the interactive entertainment game and an RNG that may be used for influencing or determining certain variables and/or outcomes to provide a randomizing influence on game play. The graphics engine 252 is used to generate a visual representation of the game state to the player. Furthermore, the sub-engines 218 may also include an audio engine (Not Shown) to generate audio outputs for the player interface 214.

During operation, the game engine 210 reads and writes game resources 222 stored on a data store of the Eg host. The game resources 222 may include game objects 261 having graphics and/or control logic used to implement game world objects of the interactive entertainment game. In various embodiments, the game resources may also include, but are not limited to, video files 264 that are used to generate cut-scenes for the interactive entertainment game; audio files 263 used to generate music, sound effects, etc. within the interactive entertainment game; configuration files 262 used to configure the features of the interactive entertainment game; scripts or other types of control code 265 used to implement various game play features of the interactive entertainment game; and graphics resources 266 such as textures, objects, etc. that are used by the game engine to render objects displayed in an interactive entertainment game.

In operation, components of the game engine 210 read portions of the game state 220 and generate the player presentation 214 for the player which is presented to the player using the player interface 212. The player perceives the presentation and provides player inputs using the HIDs 216. The corresponding player inputs are received as player actions or inputs by various components of the game engine 210. The game engine 210 translates the player actions into interactions with the virtual objects of the game world stored in the game state 220. Components of the game engine use the player interactions with the virtual objects of the interactive entertainment game and the interactive entertainment game state 220 to update the game state 220 and update the presentation 214 presented to the user. The process loops in a game loop continuously while the player plays the lottery SWig system.

The Eg 200 provides one or more interfaces between an Eg 200 and other components of a lottery SWig system, such as a GW.CON 230. The Eg 200 and the other lottery SWig system components communicate with each other using the interfaces. The interface may be used to pass various types of data; and to communicate and receive messages, status information, commands and the like. In certain embodiments, the Eg 200 and the GW.CON 230 exchange game world resources 232 and game world information (game world telemetry) 234. In some embodiments, the communications include requests by the GW.CON 230 that the Eg 200 update the game state 220 using information provided by the GW.CON 230. In many embodiments, a communication by the GW.CON 230 requests that the Eg 200 update one or more game resources 222 using information provided by the GW.CON 230. In a number of embodiments, the Eg 200 provides all or a portion of the game state to the GW.CON 230. Is some embodiments, the Eg 200 may also provide information about one or more of the game resources 222 to the GW.CON 230. In some embodiments, the communication includes player actions that the Eg 200 communicates to the GW.CON 230. The player actions may be low level player interactions with the player interface 212, such as manipulation of an HID, or may be high level interactions with game objects as determined by the interactive entertainment game. The player actions may also include resultant actions such as modifications to the lottery SWig system state 220 or game resources 222 resulting from the player's actions taken in the lottery SWig system entertainment game. In some embodiments, player actions include, but are not limited to, actions taken by entities such as non-payer characters (NPC) of the interactive entertainment game that act on behalf of or under the control of the player.

In some embodiments, the Eg 200 includes a lottery SWig system player interface 236 used to communicate lottery SWig system data 238 to and from the player. The communications from the lottery SWig system interface 236 include, but are not limited to, information used by the player to configure gambling game RC wagers, and information about the gambling game RC wagers such as, but not limited to, RC balances and RC amounts wagered.

Figure 3:
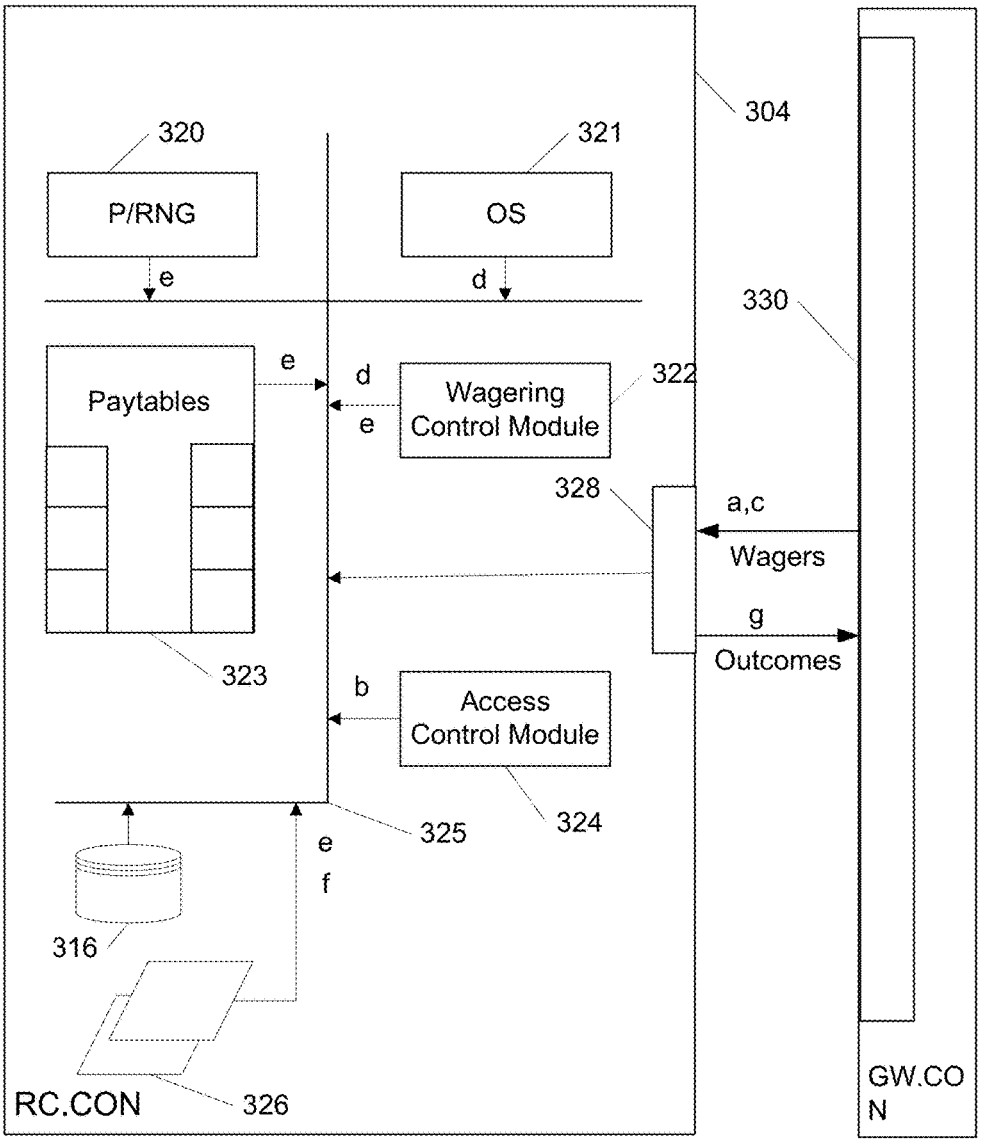
FIG. 3 illustrates a block diagram of components of a real credit controller in accordance with an embodiment.

Components of an RC.CON in accordance with an embodiment are shown in FIG. 3. The RC.CON 304 has an operating system OS 321 which controls the functions of the RC.CON 304; a random number generator (RNG) 320 to produce random numbers or pseudo random numbers; one or more pay tables 323 which includes a plurality of factors indexed by the random number to be multiplied with an amount of RC committed in a wager; and a wagering control module 322 whose processes may include, but are not limited to, pulling random numbers, looking up factors in the pay tables, multiplying the factors by an amount of RC wagered, and administering one or more RC credit meters 326. The RC.CON 304 may also include storage for statuses, wagers, wager outcomes, meters and other historical events in a storage device 316. An authorization access module 324 provides a process to permit access and command exchange with the RC.CON 304 and access to a repository (a credit meter) 326 for the amount of RC which player has deposited in the lottery SWig system. An external interface 328 allows the RC.CON 304 to interface to another system or device, such as a GW.CON 330. The various RC.CON modules and components can interface with each other via an internal bus 325 and/or other appropriate communication mechanism.

In various embodiments, an RC.CON 304 may use an RNG provided by an external system. The external system may be connected to the RC.CON 304 by a local area network (LAN) or a wide area network (WAN) such as the Internet. In some embodiments, the external RNG is a central deterministic system such as a regulated and controlled random numbered ball selection device or some other system that provides random or pseudo random numbers to one or more connected RC.CONs. In numerous embodiments, the interface between the RC.CON 304 and other systems/devices including an external RNG may be the Internet. However, other methods of communication may be used including, but not limited to, a LAN, a USB interface, and/or some other method by which two electronic devices could communicate with each other.

In numerous embodiments, signaling occurs between various components of an RC.CON 304 and an external system, such as GW.CON 330. In some of these embodiments, the purpose of the RC.CON 304 is to manage wagering on gambling events and to provide random (or pseudo random) numbers from an RNG. The external system requesting wagering support instructs the RC.CON 304 as to the pay table 328 to use and/or the amount of RC to wager. Next, the external system signals the RC.CON 304 to trigger a gambling event with an associated wager on the results of the gambling event wager. The RC.CON 304 resolves the gambling event and determines the outcomes of the wager. The RC.CON can then inform the external system as to the outcome of the wager (the amount of RC won,) and/or the amount of RC in the player's account in the credit repository.

In various embodiments, a second communication exchange between the RC.CON 304 and an external system relates to the external system using an RNG result support from the RC.CON 304. In this exchange, the external system requests an RNG result from the RC.CON 304. In response, the RC.CON 304 returns an RNG result as a function of an internal RNG or an RNG external to the RC.CON 304 to which the RC.CON 304 is connected.

In some embodiments, a communication exchange between the RC.CON 304 and an external system relate to the external system support for coupling an RNG result to a particular pay table contained in the RC.CON 304. In such an exchange, the external system instructs the RC.CON 304 as to the pay table 323 to use, and requests a result whereby the RNG result would be operatively coupled to the requested pay table 323. The result of the coupling is returned to the external system. In such an exchange, no actual RC wager is conducted, but might be useful in coupling certain non-RC wagering interactive entertainment game behaviors and propositions to the same final resultant wagering return which is understood for the lottery SWig system to conduct wagering. In a number of embodiments, some or all of the various commands and responses discussed above can be combined into one or more communication packets.

The RC.CON 304 operates in the following manner in accordance with some embodiments. The process begins by a RC.CON 304 receiving signals from an external system requesting a connection to RC.CON 304 (a). The request includes credentials for the external system. The Access Authorization Module 324 determines that the external system is authorized to connect to RC.CON 304 (b) and transmits an authorization response to the external system. The external systems provide a request for a gambling event to be performed to the RC.CON 304. The request may include an indication of a wager amount on a proposition in the gambling event, and a proper pay table 323 to use to resolve the wager. The external system then communicates a signal to trigger the gambling event (c).

The OS 321 instructs the Wager Control Module 322 as to the amount of the RC wager and the Pay Table 323 to select as well as to resolve the wager (d). In response to the request to execute the gambling event, the wager control module 222 requests an P/RNG result from the P/RNG 320 (e); retrieves a proper pay table or tables from the pay tables 323 (e); adjusts the RC of the player in the RC repository 326 as instructed (e); applies the P/RNG result to the particular pay table or tables 323 (e); and multiplies the resultant factor from the Pay Table by the amount of RC wagered to determine the result of the wager (e). The wager Control Module 322 then adds the amount of RC won by the wager to the RC repository 326 (f); and provides the outcome of the wager, and the amount of RC in the repository and the RC won to the external system (g). It should be understood that there may be many different embodiments of an RC.CON 304 including embodiments where many modules and components of the RC.CON 304 are located in various servers and locations, so the foregoing is not meant to be exhaustive or all inclusive, but rather provide information on various embodiments of an RC.CON 304.

Figure 4:
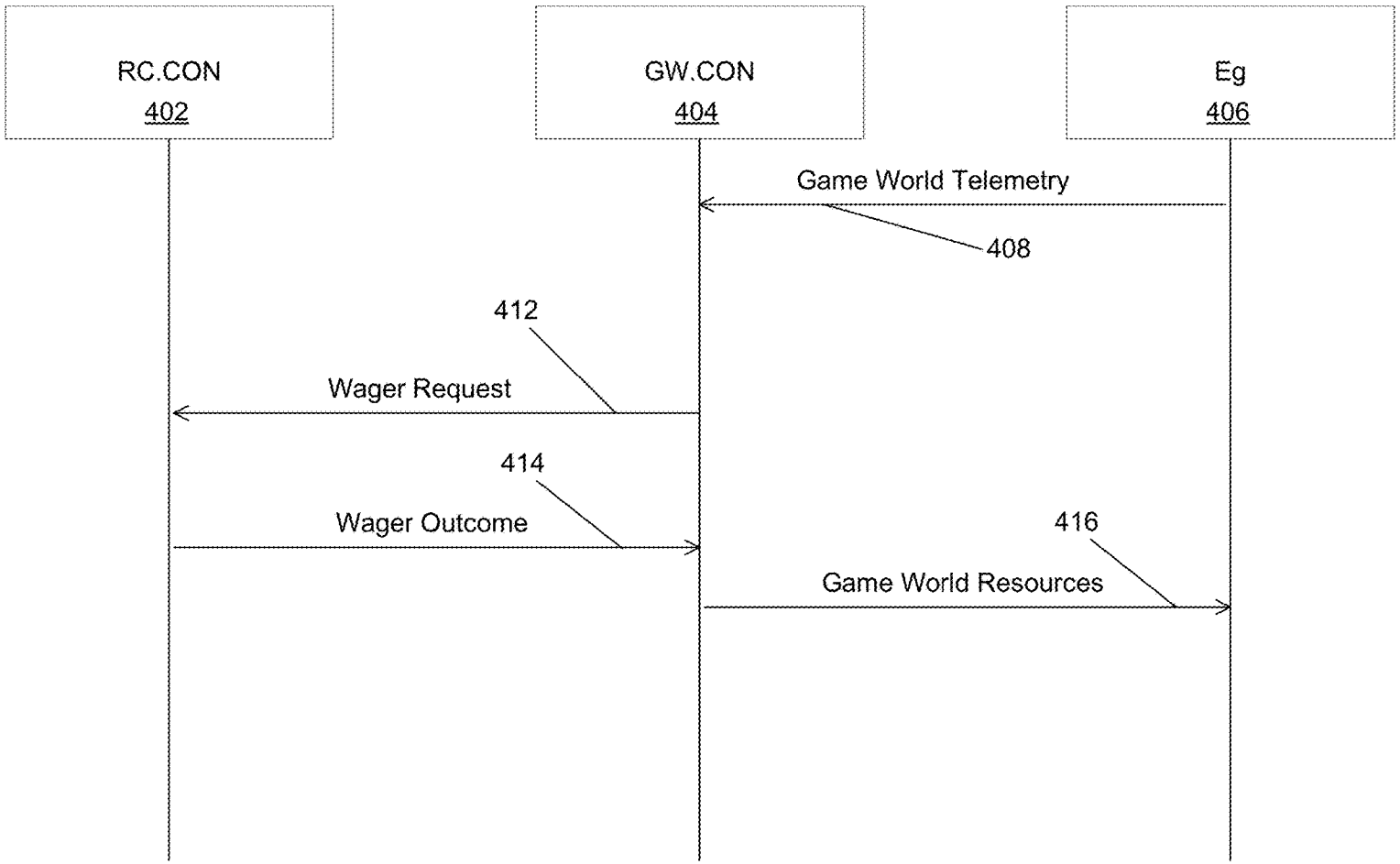
FIG. 4 illustrates a timing diagram of interactions between components of a lottery SWig system entertainment game in accordance with an embodiment.

A timing diagram of a process that facilitates interactions between components of a lottery SWig system providing an interactive entertainment game and a gambling game in accordance with an embodiment is shown in FIG. 4. The components of the lottery SWig system process include RC.CON 402, GW.CON 404, and Eg 406. The process begins with the Eg 406 detecting a player performing a player action in the interactive entertainment game using a player interface. The Eg 406 provides the GW.CON 404 with game world data (408). In some embodiments, the game world data includes but is not limited to, the player interaction detected by the Eg 406. In some embodiments, the GW.CON 404 can provide the Eg 406 with information as to the amount of elements (E) that will be consumed by the player action in response to receiving the game world data. The GW.CON 404 may also provide information to configure a function that controls E consumption, decay or addition to the Eg 406 in response to receiving the game world data. The Eg 406 can, based upon the function, consume an amount of E designated by the GW.CON 404 to couple to the player action. Upon detection that the player action is a gameplay gambling event, the GW.CON 404 can communicate a request to provide a gambling event to an RC.CON 402 (412). The request for a gambling event may include the wager terms associated with the gameplay gambling event in some embodiments. The RC.CON 402 can consume RC in executing the gambling event and resolving the wager. The RC.CON 402 can return RC as a payout from the wager. The RC.CON 402 can inform (414) the GW.CON 404 as to the outcome of the gambling event and/or any associated wagers. Based on the outcome of the gambling event, the GW.CON 404 can determine game world resources in the interactive entertainment game to award to the player. The GW.CON may provide information about the game world resources award to the Eg 406 (416). In some embodiments, the game world resources may be a payout of E based upon the outcome of the gambling event and/or a wager associated with the gambling event. The Eg 406 can reconcile and combine the payout of E with the E already ascribed to the player in the lottery SWig system entertainment game. In various embodiments, the Eg 406 can provide an update to the GW.CON 404 as to the updated status of the interactive entertainment game based upon reconciling the payout of E. The GW.CON 404 may then determine an amount of GWC to award in the interactive entertainment game based upon the updated status and provide the GWC amount to the Eg 406 in response to the status update in some embodiments.

The following is an example of the sequence of events in the timing diagram of FIG. 4 in a lottery SWig system that provides a Sudoku game as the interactive entertainment game in accordance with an embodiment. In a Sudoku game, a player can take an action, such as selecting a number to be placed in a section of a Sudoku board. The Eg 406 provides information about the player action to the GW.CON 404 (408). The information about the player action may include, but is not limited to, the player's choice of a symbol, the position on the Sudoku puzzle board that the symbol is played, and whether or not the symbol as played was a correct symbol in terms of eventually solving the Sudoku puzzle. The GW.CON 404 can process the information concerning the placement of the symbol, and determine that the player action consumes a symbol (E) with each placement. The GW.CON 404 provides information about the consumption of the symbol to the Eg 406. The Eg 406 then will consume the E based upon the placement of the symbol. The GW.CON can also determine that a gambling event is triggered by the placement of the symbol and transmit a request (412) to the RC.CON 402. The request may indicate that 3 credits of RC are to be wagered on the outcome of the gambling event to match the placement of the symbol (E) that is consumed and indicate a particular pay table (table Ln-RC) that the RC.CON 402 is to use to resolve the wager. The RC.CON 402 can consume the 3 credits for the wager, execute gambling event, and resolve the specified wager. In executing the gambling event and resolving the wager, the RC.CON 402 can determine that the player hits a jackpot of 6 credits and allocate the 6 credits of RC to the credit meter. In other embodiments, any of a variety of credits, pay tables and/or payouts can be utilized in the resolution of gambling events as appropriate to the requirements of specific applications. The RC.CON 402 also provides gambling event outcome information to the GW.CON 404 (414) that informs the GW.CON 404 that 6 credits of RC net were won as a payout from the wager. Based on the gambling event outcome information, the GW.CON 404 can determine that 2 additional symbols are to be made available to the player. The GW.CON 404 provides the game world resources information (416) to the Eg 406 informing the Eg 406 to add 2 additional symbols (E) to the set of symbols available to a player based upon the gambling game payout. The Eg 406 can then add 2 symbols (E) to the number of symbol placements available to a player in the Sudoku game. The GW.CON can receive an update from the Eg 406 as to the total amount of E associated with the player. The GW.CON can log the new player score (GWC) in the game (as a function of the successful placement of the symbol) based on the update, and provide a score update the Eg to add 2 extra points of GWC to the player's score. Although the above discussion describes the performance of the processes shown in FIG. 4 in the context of a Sodoku entertainment game, similar processes can be utilized to provide other types of entertainment games appropriate to the requirements of specific applications in accordance with embodiments.

In many embodiments, a player can bet on whether or not the player will beat another player. These bets can be made, for example, on the final outcome of an interactive entertainment game, and/or the state of the interactive entertainment game along various intermediary points (such as but not limited to the score at the end of a period of time of an interactive entertainment game session) and/or on various measures associated with the interactive entertainment game. Players can bet against one another, or engage the computer in a head to head competition in the context of the player's skill level in the interactive entertainment game in question. As such, players can have a handicap associated with their player profile that describes their skill in the interactive entertainment game which can be the professed skill of the player in some embodiments. The handicap may be used by a GW.CON to offer appropriate bets around the final and/or intermediate outcomes of the interactive entertainment game; to condition sponsored gameplay as a function of player skill; and/or to select players across one or more lottery SWig systems to participate in head to head games and/or tournaments.

Many embodiments of the lottery SWig system enable the maximization of the number of players able to compete competitively by handicapping the players based upon skill in the interactive entertainment game and utilizing a skill normalization module to modify the interactive entertainment game based upon the handicaps of players to even the skill level of players competing against each other. Handicapping enables players of varying performance potential to compete competitively regardless of absolute skill level, such as, but not limited to, where a player whose skill level identifies the player as a beginner can compete in head to head or tournament play against a highly skilled player with meaningful results.

In several embodiments, wagers can be made among numerous lottery SWig systems with a global betting manager (GBM). The GBM is a system that coordinates wagers that are made across multiple lottery SWig systems by multiple players. In some embodiments, the GBM can also support wagers by third parties relative to the in-game performance of other players. The GBM can be a stand-alone system; can be embedded in one of a number of systems including the GW.CON, Eg, or any remote server capable of providing services to a lottery SWig system; or can operate independently on one or a number of servers on-site at a gaming establishment, as part of a larger network and/or the Internet or cloud in general.

Although various components of lottery SWig systems are discussed above, lottery SWig systems can be configured with any component as appropriate to the specification of a specific application in accordance with embodiments. In certain embodiments, components of a lottery SWig system, such as a GW.CON, RC.CON, and/or Eg, can be configured in different ways for a specific lottery SWig system gameplay application. Stand-alone and network connected lottery SWig systems are discussed below.

Stand-Alone Lottery SWig Systems

Figure 5A:
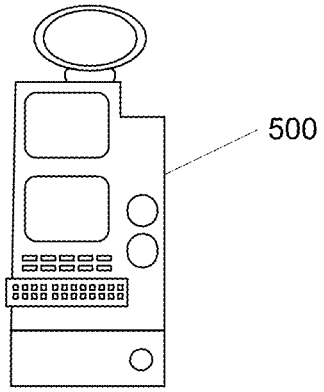
FIGS. 5A, 5B, 5C, and 5D illustrate various devices that host a lottery SWig system in accordance with embodiments.
Figure 5B:
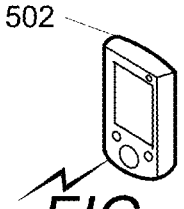
Figure 5C:
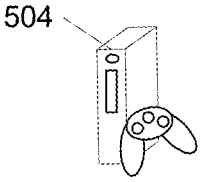
Figure 5D:
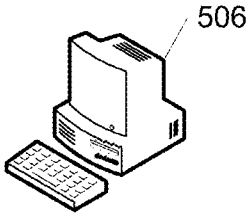

Various types of devices that may be used to host a lottery SWig system on a stand-alone device in accordance with various embodiments are shown in FIGS. 5A to 5D. An electronic gaming machine 500 may be used to host a lottery SWig system. The electronic gaming machine 500, shown in FIG. 5A may be physically located in various types of gaming establishments. A portable device 502 shown in FIG. 5B is a device that may wirelessly connect to a network and may be used to host a lottery SWig system. Examples of portable devices 502 include, but are not limited to, a tablet computer and/or a smartphone. A gaming console 504, shown in FIG. 5C, may also be used to host a lottery SWig system. A personal computer 506, shown in FIG. 5D, may also be used to host a lottery SWig system in accordance with several embodiments. Indeed, any device including sufficient processing and/network communication capabilities can be utilized to host a lottery SWig system as appropriate to the requirements of specific applications in accordance with embodiments.

Network-Connected Lottery SWig Systems

Some lottery SWig systems in accordance with many embodiments can operate locally while being network connected to draw services from remote locations or to communicate with other lottery SWig systems. In many embodiments, operations associated with a lottery SWig system utilizing an interactive entertainment game can be performed across multiple devices. These multiple devices can be implemented using a single server or a plurality of servers such that a lottery SWig system is executed as a system in a virtualized space such as, but not limited to, where the RC.CON and GW.CON are large scale centralized servers in the cloud operatively coupled to widely distributed Eg controllers or clients via the Internet.

In many embodiments, a RC.CON server can perform certain functionalities of a RC.CON of a lottery SWig system. In certain embodiments, a RC.CON server includes a centralized odds engine which can generate random outcomes (such as, but not limited to, win/loss outcomes) for gambling events in a gambling game. The RC.CON server can perform a number of simultaneous or pseudo-simultaneous runs in order to generate random outcomes for a variety of odds percentages that one or more networked lottery SWig systems can use. In a number of embodiments, an RC.CON of a lottery SWig system can communicate information to a RC.CON server including, but not limited to, pay tables, maximum speed of play for a gambling game, gambling game monetary denominations, or any promotional RC provided by the operator of the lottery SWig system. In some specific embodiments, a RC.CON server can communicate information to a RC.CON of a lottery SWig system including, but not limited to, RC used in the gambling game, player profile information, play activity, and/or a profile associated with a player.

In several embodiments, a GW.CON server can perform the functionality of the GW.CON across various lottery SWig systems. These functionalities can include, but are not limited to, providing a method for monitoring high scores on select groups of games, coordinating interactions between gameplay layers, linking groups of games in order to join them in head to head tournaments, and acting as a tournament manager.

In a variety of embodiments, management of player profile information can be performed by a patron management server separate from a GW.CON server. A patron management server (e.g., the patron management server 1006 of FIG. 11) can manage information related to a player profile. The managed information in the player profile may include, but is not limited to, data concerning controlled entities (characters) in interactive entertainment game gameplay; game scores; game elements; RC and GWC associated with particular players; and tournament reservations. Although a patron management server is discussed separate from a GW.CON server, a GW.CON server also performs the functions of a patron management server in some embodiments. In a number of embodiments, a GW.CON of a lottery SWig system can communicate information to a patron management server. The information sent by the GW.CON to the patron management system may include, but is not limited to, GWC and RC used in a game; player profile information; play activity; profile information for players; synchronization information between a gambling game and an interactive entertainment game; and/or information about other aspects of a lottery SWig system. In several embodiments, a patron management server can communicate patron information to a GW.CON of a lottery SWig system. The patron information may include, but is not limited to, interactive entertainment game title and type; tournament information; table Ln-GWC tables; special offers; character or profile setup and synchronization information between a gambling game and an interactive entertainment game; and information about any other aspect of a lottery SWig system.

In numerous embodiments, an Eg server provides a host for managing head to head play operating on a network of Egs connected to the Eg server via a network such as the Internet. The Eg server provides an environment where players can compete directly with one another and interact with other players. Although an Eg server is discussed as separate from a GW.CON server, the functionalities of an Eg server and GW.CON server can be combined in a single server in some embodiments.

Servers connected via a network to implement lottery SWig systems in accordance with many embodiments can communicate with each other to provide services utilized by a lottery SWig system. In several embodiments, a RC.CON server can communicate with a GW.CON server. In some embodiments, the RC.CON server can communicate with a GW.CON server to communicate any type of information as appropriate for a specific application. Examples of the information that may be communicated include, but are not limited to, information used to configure the various simultaneous or pseudo simultaneous odds engines executing in parallel within the RC.CON to accomplish lottery SWig system functionalities; information used to determine metrics of RC.CON performance such as random executions run and/or outcomes for tracking system performance; information used to perform audits and/or provide operator reports; and information used to request the results of a random run win/loss result for use in one or more function(s) operating within the GW.CON such as, but not limited to, automatic drawings for prizes that are a function of Eg performance.

In several embodiments, a GW.CON server can communicate with an Eg server. A GW.CON server can communicate with an Eg server to communicate any type of information as appropriate for a specific application. The information that may be communicated between a GW.CON server and an Eg server includes, but is not limited to, the information for management of an Eg server by a GW.CON server during a lottery SWig system tournament. Typically, a GW.CON (such as a GW.CON that runs within a lottery SWig system or on a GW.CON server) is not aware of the relationship of the GW.CON to the rest of a tournament since the actual tournament play is managed by the Eg server in a typical configuration. Therefore, management of a lottery SWig system tournament can include, but is not limited to tasks including, but not limited to, conducting tournaments according to system programming that can be coordinated by an operator of the lottery SWig system; allowing entry of a particular player into a tournament; communicating the number of players in a tournament; and the status of the tournament (such as, but not limited to the amount of surviving players, the status of each surviving player within the game, and time remaining on the tournament); communicating the performance of players within the tournament; communicating the scores of the various players in the tournament; and providing a synchronizing link to connect the GW.CONs in a tournament with their respective Egs.

In several embodiments, a GW.CON server can communicate with a patron management server. A GW.CON server can communicate with a patron management server to communicate any type of information as appropriate for a specific application. Examples of information communicated between a GW.CON server and a patron management system include, but are not limited to, information for configuring tournaments according to system programming conducted by an operator of a lottery SWig system; information for exchange of data used to link a player's player profile to an ability to participate in various forms of lottery SWig system gameplay (such as but not limited to the difficulty of play set by the GW.CON server or the GW.CON); information for determining a player's ability to participate in a tournament as a function of a player's characteristics (such as but not limited to a player's gaming prowess or other metrics used for tournament screening); information for configuring GW.CON and Eg performance to suit preferences of a player on a particular lottery SWig system; and information for determining a player's play and gambling performance for the purposes of marketing intelligence; and information for logging secondary drawing awards, tournament prizes, RC and/or GWC into the player profile.

In many embodiments, the actual location of where various process are executed can be located either in the game-contained devices (RC.CON, GW.CON, Eg), on the servers (RC.CON server, GW.CON server, or Eg server), or a combination of both game-contained devices and servers. In a number of embodiments, certain functions of a RC.CON server, GW.CON server, patron management server and/or Eg server can operate on the local RC.CON, GW.CON and/or Eg contained with a lottery SWig system being provided locally on a device. In some embodiments, a server can be part of a server system including multiple servers, where software can be run on one or more physical devices. Similarly, in particular embodiments, multiple servers can be combined on a single physical device.

Figure 6A:
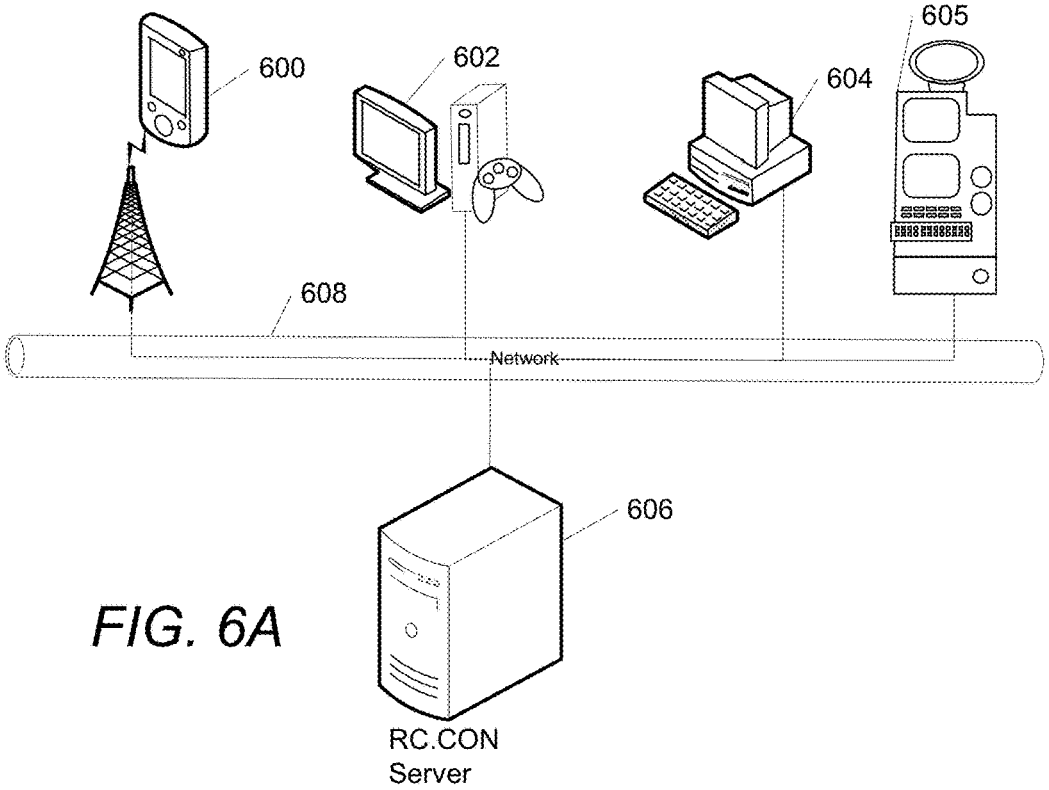
FIGS. 6A, 6B and 6C illustrate embodiments of a distributed lottery SWig system in accordance with embodiments.

Some lottery SWig systems in accordance with many embodiments can be networked with remote servers in various configurations. A networked lottery SWig system in accordance with an embodiment is illustrated in FIG. 6A. As illustrated, one or more end devices of networked lottery SWig systems such as a mobile device 600, a gaming console 602, a personal computer 604, and an electronic gaming machine 605 are connected with a RC.CON server 606 over a network 608. Network 608 is a communications network that allows processing systems to share data. Examples of the network 608 can include, but are not limited to, a Local Area Network (LAN) and a Wide Area Network (WAN). In some embodiments, the processes of an Eg and a GW.CON as described herein are executed on the individual end devices 600, 602, 604 and 605 while the processes of the RC.CON as described herein can be executed by the RC.CON server 606.

Figure 6B:
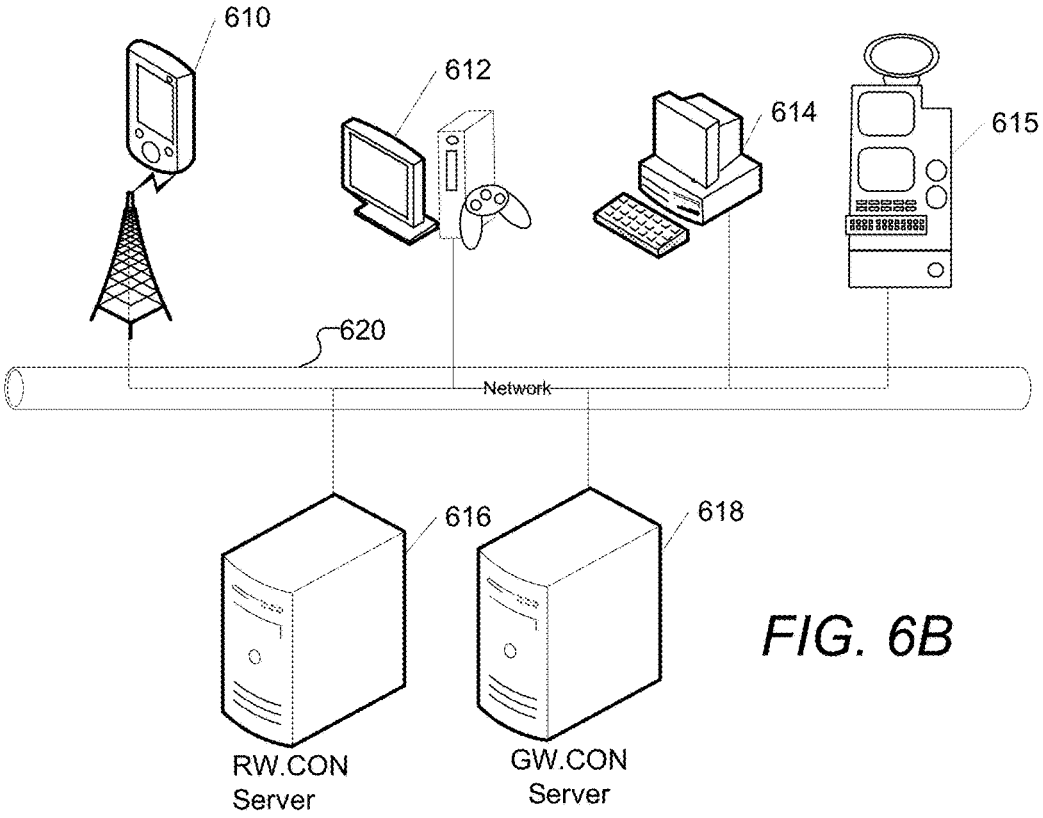

A networked lottery SWig system in accordance with another embodiment is illustrated in FIG. 6B. As illustrated, one or more end devices of networked lottery SWig systems, such as a mobile device 610, a gaming console 612, a personal computer 614, and an electronic gaming machine 615, are connected with an RC.CON server 616 and a GW.CON server 618 over a network 620. The network 620 is a communications network that allows processing systems to share data. Examples of the network 620 can include, but are not limited to, a Local Area Network (LAN) and a Wide Area Network (WAN). In some embodiments, the processes of an Eg as described herein are executed on the individual end devices 610, 612, 614 and 615. The processes of the RC.CON as described herein are executed by the RC.CON server 616 and the processes of the GW.CON as described herein are executed by the GW.CON server 618.

Figure 6C:
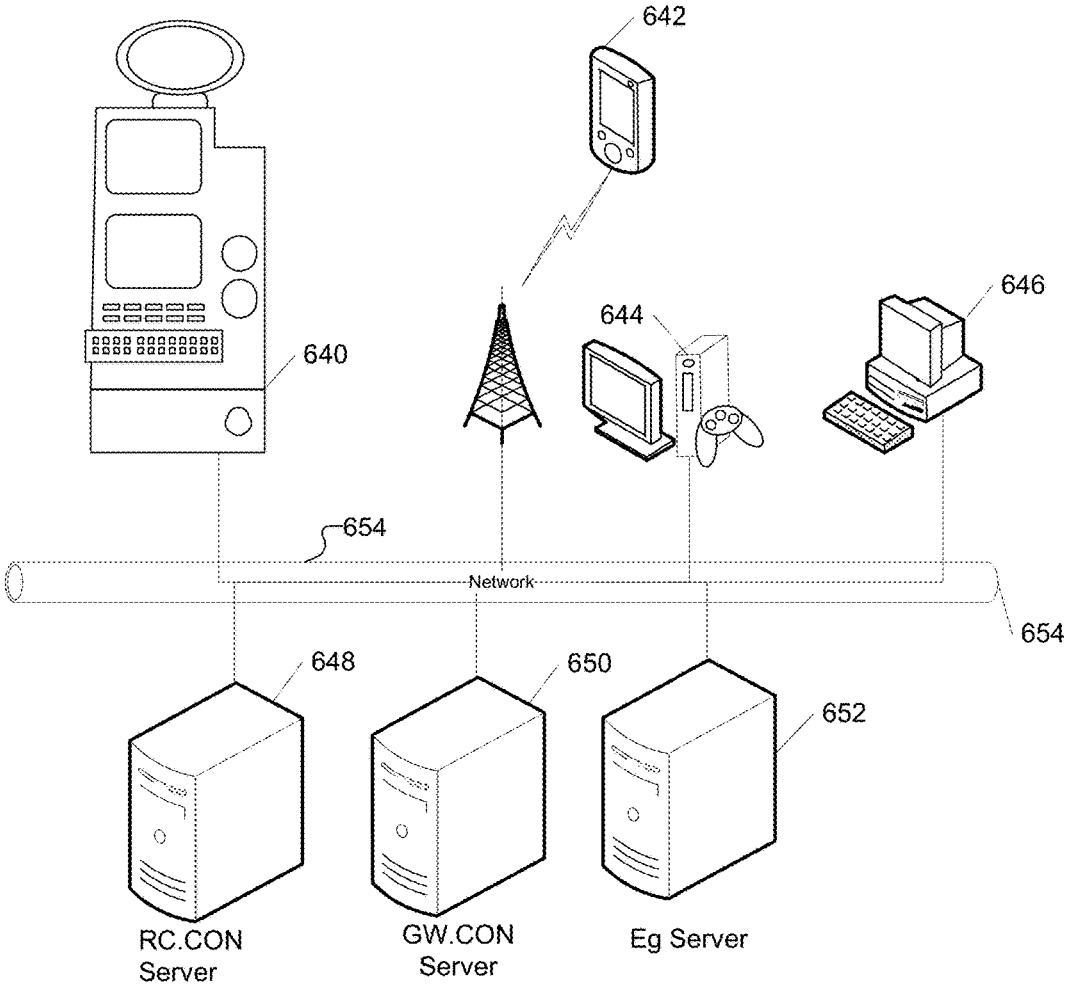

A networked lottery SWig systems in accordance with still another embodiment is illustrated in FIG. 6C. As illustrated, one or more end devices of networked lottery SWig systems, such as a mobile device 642, a gaming console 644, a personal computer 646, and an electronic gaming machine 640 are connected with an RC.CON server 648 and a GW.CON server 650, and an Eg server 652 over a network 654. The network 654 is a communications network that allows processing systems to share data. Examples of the network 654 can include, but are not limited to, a Local Area Network (LAN) and a Wide Area Network (WAN). In some embodiments, the processes of a display and player interface of an Eg as described herein are executed on the individual end devices 640, 642, 644 and 646. The processes of the RC.CON as described herein can be executed by the RC.CON server 648. The processes of the GW.CON as described herein can be executed by the GW.CON server 650 and the processes of an Eg excluding the display and player interfaces can be executed by the Eg server 652.

In various embodiments, a patron management server may be operatively coupled to components of a lottery SWig system via a network. In other embodiments, a number of other peripheral systems, such as a player management system, a gaming establishment management system, a regulatory system, and/or hosting servers can also interface with the lottery SWig systems over a network within a firewall of an operator. Also, other servers can reside outside the bounds of a network within a firewall of the operator to provide additional services for network connected lottery SWig systems.

In numerous embodiments, a network distributed lottery SWig system can be implemented on multiple different types of devices connected together over a network. Any type of device can be utilized in implementing a network distributed lottery SWig system such as, but not limited to, a gaming cabinet as used in a traditional land-based gaming establishment, a mobile processing device (such as, but not limited to a PDA, smartphone, tablet computer, or laptop computer), and a game console (such as but not limited to a Sony PlayStation®, or Microsoft Xbox®) or on a Personal Computer (PC). Each of the devices may be operatively coupled to other devices or other systems of devices via a network for the playing of head-to-head games.

Although various networked lottery SWig systems are discussed above, lottery SWig systems can be networked in any configuration as appropriate to the specification of a specific application in accordance with embodiments. In some embodiments, components of a networked lottery SWig system, such as a GW.CON, RC.CON, Eg, or other servers that perform services for a GW.CON, RC.CON and/or Eg, can be networked in different configurations for a specific networked lottery SWig system gameplay application. lottery SWig system implementations are discussed herein. Processing apparatuses that can be utilized in the implementation of lottery SWig system are discussed below.

Processing Devices

Any of a variety of processing devices can be used to host various components of a lottery SWig system in accordance with embodiments.

Figure 7A:
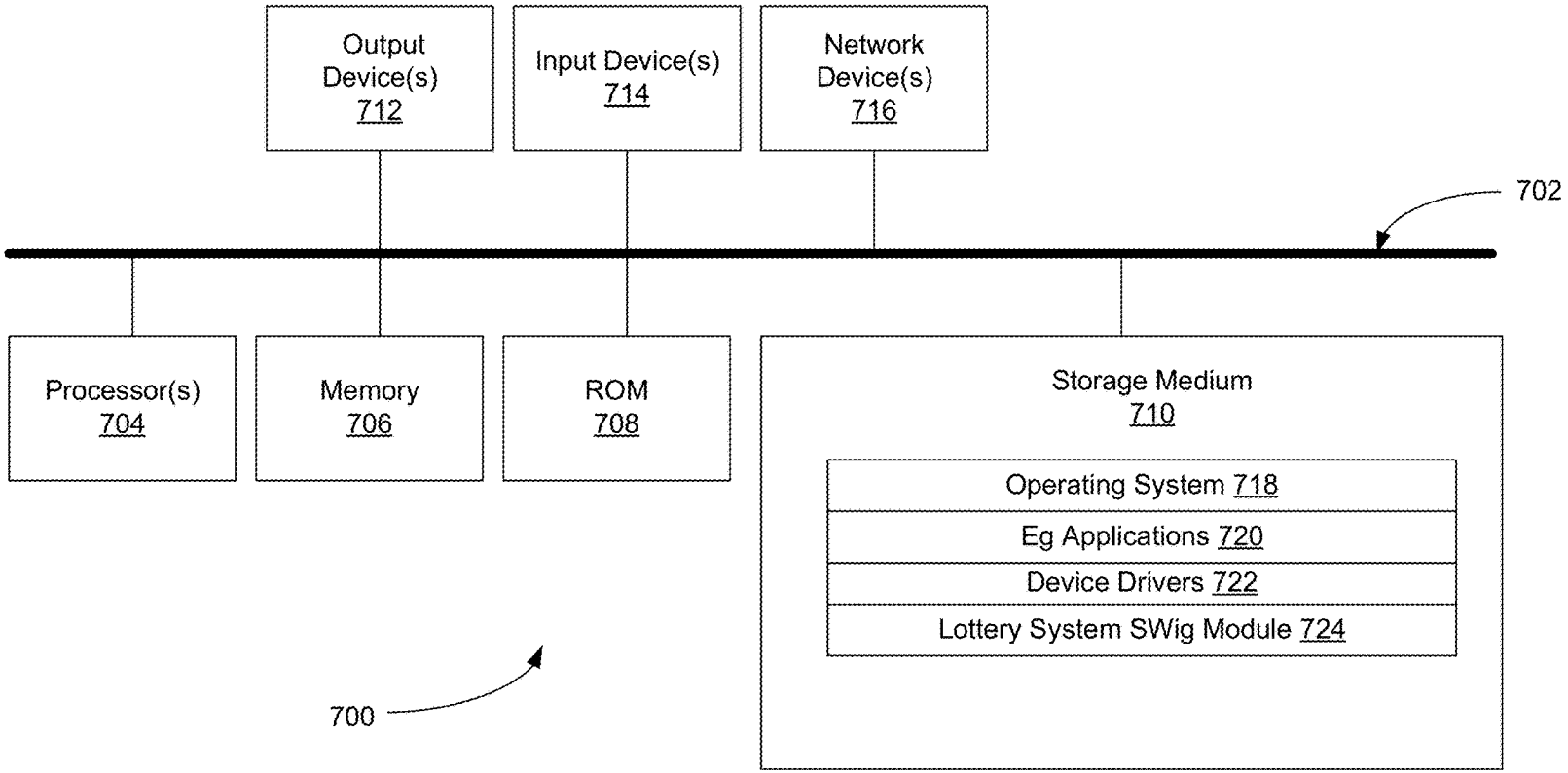
FIG. 7A illustrates a block diagram of components of a processing device of an Eg of a lottery SWig system in accordance with an embodiment.
Figure 11:
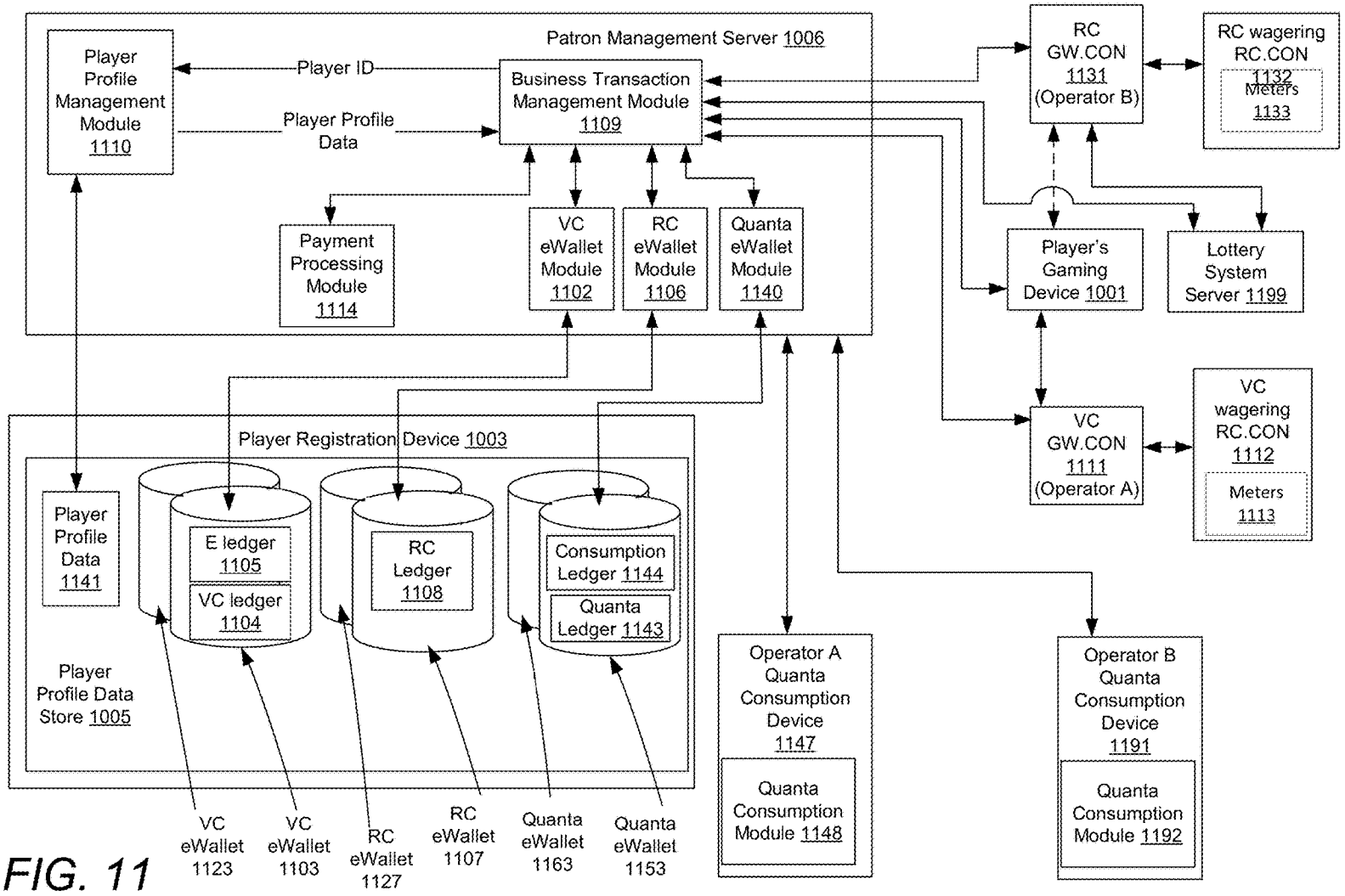
FIG. 11 illustrates lottery SWig system processing in accordance an embodiment.

FIG. 7A is an architecture diagram of processing device suitable for hosting an implementation of an Eg in accordance with embodiments (e.g., the player's gaming device 1001 of FIG. 11). In some embodiments, the processing device 700 is any suitable type of device, such as but not limited to: a mobile device such as a smartphone; a personal digital assistant; a wireless device such as a tablet computer or the like; an electronic gaming machine; a personal computer; a gaming console; a set-top box; a computing device and/or a controller; and the like.

In the illustrated embodiment, a bus 702 provides an interface for one or more processors 704, random access memory (RAM) 706, read only memory (ROM) 708, machine-readable storage medium 710, one or more user output devices 712, one or more user input devices 714, and one or more network devices 716.

The one or more processors 704 may be part of a processing module that may take many forms, such as, but not limited to: a central processing unit (CPU); a multiprocessor unit (MPU); an ARM processor; and the like.

Examples of output devices 712 include, include, but are not limited to: display screens; light panels; and/or lighted displays. In accordance with particular embodiments, the one or more processors 704 are operatively coupled to audio output devices such as, but not limited to: speakers; and/or sound amplifiers. In accordance with many of these embodiments, the one or more processors 704 are operatively coupled to tactile output devices like vibrators, and/or manipulators.

Examples of user input devices 714 include, but are not limited to: tactile devices including but not limited to, keyboards, keypads, foot pads, touch screens, and/or trackballs; non-contact devices such as audio input devices; motion sensors and motion capture devices that the processing device can use to receive inputs from a user when the user interacts with the processing device.

The one or more network devices 716 provide one or more wired or wireless interfaces for exchanging data and commands between the processing device 700 and other devices that may be included in a lottery SWig system. Such wired and wireless interfaces include, but are not limited to: a Universal Serial Bus (USB) interface; a Bluetooth interface; a Wi-Fi interface; an Ethernet interface; a Near Field Communication (NFC) interface; a POTS, cellular or satellite telephone network; and the like.

The machine-readable storage medium 710 stores machine-executable instructions for various components of the Eg, such as but not limited to: an operating system 718, Eg application programs 720, and device drivers 722. A lottery SWig system module 724 includes machine-executable instructions for controlling the one or more processors 704 to control the processing device 700 as described herein.

In various embodiments, the machine-readable storage medium 710 is one of a (or a combination of two or more of) a hard drive, a flash drive, a DVD, a CD, a flash storage, a solid state drive, a ROM, an EEPROM, and the like.

In operation, the machine-executable instructions are loaded into memory 706 from the machine-readable storage medium 710, the ROM 708 or any other storage location. The respective machine-executable instructions are accessed by the one or more processors 704 via the bus 702, and then executed by the one or more processors 704. Data used by the one or more processors 704 are also stored in memory 706, and such data is accessed by the one or more processors 704 during execution of the machine-executable instructions. Execution of the machine-executable instructions causes the one or more processors 704 to control the processing device 700 as described herein Although the processing device 700 is described herein as being constructed from one or more processors and instructions stored and executed by hardware components, the processing device can be composed of only hardware components in accordance with other embodiments. In addition, although the storage medium 710 is described as being operatively coupled to the one or more processors through a bus, those skilled in the art of processing devices will understand that the storage medium can include removable media such as, but not limited to, a USB memory device, an optical CD ROM, magnetic media such as tape and disks. Also, the storage medium 710 can be accessed by processor 704 through one of the interfaces or over a network. Furthermore, any of the user input devices or user output devices can be operatively coupled to the one or more processors 704 via one of the interfaces or over a network.

In some embodiments, the processing device can be distributed across several different devices. In many such embodiments, the Eg includes a game server operatively coupled to a game client over a network. The game server and game client cooperate to provide the functions of an Eg as described herein.

Figure 7B:
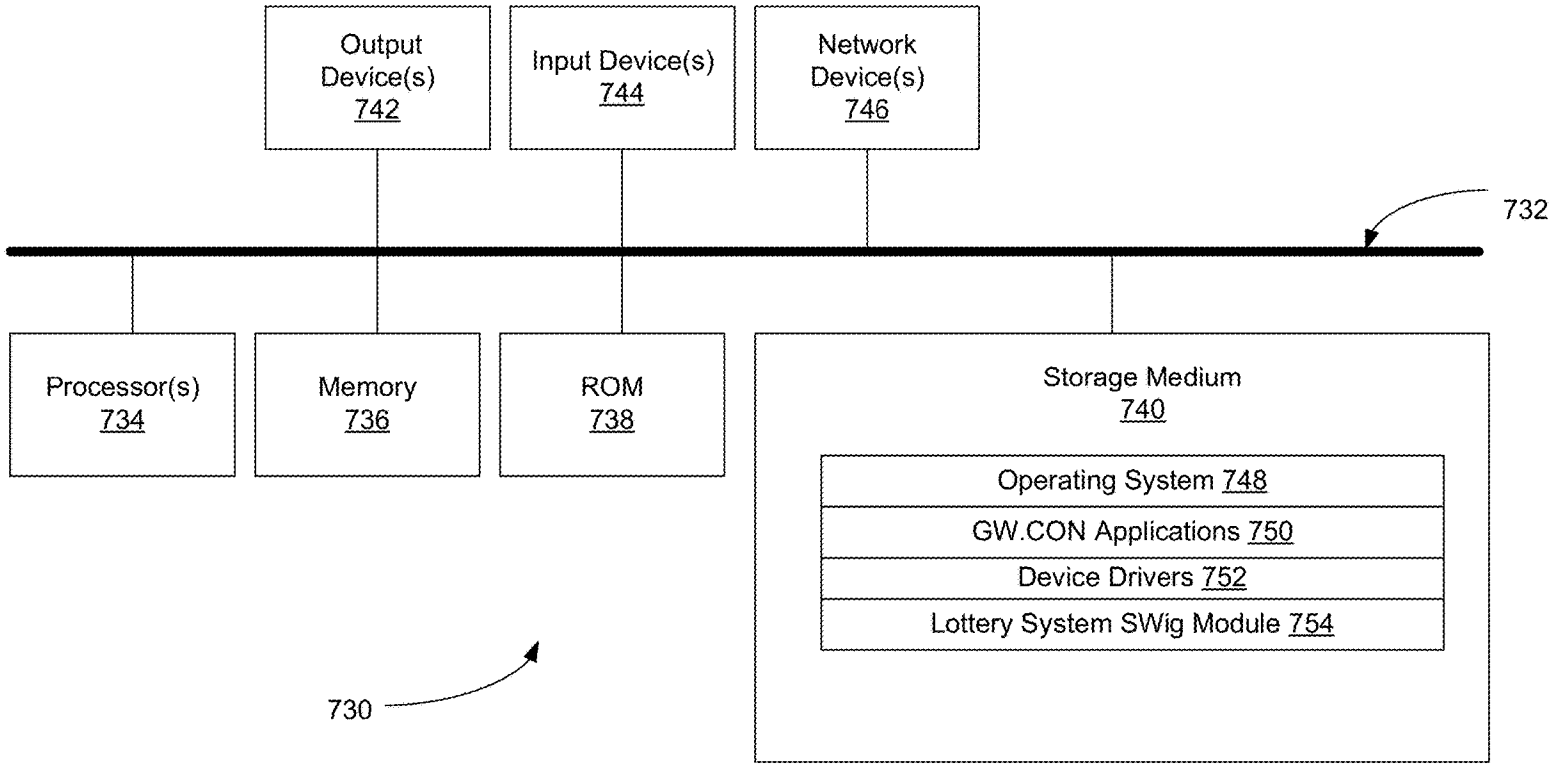
FIG. 7B illustrates a block diagram of components of a GW.CON processing device of a lottery SWig system in accordance with an embodiment.

FIG. 7B is an architecture diagram of a processing device 730 suitable for hosting an implementation of a GW.CON in accordance with embodiments. In some embodiments, the processing device 730 is any suitable type of device, such as but not limited to: a server; a mobile device such as a smartphone; a personal digital assistant; a wireless device such as a tablet computer or the like; an electronic gaming machine; a personal computer; a gaming console; a set-top box; a computing device and/or a controller; and the like. In the illustrated embodiment, a bus 732 provides an interface for one or more processors 734, random access memory (RAM) 736, read only memory (ROM) 738, machine-readable storage medium 740, one or more user output devices 742, one or more user input devices 744, and one or more network devices 746.

The one or more processors 734 may be part of a processing module that may take many forms, such as, but not limited to: a central processing unit (CPU); a multi-processor unit (MPU); an ARM processor; and the like.

Examples of output devices 742 include, include, but are not limited to: display screens; light panels; and/or lighted displays. In accordance with particular embodiments, the one or more processors 734 are operatively coupled to audio output devices such as, but not limited to: speakers; and/or sound amplifiers. In accordance with many of these embodiments, the one or more processors 734 are operatively coupled to tactile output devices like vibrators, and/or manipulators.

Examples of user input devices 734 include, but are not limited to: tactile devices including but not limited to, keyboards, keypads, touch screens, and/or trackballs; non-contact devices such as audio input devices; motion sensors and motion capture devices that the processing device can use to receive inputs from a user when the user interacts with the processing device.

The one or more network devices 736 provide one or more wired or wireless interfaces for exchanging data and commands between the processing device 730 and other devices that may be included in a lottery SWig system. Such wired and wireless interfaces include, but are not limited to: a Universal Serial Bus (USB) interface; a Bluetooth interface; a Wi-Fi interface; an Ethernet interface; a Near Field Communication (NFC) interface; a POTS, cellular or satellite telephone network; and the like.

The machine-readable storage medium 740 stores machine-executable instructions for various components of the GW.CON and/or RC.CON, such as but not limited to: an operating system 748, GW.CON application programs 750, and device drivers 752. A lottery SWig system module 754 includes machine-executable instructions for controlling the one or more processors 734 to control a GW.CON as described herein.

In various embodiments, the machine-readable storage medium 740 is one of a (or a combination of two or more of) a hard drive, a flash drive, a DVD, a CD, a flash storage, a solid state drive, a ROM, an EEPROM, and the like.

In operation, the machine-executable instructions are loaded into memory 736 from the machine-readable storage medium 740, the ROM 738 or any other storage location. The respective machine-executable instructions are accessed by the one or more processors 734 via the bus 732, and then executed by the one or more processors 734. Data used by the one or more processors 734 are also stored in memory 736, and such data is accessed by the one or more processors 734 during execution of the machine-executable instructions. Execution of the machine-executable instructions causes the one or more processors 734 to control the processing device 730 as described herein Although the processing device 730 is described herein as being constructed from one or more processors and machine-executable instructions stored and executed by hardware components, the processing device can be composed of only hardware components in accordance with other embodiments. In addition, although the storage medium 740 is described as being operatively coupled to the one or more processors through a bus, those skilled in the art of processing devices will understand that the storage medium can include removable media such as, but not limited to, a USB memory device, an optical CD ROM, magnetic media such as tape and disks. Also, the storage medium 740 can be accessed by the one ore more processors 734 through one of the interfaces or over a network. Furthermore, any of the user input devices or user output devices can be operatively coupled to the one or more processors 734 via one of the interfaces or over a network.

Figure 7C:
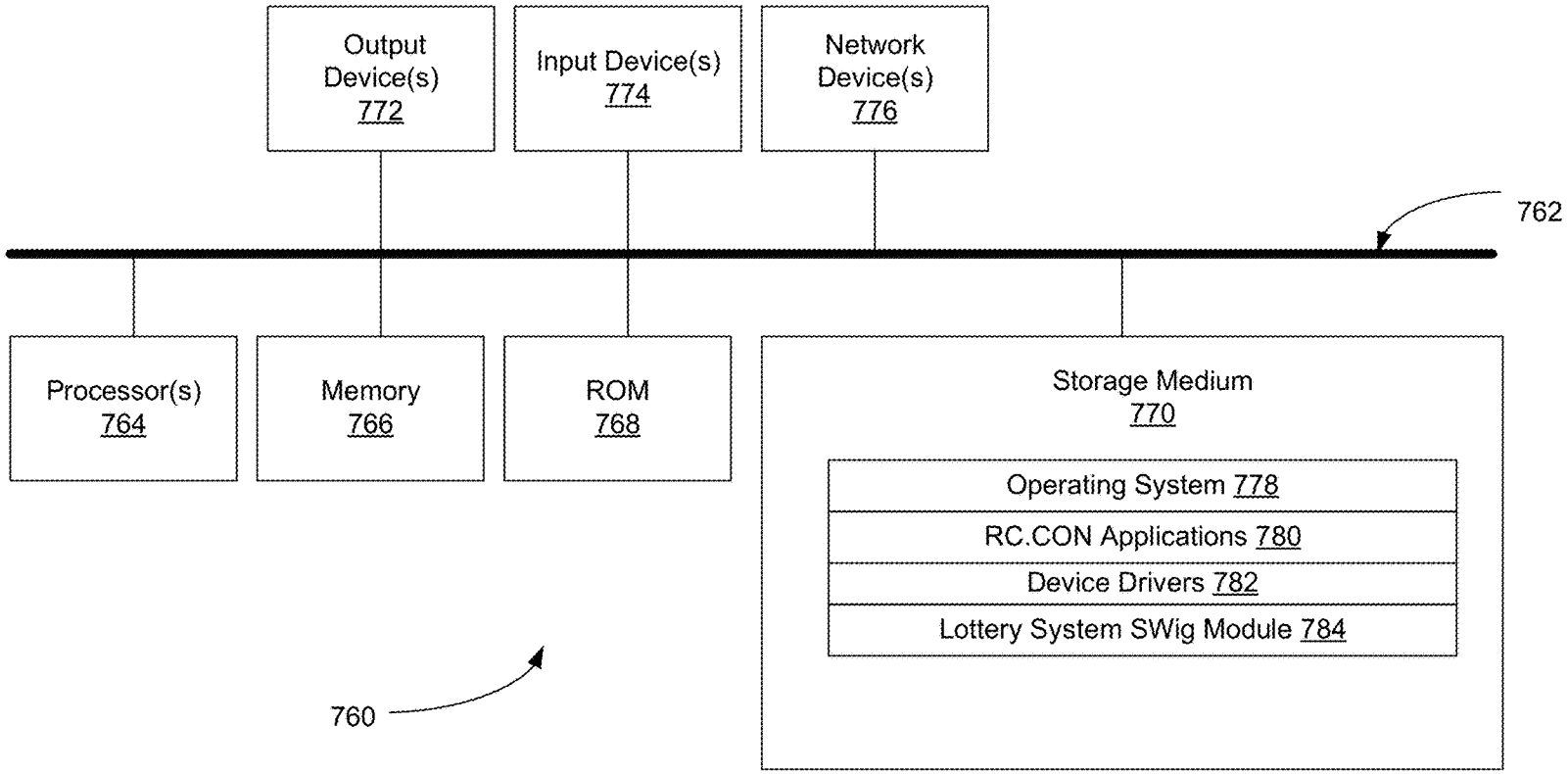
FIG. 7C illustrates a block diagram of components of a RC.CON processing device of a lottery SWig system in accordance with an embodiment.

FIG. 7C is an architecture diagram of a processing device suitable for hosting an implementation of an RC.CON in accordance with embodiments. In some embodiments, the processing device 760 is any suitable type of device, such as but not limited to: a mobile device such as a smartphone; a personal digital assistant; a wireless device such as a tablet computer or the like; an electronic gaming machine; a personal computer; a gaming console; a set-top box; a computing device and/or a controller; and the like.

In the illustrated embodiment, a bus 762 provides an interface for one or more processors 764, random access memory (RAM) 766, read only memory (ROM) 768, machine-readable storage medium 770, one or more user output devices 772, one or more user input devices 774, and one or more network devices 776.

The one or more processors 764 may be part of a processing module that may take many forms, such as, but not limited to: a central processing unit (CPU); a multi-processor unit (MPU); an ARM processor; and the like.

Examples of output devices 772 include, include, but are not limited to: display screens; light panels; and/or lighted displays. In accordance with particular embodiments, the one or more processors 764 are operatively coupled to audio output devices such as, but not limited to: speakers; and/or sound amplifiers. In accordance with many of these embodiments, the one or more processors 764 are operatively coupled to tactile output devices like vibrators, and/or manipulators.

Examples of user input devices 774 include, but are not limited to: tactile devices including but not limited to, keyboards, keypads, foot pads, touch screens, and/or trackballs; non-contact devices such as audio input devices; motion sensors and motion capture devices that the processing device can use to receive inputs from a user when the user interacts with the processing device.

The one or more network devices 776 provide one or more wired or wireless interfaces for exchanging data and commands between the processing device 760 and other devices that may be included in a lottery SWig system. Such wired and wireless interfaces include, but are not limited to: a Universal Serial Bus (USB) interface; a Bluetooth interface; a Wi-Fi interface; an Ethernet interface; a Near Field Communication (NFC) interface; a POTS, cellular or satellite telephone network; and the like.

The machine-readable storage medium 770 stores machine-executable instructions for various components of the RC.CON, such as but not limited to: an operating system 778, RC.CON application programs 780, and device drivers 782. A lottery SWig system module 784 includes machine-executable instructions for controlling the one or more processors 764 to control the processing device 760 as described herein.

In various embodiments, the machine-readable storage medium 770 is one of a (or a combination of two or more of) a hard drive, a flash drive, a DVD, a CD, a flash storage, a solid state drive, a ROM, an EEPROM, and the like.

In operation, the machine-executable instructions are loaded into memory 766 from the machine-readable storage medium 770, the ROM 768 or any other storage location. The respective machine-executable instructions are accessed by the one or more processors 764 via the bus 762, and then executed by the one or more processors 764. Data used by the one or more processors 764 are also stored in memory 766, and such data is accessed by the one or more processors 764 during execution of the machine-executable instructions. Execution of the machine-executable instructions causes the one or more processors 764 to control the processing device 700 as described herein Although the processing device 760 is described herein as being constructed from one or more processors and instructions stored and executed by hardware components, the processing device can be composed of only hardware components in accordance with other embodiments. In addition, although the storage medium 770 is described as being operatively coupled to the one or more processors through a bus, those skilled in the art of processing devices will understand that the storage medium can include removable media such as, but not limited to, a USB memory device, an optical CD ROM, magnetic media such as tape and disks. Also, the storage medium 770 can be accessed by processor 764 through one of the interfaces or over a network. Furthermore, any of the user input devices or user output devices can be operatively coupled to the one or more processors 764 via one of the interfaces or over a network.

In numerous embodiments, any of an RC.CON, GW.CON or Eg as described herein can be implemented on multiple processing devices, whether dedicated, shared, or distributed in any combination thereof, or can be implemented on a single processing device. In addition, while certain aspects and features of lottery SWig system processes described herein have been attributed to an RC.CON, GW.CON, or Eg, these aspects and features can be implemented in a distributed form where any of the features or aspects can be performed by any of a RC.CON, GW.CON, and/or Eg within a lottery SWig system without deviating from the spirit of the disclosure.

Lottery SWig System Implementations

Figure 8:
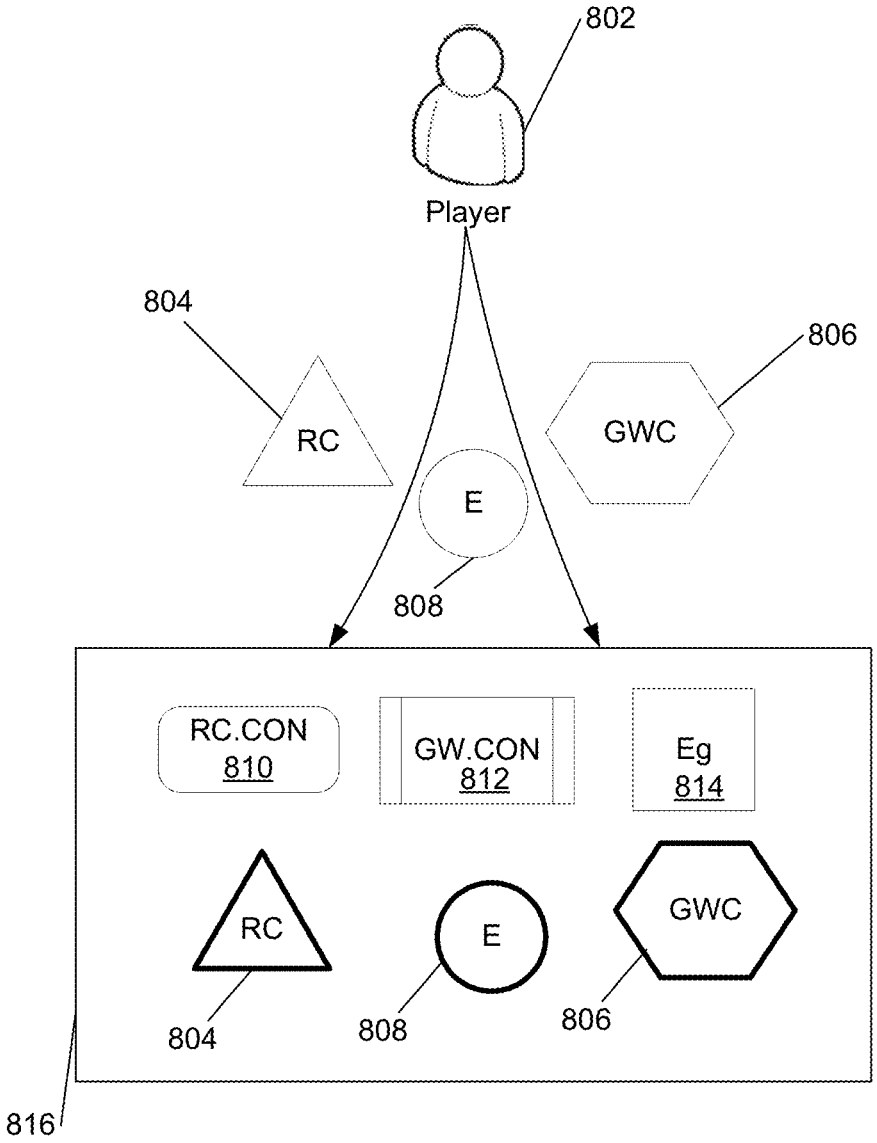
FIG. 8 illustrates a conceptual diagram of components of a lottery SWig system in accordance with an embodiment.

In several embodiments, a player can interact with a lottery SWig system by using RC for wagering within a gambling game along with GWC and elements in interactions with an interactive entertainment game. The gambling game can be executed by a RC.CON while an interactive entertainment game can be executed with an Eg and managed with a GW.CON. A conceptual diagram that illustrates how resources such as GWC, RC and elements (E), such as but not limited to EE, are utilized in a lottery SWig system in accordance with an embodiment is illustrated in FIG. 8. The conceptual diagram illustrates that RC 804, elements E 808 and GWC 806 can be utilized by a player 802 in interactions with the RC.CON 810, GW.CON 812 and Eg 814 of a lottery SWig system 816. The contribution of elements, such as E 808, can be linked to a player's access to credits, such as RC 804 and/or GWC 806. Electronic receipt of these credits can come via a smart card, voucher or other portable media, or as received over a network from a server. In some embodiments, these credits can be drawn on demand from a player profile located in a database locally on a lottery SWig system or in a remote server.

Figure 9:
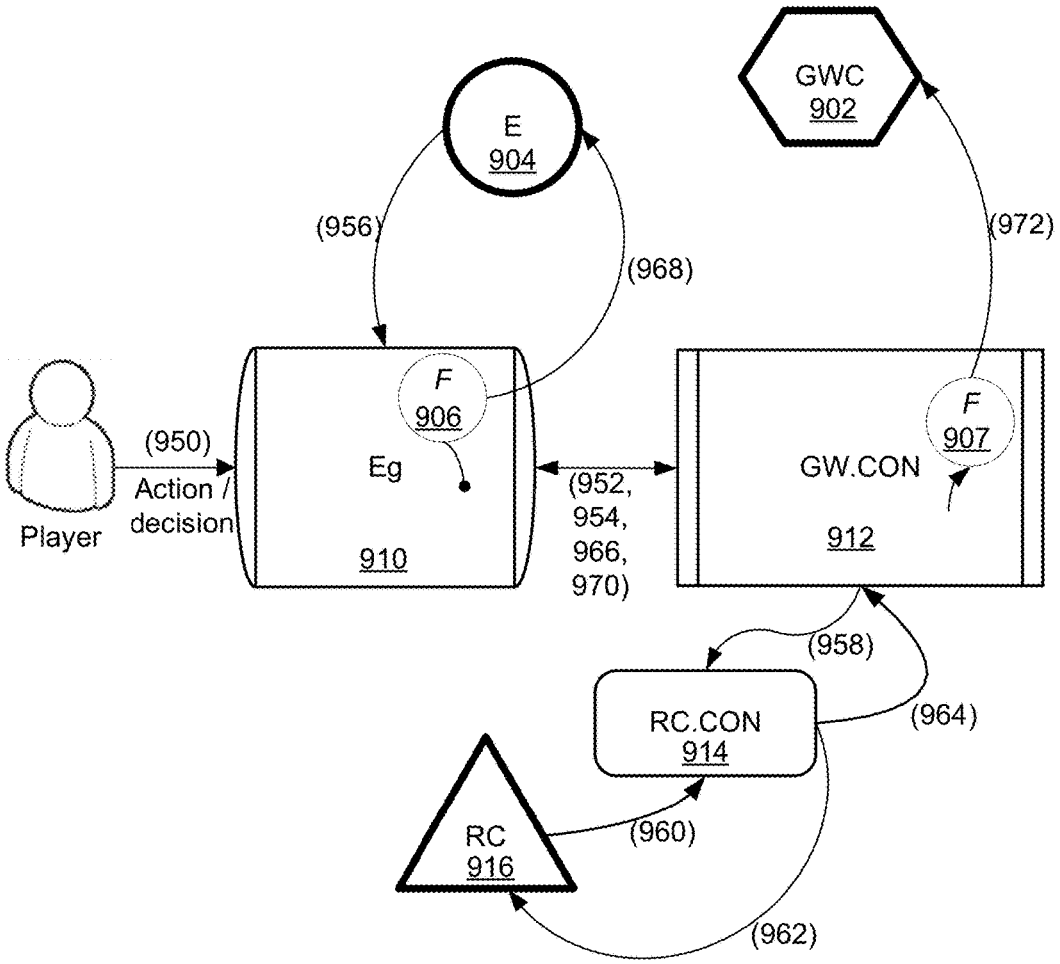
FIG. 9 illustrates a conceptual diagram of the interplay between aspects of a lottery SWig system using Real World Currency (RC) in accordance with an embodiment.

A conceptual diagram that illustrates interplay between elements and components of a lottery SWig system in accordance with an embodiment is illustrated in FIG. 9. Similar to FIG. 8, a player's actions and/or decisions can affect functions 906 and 907 that consume and/or accumulate GWC 902 and/or E 904 in an interactive entertainment game executed by an Eg 910, a RC.CON 914 and a GW.CON 912. The GW.CON 912 can monitor the activities taking place within an interactive entertainment game executed by an Eg 910 for gameplay gambling event occurrences. The GW.CON 912 can also communicate the gameplay gambling event occurrences to the RC.CON 914 that triggers a gambling event and/or wager of RC 916 in a gambling game executed by the RC.CON 914.

In the illustrated example, the player commences interaction with the lottery SWig system by contributing one or more of three types of credits to the lottery SWig system: (i) RC 916 which is a currency fungible instrument, (ii) GWC 902 which are game world credits, and (iii) E 904 which is an element of the entertainment portion of the lottery SWig system executed by the Eg. In many embodiments, an element is an element consumed by, traded or exchanged in, operated upon, or used by the player during the player's play of the interactive entertainment game portion of the lottery SWig system. There may be one or more types of E present in a lottery SWig system's entertainment game. Embodiments of E include, but are not limited to, bullets in a shooting game, fuel in a racing game, letters in a word spelling game, downs in a football game, potions in a character adventure game, and/or character health points, etc.

The contribution of one or more of these elements may be executed by insertion into the lottery SWig system of currency in the case of RC, and/or transferred in as electronic credit in the case of any of the RC, GWC and/or E. Electronic transfer in of these credits may come via a smart card, voucher or other portable media, or as transferred in over a network from a patron server or lottery SWig system player account server. In many embodiments, these credits may not be transferred into the lottery SWig system. Instead the credits may be drawn on demand from player accounts located in servers residing on the network or in the cloud on a real time basis as the credits are consumed by the lottery SWig system. Once these credits are deposited, or a link to their availability is made, the lottery SWig system has the credits at its disposal to use for execution of the lottery SWig system. Generally, the RC is utilized and accounted for by the RC.CON 914; and the E 904 and GWC 902 are utilized and accounted for by the GW.CON 912 and/or the Eg 910.

In accordance with some embodiments, the following may occur during use of the lottery SWig system. The user enters an input that represents an action or decision (950). The Eg 910 signals the GW.CON 912 with the input decision or action (952). The GW.CON 912 responds by signaling to the Eg 910 the amount of E that is consumed by the player action or decision (954). The signaling from the GW.CON 912 configures a function 906 to control the E consumption, decay, and/or accumulation.

The Eg 910 then adjusts the E 904 accordingly (956). The GW.CON 912 signals the RC.CON 914 as to the profile of the wager proposition associated with the action or decision and triggers a gambling event and the wager (958). The RC.CON 914 consumes the appropriate amount of RC 916, executes the gambling event and resolves the wager (960). The RC.CON 914 then adjusts the RC 916 based upon the outcome of the wager (962) and informs the GW.CON 912 as to the outcome of the wager (964).

The GW.CON 912 signals the Eg 910 to adjust E to one or more of the Es of the Eg entertainment game (966). Function 906 of the Eg 910 performs the adjustment of E 904 (968). The Eg 910 signals the GW.CON 912 as to the updated status (970). In response, the GW.CON 912 updates the GWC 902 using a function 907 (972) and may provide an update of the GWC to the Eg 910.

The following is an example of the above flow in a first person shooter game, such as Call of Duty®, using a lottery SWig system sequence in accordance with embodiments.

The process begins by a player selecting a machine gun to use in the game and then fires a burst of bullets at an opponent (950). The Eg 910 can signal to the GW.CON 912 of the player's choice of weapon, that a burst of bullets was fired, and/or the outcome of the burst (952). The GW.CON 912 processes the information received and signals the Eg 910 to consume 3 bullets (E) with each pull of the trigger (954). The Eg 910 consumes 3 bullets for the burst using function 906 (956).

The GW.CON 912 signals the RC.CON 914 that 3 credits (RC) are to be wagered on the outcome of a gambling event to match the three bullets consumed. The RC.CON 914 then performs the gambling event and determines the result of the wager and may determine the winnings from a pay table. The RC.CON 914 consumes 3 credits of RC 916 for the wager and executes the specified wager (960). By way of example, the RC.CON 914 may determine that the player hit a jackpot of 6 credits and returns the 6 credits to the RC 916 (962) and signals the GW.CON 912 that 3 net credits were won by the player (964).

The GW.CON 912 signals the Eg 910 to add 3 bullets to an ammunition clip (966). The Eg 910 adds 3 bullets back to the ammo clip (E 904) using a function 906 (968). The ammunition may be added by directly adding the ammunition to the clip or by allowing the user to find extra ammunition during gameplay. The GW.CON 912 logs the new player score (GWC 902) in the game (as a function of the successful hit on the opponent) based on the Eg 910 signaling, and adds 2 extra points to the player score since a jackpot has been won (970). The GW.CON then adds 10 points to the player score (GWC 902) given the success of the hit which in this example is worth 8 points, plus the 2 extra points (972). Note that the above example is only intended to provide an illustration of how credits flow in a lottery SWig system, but is not intended to be exhaustive and only lists only one of numerous possibilities of how a lottery SWig system may be configured to manage its fundamental credits.

Note that the foregoing embodiments are intended to provide an illustration of how credits flow in a lottery SWig system, but are not intended to be exhaustive, and only list one of numerous possibilities of how a lottery SWig system may be configured to manage its fundamental credits.

In accordance with some embodiments, the lottery SWig system of FIG. 9 may provide a lottery SWig system with virtual currency versus using RC. Virtual currency can be thought of as a form of alternate currency which can be acquired, purchased or transferred in unit or in bulk by/to a player but does not necessarily directly correlate to RC or real currency. In a number of embodiments, there is a virtual currency called "Triax Jacks". 1000 units of "Triax Jacks" are given to a player by an operator of a lottery SWig system with additional blocks of 1000 units being available for purchase for $5 USD for each block. Triax Jacks could be redeemed for various prizes. Alternatively, the Triax Jacks could never be redeemed but simply used and traded purely for entertainment value by players. It would be completely consistent with the architecture of the lottery SWig system that Triax Jacks would be wagered in place of RC such that the lottery SWig system could be played for free or with played with operator sponsored Triax Jacks.

Virtual Credits

Virtual credits (VC) are credits that are usable within an ecosystem of games that accept VC. In other words, VC is not limited to use within a given game. Players can register to create a player account, and persist their VC in the player account for use in many different games. In the lottery SWig system (and the ecosystem of games that accept VC), VC is used as a proxy for cash. More specifically, it is used as a proxy for cash in casino-style games, in lottery SWig system games, and in other Skill Wagering Interleaved Games. VC is also used as a proxy for coins in an arcade-style coin-operated game. VC is also used within the ecosystem of games to purchase virtual items such as, for example, elements (E) (e.g., enabling elements).

VC is added to a player's account based on real value received from the player via a payment processing module, VC received (e.g., cashed-out) from a credit meter of a virtual credit gaming RC.CON used in a gaming session of the player, VC received from the player's sale or redemption of elements (E), and based on a scanned code (e.g., a scanned ticket code (e.g., lottery ticket, concert ticket, movie ticket, and the like), a scanned receipt code, a scanned UPC code, a scanned proof of purchase code, and the like).

VC is consumed based on VC added (e.g., cashed-in) to the credit meter of the RC.CON used in a gaming session of the player, and VC used for a player's purchase of elements (E).

VC cannot be exchanged for real value (e.g., redeemed for real currency).

Quanta

Quanta are credits that are awarded to a player for skillful gameplay of an interactive entertainment game. Quanta are usable within an ecosystem of games that accept Quanta. In other words, Quanta is not limited to use within a given game. Players can register to create a player account, and persist their Quanta in the player account for use in many different games. In the lottery SWig system (and the ecosystem of games that accept Quanta), Quanta is exchanged for virtual items such as, for example, elements (E) (e.g., enabling elements). Quanta is also exchanged for entrance into tournaments. Quanta is also redeemed to unlock new games or levels of games. Moreover, Quanta is exchanged for VC.

Unlike VC which cannot be exchanged for real value, Quanta is redeemed for real-world prizes (e.g., a Slurpee, M&Ms, a trip to Orlando, tickets to a concert, a coupon for a discount at Target, or any item having a real-world economic value or useful value).

Quanta is added to a player's account based on skillful gameplay, and based on a scanned code (e.g., a scanned ticket code (e.g., lottery ticket, concert ticket, movie ticket, and the like), a scanned receipt code, a scanned UPC code, a scanned proof of purchase code, and the like).

Quanta is consumed based on exchange for virtual items, exchange for entrance into tournaments, redemption for unlocking of new games or unlocking of levels of games, exchange of Quanta for VC, and redemption for real-world prizes.

Lottery SWig System Operational Overview

As described above, the lottery SWig system grants one or more of VC and Quanta to a player of the Lotter System SWig based on a scanned code (e.g., a scanned ticket code (e.g., lottery ticket, concert ticket, movie ticket, and the like), a scanned receipt code, a scanned UPC code, a scanned proof of purchase code, and the like). In some embodiments, the code is scanned and the scanned code is provided to a P/RNG (e.g., P/RNG 106 of FIG. 1) of an RC.CON. The P/RNG generates a result based on the scanned code, and the generated result is used to determine an amount of VC or Quanta to award to the player.

In some embodiments, in a case where the scanned code is a lottery ticket code, the scanned code is provided to a lottery system that operates the lottery corresponding to the scanned lottery ticket, and the lottery system provides the player with a result of the lottery.

In some embodiments, each code (e.g., a scanned ticket code (e.g., lottery ticket, concert ticket, movie ticket, and the like), a scanned receipt code, a scanned UPC code, a scanned proof of purchase code, and the like) is logged in a monitoring system so that an identical code is not used more than once as a prompt to generate VC or Quanta.

In accordance with some embodiments, a player of the lottery SWig system receives an amount of RC that corresponds to a lottery result of a lottery ticket, as determined by a lottery system. In other words, if the lottery ticket is a winning lottery ticket, the player receives an amount of RC equal to the lottery ticket winnings. If the lottery ticket is a losing lottery ticket, the player does not receive any RC.

In some embodiments, a code (e.g., a bar code, a watermark, a numerical code, a QR code, and the like) of a lottery ticket is scanned and the scanned lottery ticket code is provided to a real money gaming GW.CON. The real money gaming GW.CON provides the scanned code to a lottery system that operates the lottery corresponding to the scanned lottery ticket, and the player receives an amount of RC corresponding to a result of the lottery.

In accordance with some embodiments, the lottery SWig system provides a user of a player's gaming device with lottery results of lottery ticket codes scanned for the player. In some implementations, the player's gaming device outputs the lottery results in a human perceivable format via an output device.

In some embodiments, each code scanned for a player (e.g., a scanned ticket code (e.g., lottery ticket, concert ticket, movie ticket, and the like), a scanned receipt code, a scanned UPC code, a scanned proof of purchase code, and the like) is logged in the player's account. By virtue of logging scanned codes in association with player accounts, the lottery SWig system generates a customer database that can be provided to lotteries and others who provide scanable codes to learn more about their customers and provided targeted advertising and marketing.

Player Registration, Player Profiles and eWallets

Figure 10:
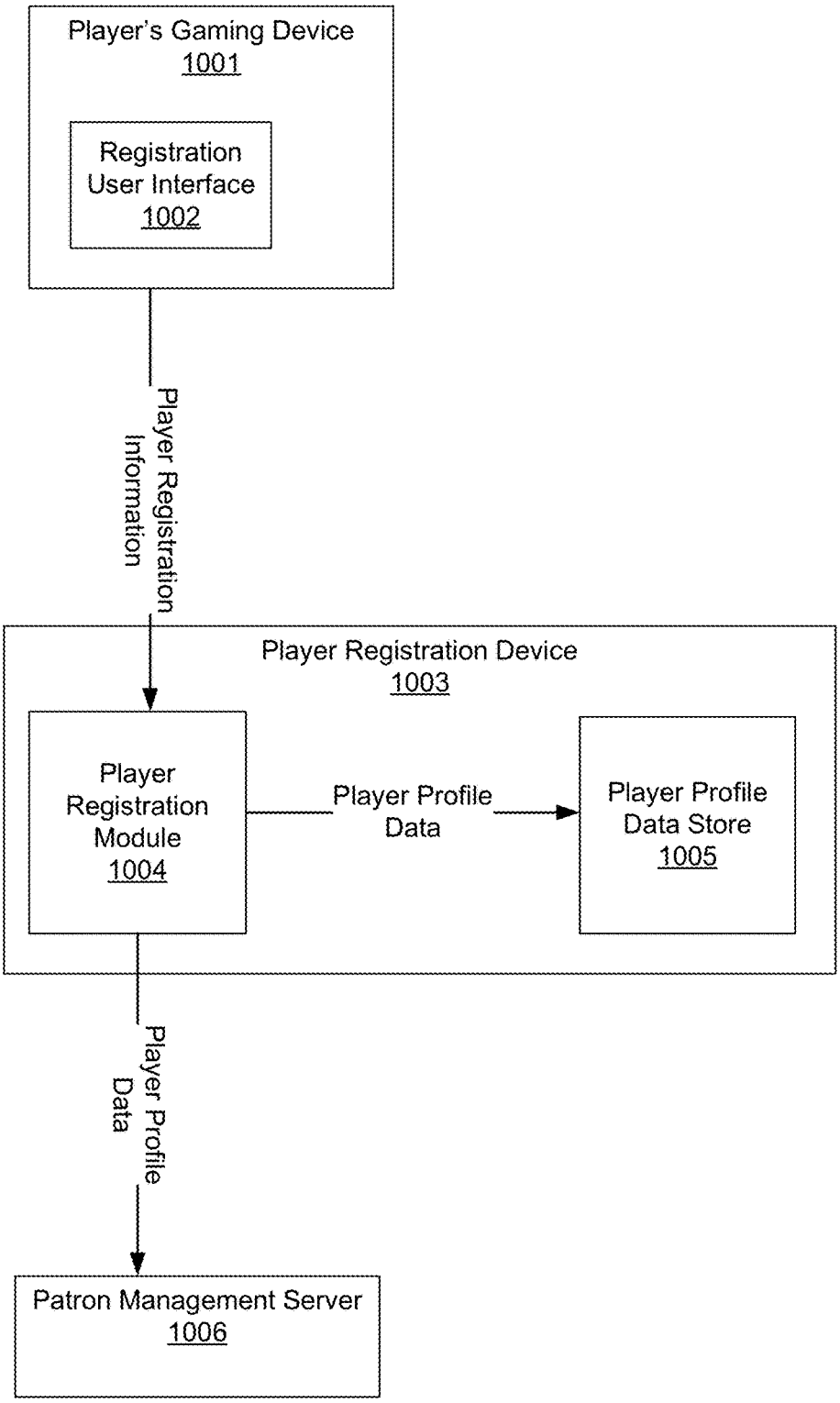
FIG. 10 illustrates player registration in accordance with an embodiment.

In an example embodiment, player registration is performed by using a player registration user interface (e.g., 1002 of FIG. 10) in connection with a player registration module (e.g., 1004 of FIG. 10). In the example embodiment, a processor of a player's gaming device (e.g., 642 of FIG. 6C, 1001 of FIG. 10) executes processor-executable instructions that when executed, control the player's gaming device to provide the player registration user interface. Player registration information is received by the player's gaming device via the player registration user interface.

The player's gaming device provides the received player registration information to the player registration module (e.g., 1004 of FIG. 10), which generates player profile data based on the received player registration information. In an example implementation, the player profile data includes authorization credentials for the lottery SWig system. In some implementations, the player profile data includes player contact information, such as, for example, an e-mail address, a phone number, a mailing address, social network account information, and the like. During operation of the lottery SWig system, the player profile data is updated to include game score data, data concerning controlled entities (such as characters used by a player in lottery SWig system entertainment game gameplay), tournament reservation data, and data identifying elements, virtual credits (VC), GWC and Quanta associated with the player.

At least one eWallet is associated with each player of the lottery SWig system. In the example embodiment, player profile data of a player is associated with at least one eWallet for the player.

In some implementations, the elements (E) (including elements acquired from in-app purchases), virtual credits (VC), GWC and Quanta are managed by at least one player eWallet, and the player profile data includes information for accessing each player eWallet. In some implementations, the elements (E) (including elements acquired from in-app purchases), virtual credits (VC), GWC and Quanta are managed by a player eWallet, and the player profile data includes each player eWallet.

In some implementations, the player registration information includes payment information for in-app purchases (e.g., of elements and VC), and the player registration module includes the payment information in the player profile data.

In the example embodiment, in a case where real money gaming is enabled, the player registration module (e.g., 1004 of FIG. 10) generates real money gaming identification information, for identifying the player in accordance with real money gaming regulations of one or more real money gaming jurisdictions. In some implementations, the player registration information includes real money gaming payment information for purchase of RC, and the player registration module includes the real money gaming payment information in the player profile data. During operation of a real money gambling game, the player profile data is updated to include information related to RC. In some implementations, the RC, along with elements (E) (including elements acquired form in-app purchases), virtual credits (VC), GWC and Quanta are managed by at least one player wallet, and the player profile data includes information for accessing each player wallet. In some implementations, the RC, along with the elements (E) (including elements acquired form in-app purchases), virtual credits (VC), GWC and Quanta are managed by at least one player wallet, and the player profile data includes each player wallet.

In the example implementation, registration for real money gaming is performed in a case where the player's gaming device (e.g., 642 of FIG. 6C, 1001 of FIG. 10) is communicatively coupled with a real money gaming GW.CON. For example, in a case where the player's gaming device enters a real money gaming jurisdiction and a real money gaming GW.CON is selected, the player's device provides a real money gaming player registration user interface (e.g., 1002 of FIG. 10) to perform user registration for real money gaming by using the selected GW.CON. In some implementations, registration for real money gaming is performed in a case where the player's gaming device (e.g., 642 of FIG. 6C, 1001 of FIG. 10) is not communicatively coupled with a real money gaming GW.CON. For example, a player can be pre-registered for real money gaming prior to the player's gaming device entering a real money gaming jurisdiction, such that real money gaming can be seamlessly enabled upon entering the real money gaming jurisdiction. In some implementations, the pre-registration is a GW.CON-specific pre-registration in which the player is registered for real money gaming with a specific GW.CON (e.g., a GW.CON in a specific jurisdiction or a GW.CON operated by a specific real money gaming operator). In some implementations, the pre-registration is a universal pre-registration in which the player is registered for real money gaming with any real money gaming GW.CON.

In the example implementation, a player registration device (e.g., 1003 of FIG. 10) external to the player's gaming device includes the player registration module. In more detail, the player registration device stores processor-executable instructions that when executed by the processor of the player registration device, control the player registration device to provide the functionality of the player registration module, which generates player profile data based on received player registration information. The player registration device is controlled by one of a game publisher of the entertainment game, a game publisher of the lottery SWig system, a game publisher of the real money game, an operator of the entertainment game, an operator of the lottery SWig system, and an operator of the real money game.

In the example implementation, the player registration module stores the generated player profile data in a player profile data store (e.g., 1005 of FIG. 10). The player profile data store is controlled by one of a game publisher of the entertainment game, a game publisher of the lottery SWig system, a game publisher of the real money game, an operator of the entertainment game, an operator of the lottery SWig system, and an operator of the real money game. In some implementations, a patron management server (e.g., 1006 of FIG. 10) stores the generated player profile data in a player profile data store.

In the example implementation, after the player registration module generates the player profile data, the player registration module registers the player profile data with a patron management server (e.g., 1006 of FIG. 10).

Player registration, as discussed above, is illustrated in FIG. 10. As illustrated in FIG. 10, the player's gaming device 1001 provides a registration user interface 1002 for receiving player registration information (e.g., entertainment game player registration information, real money gaming player registration information, or any combination of entertainment game player registration information and real money gaming player registration information). The player's gaming device 1001 provides player registration information received via the registration user interface 1002 to a player registration device 1003. A player registration module 1004 of the player registration device 1003 generates player profile data based on the player registration information received from the player's gaming device 1001. The player registration module 1004 stores the generated player profile data in a player profile data store 1005. The player registration module 1004 also registers the generated player profile data with a patron management server 1006.

The player registration device 1003 is controlled by one of a game publisher of the entertainment game, a game publisher of the lottery SWig system, a game publisher of the real money game, an operator of the entertainment game, an operator of the lottery SWig system, and an operator of the real money game. In some implementations, the patron management server 1006 is controlled by an operator of the lottery SWig system.

In some implementations, the player registration device 1003 includes one or more of a GW.CON and an RC.CON. In some implementations, a patron management server (e.g., 1006 of FIG. 10) stores the generated player profile data in a player profile data store.

—eWallets: Overview—

As described above, at least one eWallet is associated with each player of the lottery SWig system. In the example embodiment, player profile data of a player is associated with at least one eWallet for the player.

The example embodiment involves use of at least three wallets for each player: a Virtual Credit (VC) eWallet, a Real Credit (RC) eWallet, and a Quanta eWallet. In the example embodiment, the patron management server 1006 manages each eWallet.

In the example embodiment, the use of both a Virtual Credit eWallet for VC and a Real Credit Wallet for RC allows both VC and RC to be used in a gaming session of the lottery SWig system. In other words, a single gaming session of the lottery SWig system can involve game play in virtual credit mode, and game play in real credit mode.

FIG. 11 illustrates management of player eWallets by the patron management server 1006, according to the example implementation. As shown in FIG. 11, the patron management server 1006 includes a business transaction management module 1109, a virtual credit (VC) eWallet module 1102, a real credit (RC) eWallet module 1106, a Quanta eWallet module 1140, a player profile management module 1110, a payment processing module 1114.

As illustrated in FIG. 11, the patron management server 1006 is communicatively coupled to the player's gaming device 1001, a VC gaming GW.CON 1111 (of Operator A), an RC gaming GW.CON 1131 (of Operator B), the player profile data store 1005 (of the player registration device 1003 of FIG. 10), a Quanta Consumption Device 1147 (of Operator A), a Quanta Consumption Device 1191 (of Operator B), and a lottery system Server Device 1199.

In the example implementation, the player's gaming device 1001 is a processing device suitable for hosting an implementation of an Eg, and having an architecture similar to that of the processing device 700 of FIG. 7A. In the example implementation, VC GW.CON 111 and the RC GW.CON 1131 are each processing devices suitable for hosting an implementation of a GW.CON, and having an architecture similar to that of the processing device 730 of FIG. 7B. In the example implementation, the VC RC.CON 1112 and the RC RC.CON 1132 are each processing devices suitable for hosting an implementation of an RC.CON, and having an architecture similar to that of the processing device 760 of FIG. 7C.

In some implementations, the VC GW.CON 111, the RC GW.CON 1131, the VC RC.CON 1112 and the RC RC.CON 1132 are modules hosted by one or more processing devices.

The architecture of the patron management server 1006 is described below with respect to FIG. 16. The architecture of the player registration device 1006 is described below with respect to FIG. 17.

The VC gaming GW.CON 1111 (of Operator A) is communicatively coupled to a VC gaming RC.CON 1112 having one or more credit meters 1113. As shown in FIG. 11, the player's gaming device 1001 is operating the lottery SWig system in an Operator A Domain, and thus the player's gaming device 1001 is communicatively coupled to the VC gaming GW.CON 1111 of Operator A.

The RC gaming GW.CON 1131 (of Operator B) is communicatively coupled to an RC gaming RC.CON 1132 having one or more credit meters 1133. The RC gaming GW.CON 1131 is also communicatively coupled to the lottery system Server 1199. As shown in FIG. 11, since the player's gaming device 1001 is operating the lottery SWig system in the Operator A Domain, the player's gaming device 1001 is not communicatively coupled to the RC gaming GW.CON 1131 (of Operator B), as represented by the dashed line. In operation, in a case where the player's gaming device 1001 is located in a jurisdiction that allows real money gaming, the player's gaming device 1001 can communicatively couple with the RC gaming GW.CON 1131 to provide real money gaming.

In the example implementation of FIG. 11, when a player is registered by the player registration device 1003 (of FIG. 10), a VC eWallet, an RC eWallet, and a Quanta eWallet are added to the player profile data store 1005 in association with the player profile data for the player. In some implementations, an RC eWallet for a player is not added to the player profile data store until the player registers for real money gaming.

In the example implementation of FIG. 11, a player's VC Wallet, RC eWallet, and Quanta eWallet are associated with the player by using a player ID.

As illustrated in FIG. 11, the player profile data store 1005 includes two VC eWallets, two RC eWallets, and two Quanta eWallets. VC eWallet 1103, RC eWallet 1107, and Quanta eWallet 1153 are for a first player having a first player ID, and VC eWallet 1123, RC eWallet 1127, and Quanta wWallet 1163 are for a second player having a second player ID. During operation, as additional players are registered by the player registration device 1003 (of FIG. 10), additional VC eWallets, RC eWallets, and Quanta eWallets are added to the player profile data store 1005.

—Virtual Credit eWallet—

The virtual credit (VC) eWallet module 1102 manages each Virtual Credit eWallet (e.g., 1103 and 1123 of FIG. 11). The Virtual Credit eWallet for each player is stored in a processor-readable format, and each Virtual Credit eWallet includes a virtual credit ledger (e.g., VC ledger 1104 of FIG. 11). The virtual credit ledger (e.g., 1104) records at least virtual credit (VC) debit transactions, VC credit transactions, and a VC balance for a respective player. The VC eWallet module 1102 includes processor-executable instructions that when executed, control the patron management server 1006 to record VC debit transactions for a player in the VC ledger of the player, record VC credit transactions for the player in the VC ledger of the player, update the VC balance of the VC ledger for the player, and provide the VC balance of the VC ledger for the player.

The VC eWallet module 1102 records VC credit transactions for a player based on real value received from the player via the payment processing module 1114, VC received (e.g., cashed-out) from a credit meter 1113 of a virtual credit gaming RC.CON 1112 used in a gaming session of the player, VC received from the player's sale or redemption of elements (E), and VC received based on a scanned code (e.g., a scanned ticket code (e.g., lottery ticket, concert ticket, movie ticket, and the like), a scanned receipt code, a scanned UPC code, a scanned proof of purchase code, and the like).

The VC eWallet module 1102 records VC debit transactions for a player based on VC added (e.g., cashed-in) to the credit meter 1113 of the RC.CON 1112 used in a gaming session of the player, and VC used for a player's purchase of elements (E).

In the example embodiment, VC cannot be exchanged for real value (e.g., redeemed for real currency), and the VC eWallet module 1102 is prohibited from performing operations to exchange VC for real value.

In the example implementation, the VC eWallet module 1102 includes processor-executable instructions that when executed, control the patron management server 1006 to prohibit recordation of VC debit transactions based on real value received by the player. In more detail, responsive to a request to record a VC debit transaction, the VC eWallet module 1102 determines whether the VC debit transaction relates to VC added (e.g., cashed-in) to the credit meter 1113 of the RC.CON 1112 used in a gaming session of the player or VC used for a player's purchase of E. In the example implementation, if the request to record the VC debit transaction does not specify that the VC debit transaction relates to VC added (e.g., cashed-in) to the credit meter 1113 of the RC.CON 1112 used in a gaming session of the player or VC used for a player's purchase of E, then the VC eWallet module 1102 does not record the VC debit transaction. In the example implementation, in the case where the VC eWallet module 1102 does not record the VC debit transaction, the VC eWallet module 1102 communicates an error message to the requestor of the VC debit transaction recordation request.

In the example implementation, each Virtual Credit eWallet (e.g., 1103, 1123) includes an element (E) ledger (e.g., 1105). The E ledger records at least one of E purchase transactions, E sale transactions, E exchange transactions, E consumption transactions, and an inventory of E (e.g., items owned, amount of a particular E owned) for a respective player. The VC eWallet module 1102 includes processor-executable instructions that when executed, control the patron management server 1006 to record E purchase transactions for a player, record E sale transactions for the player, record E exchange transactions for the player, record E consumption transactions for the player, update an inventory of the player's E (e.g., items owned, amount of a particular E owned), and provide the inventory of the player's E.

The VC eWallet module 1102 records E purchase transactions for a player based on real value received by the seller from the player via the payment processing module 1114, VC received by the seller from the player, and Quanta received by the seller from the player.

The VC eWallet module 1102 records E sale transactions in which E is sold for VC. In the example embodiment, E cannot be exchanged for real value (e.g., redeemed for real currency), and the VC eWallet module 1102 is prohibited from performing operations to exchange E for real value.

—Real Credit eWallet—

The real credit eWallet module 1106 manages each Real Credit (RC) eWallet (e.g., 1107 and 1127 of FIG. 11). The Real Credit eWallet for each player is stored in a processor-readable format, and each Real Credit eWallet includes a real credit ledger (e.g., 1108 of FIG. 11). The real credit ledger records at least real credit (RC) debit transactions, RC credit transactions, and a RC balance for a respective player. The RC eWallet module 1106 includes processor-executable instructions that when executed, control the patron management server 1006 to record RC debit transactions for a player in the RC ledger of the player, record RC credit transactions for the player in the RC ledger of the player, update the RC balance of the RC ledger for the player, and provide the RC balance of the RC ledger for the player.

The RC eWallet module 1106 records RC credit transactions for a player based on real value received (e.g., from the player, from a lottery, and the like) via the payment processing module 1114, and RC received (e.g., cashed-out) from a credit meter 1133 of a real credit gaming RC.CON 1132 used in a gaming session of the player.

In the example embodiment, VC cannot be exchanged for real value (e.g., redeemed for real currency), and the RC eWallet module 1106 is prohibited from recording RC credit transactions based on VC debited from the player.

In the example implementation, the RC eWallet module 1106 includes processor-executable instructions that when executed, control the patron management server 1006 to prohibit recordation of RC credit transactions based on VC debited from the player. In more detail, responsive to a request to record an RC credit transaction, the RC eWallet module 1106 determines whether the RC credit transaction relates to real value received from the player via the payment processing module 1114, real value received from a lottery system via the payment processing module 1114, or RC received (e.g., cashed-out) from a credit meter of a real credit gaming RC.CON. In the example implementation, if the request to record the RC credit transaction does not specify that the RC credit transaction relates to real value received from the player via the payment processing module 1114, real value received from a lottery system via the payment processing module 1114, or RC received (e.g., cashed-out) from a credit meter of a real credit gaming RC.CON, then the RC eWallet module 1106 does not record the RC credit transaction. In the example implementation, in the case where the RC eWallet module 1106 does not record the RC credit transaction, the RC eWallet module 1106 communicates an error message to the requestor of the RC credit transaction recordation request.

In the example implementation, the patron management server 1006 includes processor-executable instructions that when executed control the patron management server 1006 to prohibit reception of real value via the payment processing module 1114 in connection with an exchange of VC for real value, and to refund real value received via the payment processing module 1114 that is determined to have been received in connection with an exchange of VC for real value. In the example implementation, the patron management server 1006 determines whether real value received for a player via the payment processing module 1114 relates to an exchange of VC for real value based on information recorded in the VC ledger (e.g, the VC ledger 1104) and the RC ledger (e.g., the RC ledger 1108) of the player.

The RC eWallet module records RC debit transactions for a player based on RC added (e.g., cashed-in) to the credit meter 1133 of the RC.CON 1132 used in a gaming session of the player, RC used for a player's purchase of E or VC, and RC exchanged for real value (e.g., redeemed for real currency). In the example implementation, the RC is exchanged for real value by using the payment processing module 1114.

In some implementations, the payment processing module 1114 used in connection with real value transactions related to E, VC and RC is one of an iTunes payment processing module, an Android payment processing module, a Pay-Pal payment processing module, a payment processing module provided by an operator of the lottery SWig system, and the like. In some implementations, the payment processing module 1114 receives payment from a player via at least one of a credit card, a bank account, a debit card, a real money gaming voucher, a mobile device virtual wallet (e.g., an iOS virtual wallet, an Android virtual wallet, and the like), and a real money gaming smart card.

—Quanta eWallet—

The Quanta eWallet module 1140 manages each Quanta eWallet (e.g., 1153 and 1163 of FIG. 11). The Quanta eWallet for each player is stored in a processor-readable format, and each Quanta eWallet includes a Quanta ledger (e.g., Quanta ledger 1143 of FIG. 11). The Quanta ledger (e.g., 1143) records at least Quanta debit transactions, Quanta credit transactions, and a Quanta balance for a respective player. The Quanta eWallet module 1140 includes processor-executable instructions that when executed, control the patron management server 1006 to record Quanta debit transactions for a player in the Quanta ledger of the player, record Quanta credit transactions for the player in the Quanta ledger of the player, update the Quanta balance of the Quanta ledger for the player, and provide the Quanta balance of the Quanta ledger for the player.

The Quanta eWallet module 1140 records Quanta credit transactions for a player based on skillful gameplay of the entertainment game as determined by the player's game world telemetry (e.g., game world telemetry 124 of FIG. 1). In the example embodiment, the Quanta eWallet module 1140 also records Quanta credit transactions for a player based Quanta received based on a scanned code (e.g., a scanned ticket code (e.g., lottery ticket, concert ticket, movie ticket, and the like), a scanned receipt code, a scanned UPC code, a scanned proof of purchase code, and the like).

In the example embodiment, VC cannot be used to purchase Quanta, and the Quanta eWallet module 1140 is prohibited from performing operations to exchange VC for Quanta.

In the example embodiment, the Quanta eWallet module 1140 includes processor-executable instructions that when executed, control the patron management server 1006 to prohibit recordation of Quanta credit transactions in connection with consumption of VC.

In more detail, responsive to a request to record a Quanta credit transaction, the Quanta eWallet module 1140 determines whether the Quanta credit transaction represents an award of Quanta to a player based on skillful gameplay of the entertainment game (based on game world telemetry) or based on a scanned code.

In the example implementation, if the request to record the Quanta credit transaction specifies game world telemetry used to award the Quanta to the player or specifies a scanned code, then the Quanta eWallet module 1140 determines that the Quanta credit transaction represents an award of Quanta to a player based on skillful gameplay of the entertainment game (based on game world telemetry) or based on a scanned code.

In a case where the Quanta eWallet module 1140 determines that the Quanta credit transaction does not represent an award of Quanta to a player based on one of skillful gameplay of the entertainment game (based on game world telemetry) and a scanned code, then the Quanta eWallet module 1140 does not record the Quanta credit transaction. In the example implementation, in the case where the Quanta eWallet module 1140 does not record the Quanta credit transaction, the Quanta eWallet module 1140 communicates an error message to the requestor of Quanta recordation request.

In a case where the Quanta eWallet module 1140 determines that the Quanta credit transaction represents an award of Quanta to a player based on skillful gameplay of the entertainment game (based on game world telemetry) or based on a scanned code, then the Quanta eWallet module 1140 records the Quanta credit transaction.

The Quanta eWallet module 1102 records Quanta debit transactions for a player based on exchange for virtual items, exchange for entrance into tournaments, redemption for unlocking of new games or unlocking of levels of games, exchange of Quanta for VC, and consumption of quanta for real-world prizes Consumption of Quanta for real-world prizes is performed by the patron management server 1106 in conjunction with a Quanta consumption device (e.g., one of the Quanta consumption devices 1147 and 1191).

In the example implementation, each Quanta eWallet (e.g., 1153, 1163) includes a Quanta consumption ledger (e.g., 1144). The Quanta consumption ledger records at least Quanta consumption transactions, and an inventory of economic value items (e.g., real-world prizes) acquired in connection with Quanta consumption transactions (e.g., economic value items owned, amount of a particular economic value item owned) for a respective player. The Quanta eWallet module 1140 includes processor-executable instructions that when executed, control the patron management server 1006 to record Quanta consumption transactions for a player, and update an inventory of the player's economic value items (e.g., economic value items owned, amount of a particular economic value item owned), and provide the inventory of the player's economic value items.

The Quanta eWallet module 1140 records Quanta consumption transactions for a player based on one or more economic value items transferred to the player and an amount of Quanta consumed to transfer the one or more economic value items to the player.

—Business Transaction Management Module—

In the example implementation, the business transaction management module 1109 manages business transactions. A business transaction is a transaction involving one or more of VC, RC, Quanta and E that is performed in response to a user instruction provided by the player's gaming device (e.g., 1001) or a wager decision provided by a GW.CON (e.g., 1111, 1131). Business transactions include, for example, VC or RC cash-in to a gambling game provided by an RC.CON (e.g., 1112, 1132), VC or RC cash-out from a gambling game provided by an RC.CON (e.g., 1112, 1132), purchase of E using VC or RC, sale of E for VC, purchase of VC using RC, exchange of RC for real value, and exchange or consumption of Quanta. Business transactions can include sub-transactions that involve one or more of the VC eWallet, the RC eWallet and the Quanta eWallet of the player. For example, a business transaction for a player can include a first sub-transaction that involves the VC eWallet (e.g., 1103, 1123) of the player and a second sub-transaction that involves the RC eWallet (e.g., 1107, 1127) of the player. Some business transactions for a player involve only one of the VC eWallet and the RC eWallet of the player.

The business transaction management module 1109 uses one or more of the RC eWallet module 1106, the VC eWallet module 1102 and the Quanta eWallet module 1140 to perform a business transaction for a player.

Granting VC and Quanta Based on a Scanned Code

Figure 12:
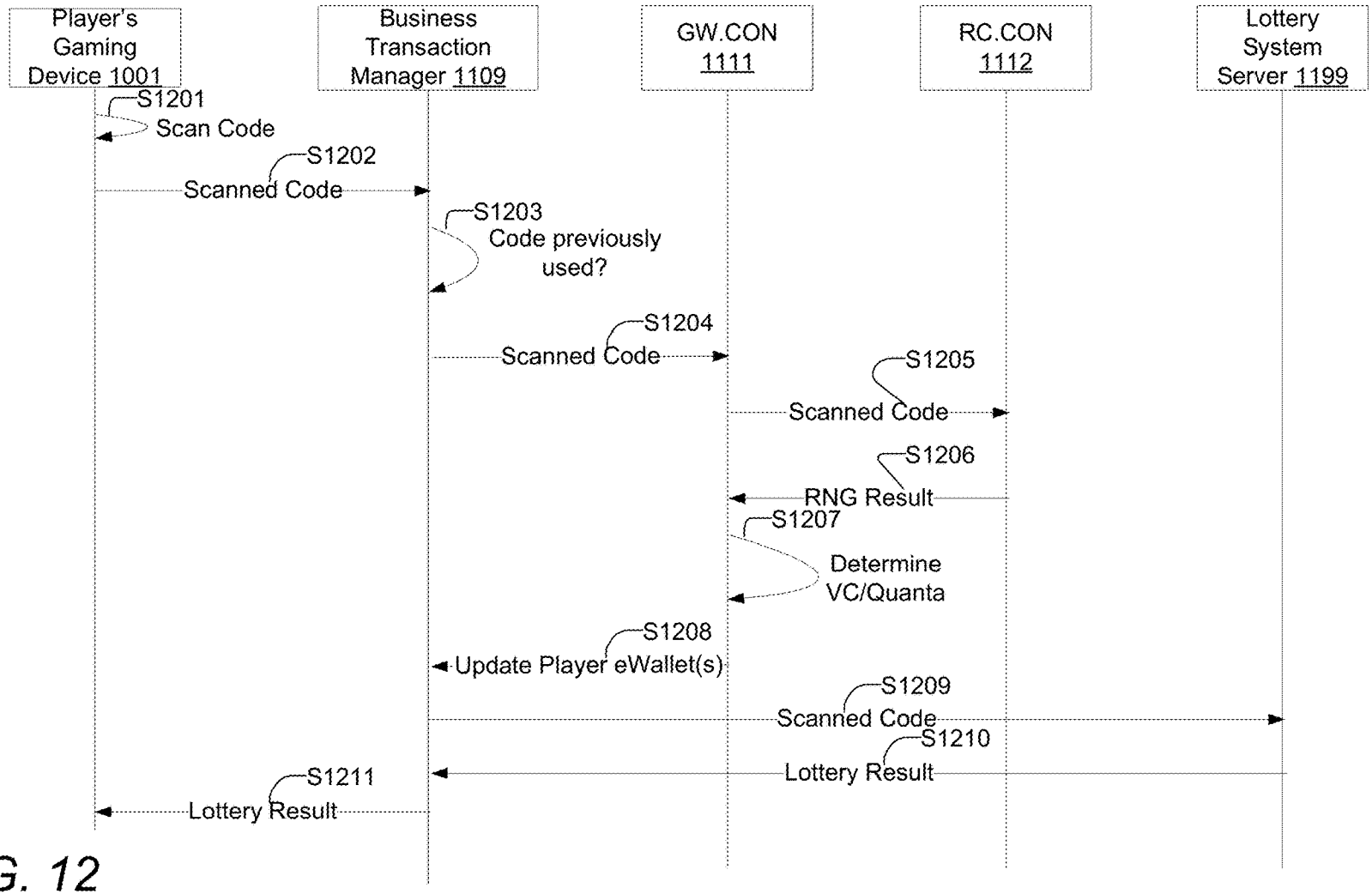
FIG. 12 is a sequence diagram for a process of granting one or more of VC and Quanta to a player of a lottery SWig system based on a scanned code, in accordance with an embodiment.

FIG. 12 is a sequence diagram for a process of granting one or more of VC and Quanta to a player of the lottery SWig system based on a scanned code.

Figure 13:
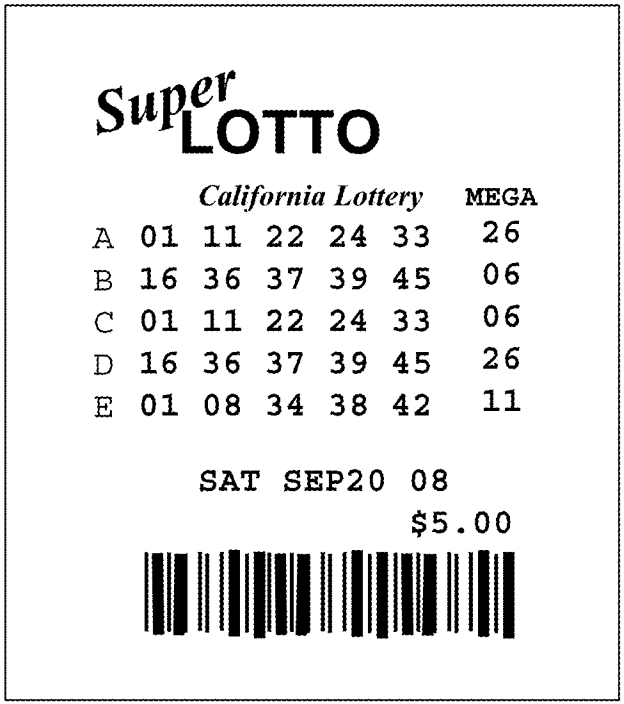
FIG. 13 illustrates how quanta, VRC, or other intermediate currencies may be used in a SWig in accordance with an embodiment.

At process S1201, the player's gaming device 1001 is communicatively coupled with the VC GW.CON 1111, and the player's gaming device 1001 scans a code. In the example implementation, the code is a lottery ticket bar code. An exemplary lottery ticket with a bar code is depicted in FIG. 13. In some implementations, the code is one of a ticket code (e.g., lottery ticket, concert ticket, movie ticket, and the like), a receipt code, a UPC code, a proof of purchase code, and the like. In the some implementations, the code is one or more of a bar code, a watermark, a numerical code, a QR code, and the like.

Figure 14:
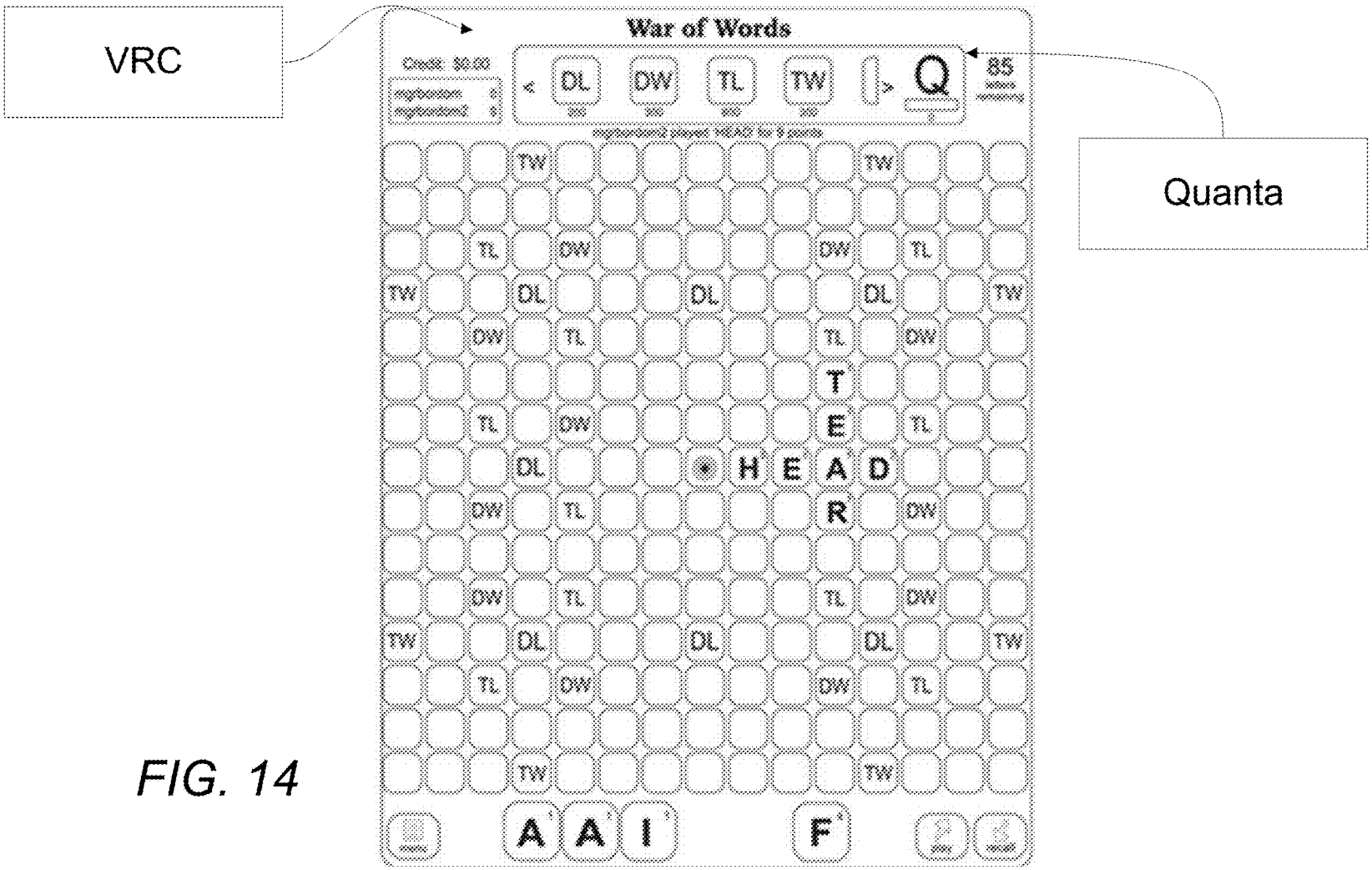
FIG. 14 depicts an exemplary lottery ticket with a bar code in accordance with an embodiment.

FIG. 14 illustrates an example implementation that allows for the use of quanta, VRC, or other intermediate currencies in the SWig. The code scanned lottery ticket bar code (FIG. 13), may grant one or more of VC and Quanta to a player, which may then be used within the SWig Gameplay.

At process S1202, the player's gaming device 1001 provides the scanned code and a player ID of a player of the player's gaming device 1001 to the business transaction management module 1109 of the patron management server 1006.

At process S1203, the business transaction management module 1109 determines whether the scanned code has been previously used by the player of the player's gaming device 1001. In the example implementation, the business transaction management module 1109 determines whether the scanned code has been previously used by the player of the player's gaming device 1001 by determining whether the scanned code is logged in the player's profile in the player profile data 1141. More specifically, the business transaction management module 1109 provides the player ID received from the player's gaming device 1001 to the player profile management module 1110, and the player profile management module 1110 provides the business transaction management module 1109 with a player profile data corresponding to the player ID. The business transaction management module 1109 determines whether the scanned code is logged in the player profile data, and if not, then the business transaction management module 1109 determines that the scanned code has not been previously used by the player.

At process S1204, the business transaction management module 1109 determines that the scanned code has not been previously used by the player's gaming device 1001, and the business transaction management module logs the scanned code in the player profile data corresponding to the player ID (by using the player profile management module 1110). In the example implementation, the business transaction management module 1109 determines that the player's gaming device 1001 is communicatively coupled to the VC GW.CON 1111 based on lottery SWig system session information included in the player profile data. Accordingly, the business transaction management module 1109 provides the scanned code to the VC GW.CON 1111.

In a case where the business transaction management module 1109 determines that the scanned code has been previously used by the player's gaming device 1001, the business transaction management module 1109 does not provide the scanned code to the VC GW.CON 1111.

At process S1205, the VC GW.CON 1111 determines that the scanned code is not game world telemetry. Accordingly, the GW.CON 1111 provides the scanned code to the RC.CON 1112 and requests an RNG result from the RC.CON 1112 based on the scanned code. In the example implementation, the RC.CON 1112 uses the scanned code as a seed for the P/RNG of the RC.CON.

At process S1206, the RC.CON 1112 returns an RNG result (based on the scanned code) to the GW.CON 1111.

At process S1207, the GW.CON 1111 determines an amount of VC or Quanta to award to a player of the player's gaming device 1001 based on the RNG result.

Figure 15:
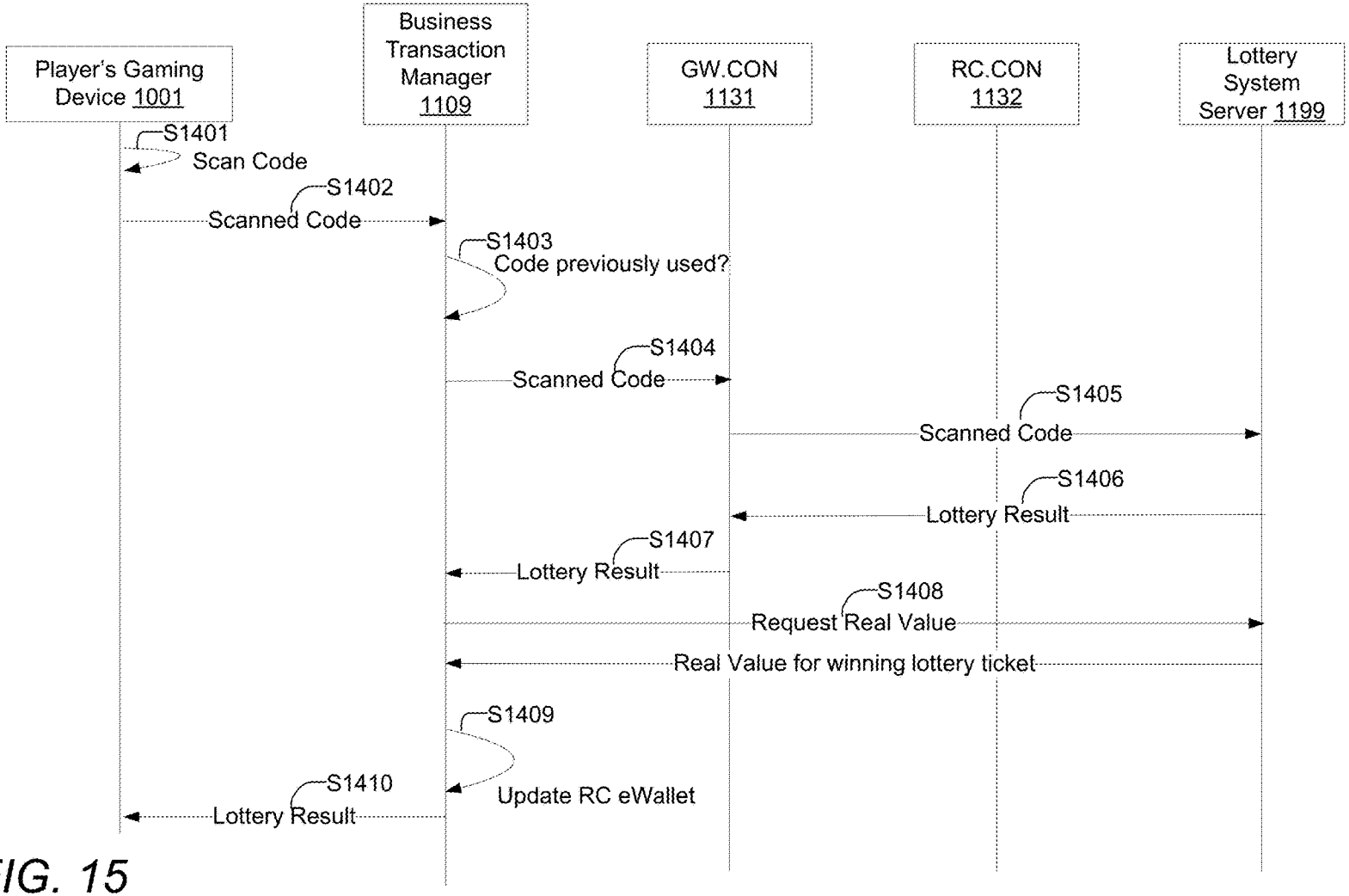
FIG. 15 is a sequence diagram for a process of awarding RC to a player of a lottery SWig system based on a scanned lottery ticket code, in accordance with an embodiment.

At process S1208, the GW.CON 1111 requests the business transaction management module 1109 to update the player's VC eWallet (e.g., 1123, 1103) and Quanta eWallet (e.g., 1163, 1153) based on any VC or Quanta awarded to the player (by using the VC eWallet module 1102 and the Quanta eWallet module 1140). In the example implementation, in which the code is a lottery ticket bar code, the business transaction management module 1109 communicates the scanned lottery ticket bar code to the lottery system server 1199 (at process S1209), the lottery system server 1199 determines a lottery result for the scanned lottery ticket bar code and provides the lottery result to the business transaction management module 1109 (at process S1210), and the business transaction management module 1109 provides the lottery result to the player's gaming device 1001 which outputs the lottery result in a human perceivable format via an output device (at process S1211). Awarding RC Based on a Scanned Lottery Ticket Code FIG. 15 is a sequence diagram for a process of awarding RC to a player of the lottery SWig system based on a scanned lottery ticket code. At process S1401, the player's gaming device 1001 is communicatively coupled with the real-money gaming GW.CON 1131, and the player's gaming device 1001 scans a lottery ticket bar code (FIG. 13).

At process S1402, the player's gaming device 1001 provides the scanned lottery ticket code and a player ID of a player of the player's gaming device 1001 to the business transaction management module 1109 of the patron management server 1006.

In the example implementation, at process S1403, the business transaction management module 1109 determines whether the scanned code has been previously used by the player of the player's gaming device 1001. In the example implementation, the business transaction management module 1109 determines whether the scanned code has been previously used by the player of the player's gaming device 1001 by determining whether the scanned lottery ticket code is logged in the player's profile in the player profile data 1141. More specifically, the business transaction management module 1109 provides the player ID received from the player's gaming device 1001 to the player profile management module 1110, and the player profile management module 1110 provides the business transaction management module 1109 with a player profile data corresponding to the player ID. The business transaction management module 1109 determines whether the scanned code is logged in the player profile data, and if not, then the business transaction management module 1109 determines that the scanned code has not been previously used by the player.

At process S1404, the business transaction management module 1109 determines that the scanned code has not been previously used by the player's gaming device 1001, and the business transaction management module logs the scanned code in the player profile data corresponding to the player ID (by using the player profile management module 1110). In the example implementation, the business transaction management module 1109 determines that the player's gaming device 1001 is communicatively coupled to the RC GW.CON 1131 based on lottery SWig system session information included in the player profile data. Accordingly, the business transaction management module 1109 provides the scanned code to the RC GW.CON 1131.

In a case where the business transaction management module 1109 determines that the scanned code has been previously used by the player's gaming device 1001, the business transaction management module 1109 does not provide the scanned code to the RC GW.CON 1131.

At process S1405, the RC GW.CON 1131 determines that the scanned code is a scanned lottery ticket bar code. Accordingly, the RC GW.CON 1131 provides the scanned code to the lottery system 1199 and requests a lottery result corresponding to the lottery ticket identified by the scanned lottery ticket bar code. In the example implementation, the RC GW.CON 1131 requests the lottery result by using a typical lottery system infrastructure for requesting lottery results for a lottery ticket.

At process S1406, the RC GW.CON 1131 receives the lottery result from the lottery system 1199.

In the example implementation, the RC GW.CON 1131 updates lottery SWig system entertainment game gameplay based on the lottery result. In some implementations, the RC GW.CON 1131 does not update the lottery SWig system entertainment game gameplay based on the lottery result.

At process S1407, the RC GW.CON 1131 provides the lottery result, the lottery ticket bar code, and the player ID for the player of the player's gaming device 1001 to the business transaction management module 1109, and requests the business transaction management module 1109 to receive real value from the lottery system 1199 for any real value awarded to the player based on the lottery result.

At process S1408, the business transaction management module 1109 determines that the lottery ticket bar code corresponds to a winning lottery ticket, and the business transaction management module 1109 receives real value from lottery system 1199. In the example implementation, the business transaction management module 1109 receives the real value from lottery system 1199 by using a typical lottery system infrastructure for receiving real value from a lottery system for a winning lottery ticket. In the example implementation, the business transaction management module 1109 receives the real value from lottery system 1199 by using the payment processing module 1114.

At process S1409, the business transaction management module 1109 updates the player's RC eWallet (e.g., 1127, 1107) based on the RC awarded to the player for the winning lottery ticket (by using the RC eWallet module 1106.

At process S1410, the business transaction management module 1109 provides the lottery result to the player's gaming device 1001, and the player's gaming device 1001 outputs the lottery result in a human perceivable format via an output device.

—Patron Management Server—

Figure 16:
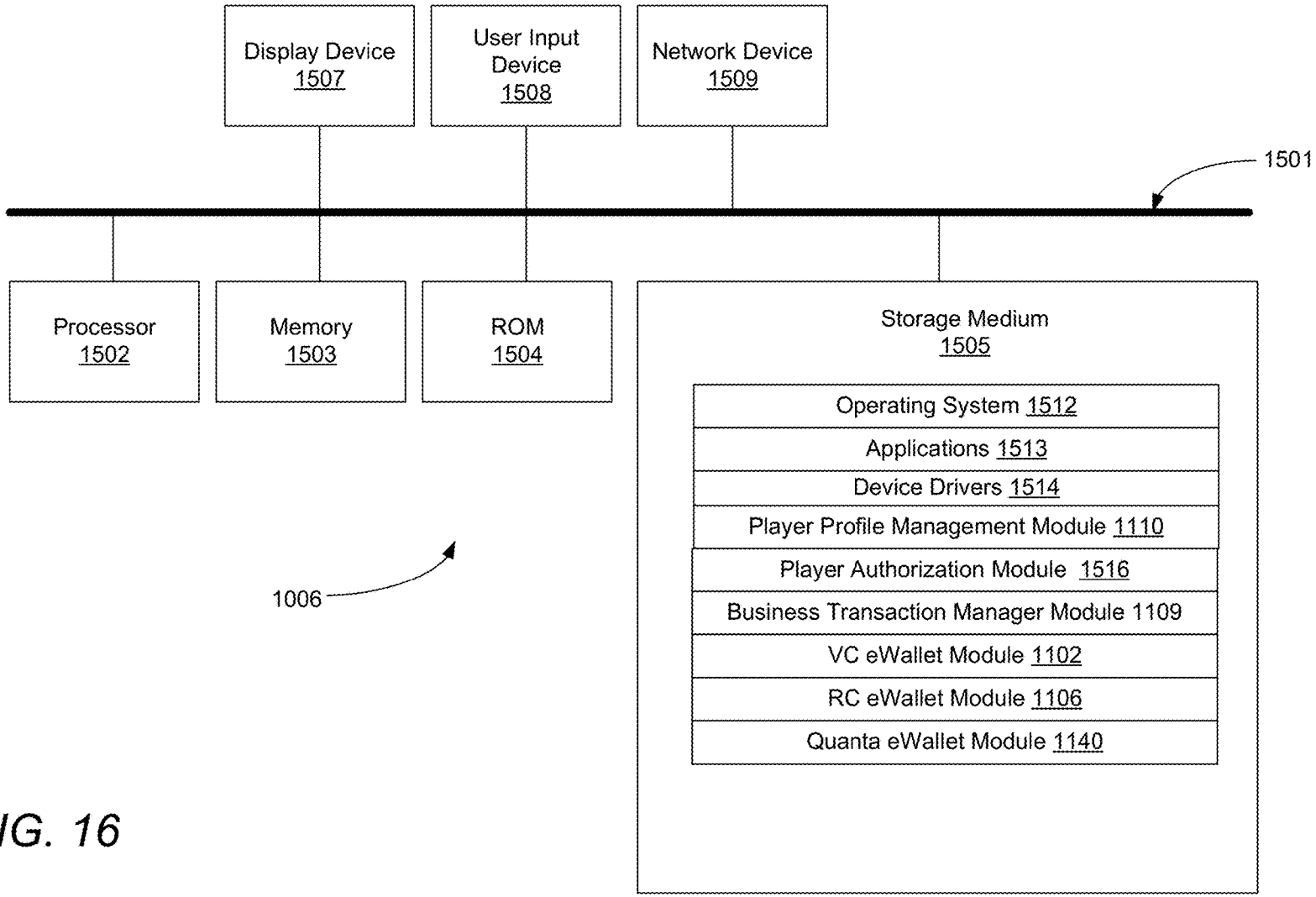
FIG. 16 is an illustration of a patron management server in accordance with an embodiment.

FIG. 16 is an architecture diagram of the patron management server 1006. In the example embodiment, the patron management server 1006 is a server device. In some embodiments, the patron management server 1006 is any suitable type of device, such as, for example, a rack-mount server device, a blade server device, a client device, a network device, a mobile device, and the like.

The bus 1501 interfaces with a processor 1502, a random access memory (RAM) 1503, a read only memory (ROM) 1504, a processor-readable storage medium 1505, a display device 1507, a user input device 1508, and a network device 1509.

The one or more processors 1502 may be part of a processing module that may take many forms, such as, but not limited to: a central processing unit (CPU), a multiprocessor unit (MPU), an ARM processor, and the like.

The network device 1509 provides one or more wired or wireless interfaces for exchanging data and commands between the patron management server 1006 and other devices, such as, for example, the GWC Consumption Devices 1147 and 1191, the player registration device 1003, the player's gaming device 1001, the GW.CON 111, the GW.CON 1131, and the lottery system server 1199. Such wired and wireless interfaces include, for example, a Universal Serial Bus (USB) interface, Bluetooth interface, Wi-Fi interface, Ethernet interface, Near Field Communication (NFC) interface, and the like.

Machine-executable instructions in software programs (such as an operating system 1512, application programs 1513, and device drivers 1514) are loaded into the memory 1503 from the processor-readable storage medium 1505, the ROM 1504 or any other storage location. During execution of these software programs, the respective machine-executable instructions are accessed by the processor 1502 via the bus 1501, and then executed by the processor 1502. Data used by the software programs are also stored in the memory 1503, and such data is accessed by the processor 1502 during execution of the machine-executable instructions of the software programs.

The processor-readable storage medium 1505 is one of (or a combination of two or more of) a hard drive, a flash drive, a DVD, a CD, a flash storage, a solid state drive, a ROM, and EEPROM, and the like. The processor-readable storage medium 1505 includes the operating system 1512, the software programs 1513, the device drivers 1514, the business transaction manager module 1109, the VC eWallet module 1102, the RC eWallet module 1106, the Quanta eWallet Module 1140, the player profile management module 1110, and a player authorization module 1516.

The Quanta eWallet module 1140 includes machine-executable instructions for controlling the processor 1502 to control the patron management server 1106 to manage Quanta eWallets (e.g., Quanta eWallets 1153 and 1163 of FIG. 11), as described above.

In the example implementation of FIG. 16, the player profile management module 1110 includes machine-executable instructions for receiving a player ID from the business transaction management module 1109, controlling the processor 1502 to control the patron management server 1106 to receive player profile data corresponding to the player ID from a player registration device (e.g., player registration device 1003), and providing the received player profile data (corresponding to the player ID) to the business transaction management module 1109. In the example implementation, the received player profile data corresponding to the player ID includes information for accessing the VC eWallet, the RC eWallet, and the Quanta eWallet corresponding to the player ID, by using the VC eWallet Module 1102, the RC eWallet module 1106, and the Quanta eWallet module 1140, respectively.

—Player Registration Device—

Figure 17:
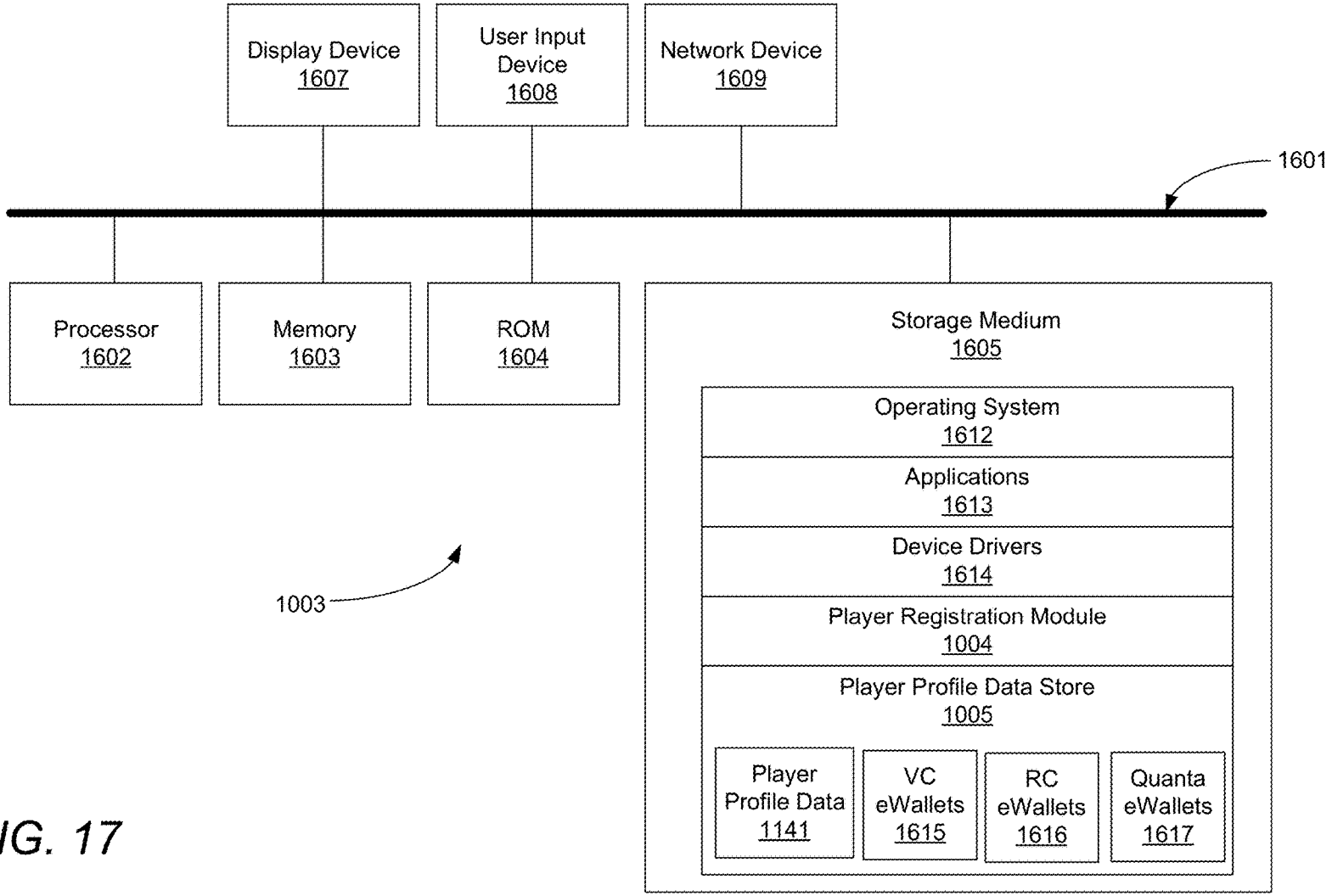
FIG. 17 is an illustration of a player registration device in accordance with an embodiment.

FIG. 17 is an architecture diagram of the player registration device 1003. In the example embodiment, the player registration device 1003 is a server device. In some embodiments, the player registration device 1003 is any suitable type of device, such as, for example, a rack-mount server device, a blade server device, a client device, a network device, a mobile device, and the like.

The bus 1601 interfaces with a processor 1602, a random access memory (RAM) 1603, a read only memory (ROM) 1604, a processor-readable storage medium 1605, a display device 1607, a user input device 1608, and a network device 1609.

The one or more processors 1602 may be part of a processing module that may take many forms, such as, but not limited to: a central processing unit (CPU), a multiprocessor unit (MPU), an ARM processor, and the like.

The network device 1609 provides one or more wired or wireless interfaces for exchanging data and commands between the player registration device 1003 and other devices, such as, for example, the player's gaming device 1001 and the patron management server 1006. Such wired and wireless interfaces include, for example, a Universal Serial Bus (USB) interface, Bluetooth interface, Wi-Fi interface, Ethernet interface, Near Field Communication (NFC) interface, and the like.

Machine-executable instructions in software programs (such as an operating system 1612, application programs 1613, and device drivers 1614) are loaded into the memory 1603 from the processor-readable storage medium 1605, the ROM 1604 or any other storage location. During execution of these software programs, the respective machine-executable instructions are accessed by the processor 1602 via the bus 1601, and then executed by the processor 1602. Data used by the software programs are also stored in the memory 1603, and such data is accessed by the processor 1602 during execution of the machine-executable instructions of the software programs.

The processor-readable storage medium 1605 is one of a (or a combination of two or more of) a hard drive, a flash drive, a DVD, a CD, a flash storage, a solid state drive, a ROM, an EEPROM, and the like. The processor-readable storage medium 1605 includes the operating system 1612, the software programs 1613, the device drivers 1614, the player registration module 1004, and the player profile data store 1005. The player profile data store 1005 includes the player profile data 1141, VC eWallets 1615, RC eWallets 1616, and Quanta eWallets 1617. VC eWallets 1615 include VC eWallets 1103 and 1123 of FIG. 11. RC eWallets 1616 include RC eWallets 1107 and 1127 of FIG. 11. Quanta eWallets 1617 include GWC eWallets 1153 and 1163 of FIG. 11. The player registration module 1004 includes machine-executable instructions for controlling the processor 1602 to control the player registration device 1003 to generate player profile data and register the player profile data with the patron management server 1006, as described above.

Figure 18:
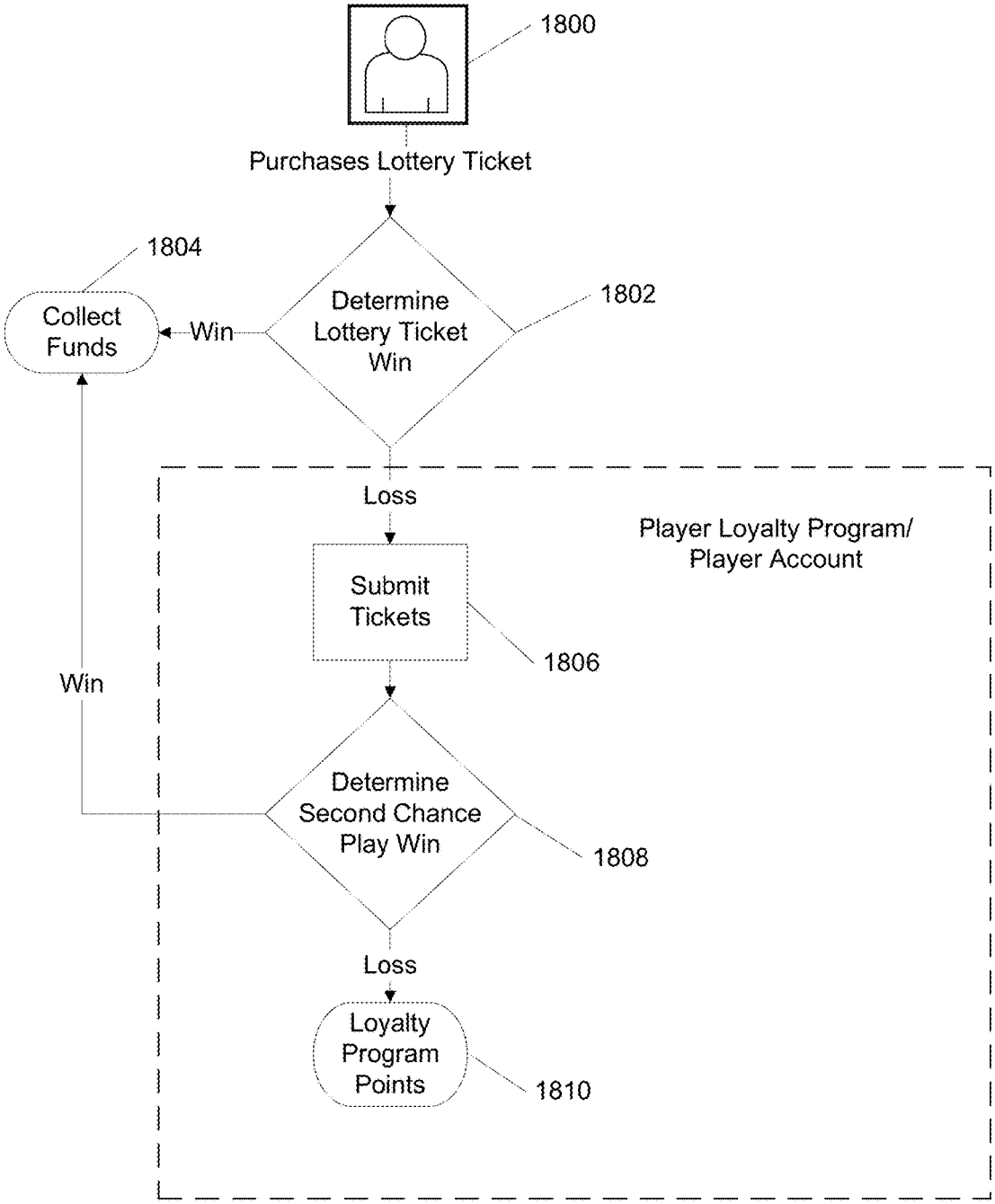
FIG. 18 is an illustration of a process of a lottery SWig system providing a second chance in accordance with an embodiment.

FIG. 18 is an illustration of a process of a lottery SWig system providing a second chance in accordance with an embodiment. As illustrated in FIG. 18, a lottery SWig system may include second chance plays, in which a player may use non-winning tickets for entrance into a subsequent lottery drawing. These second chance drawings allow an operator of a lottery to maintain a relationship with players who might otherwise lose interest after losing a lottery draw. In addition, second chance plays provided by a lottery SWig system may create an incentive system that is more interactive and dynamic than a second chance play associated with current lottery systems by creating an incentive for players to continue gameplay outside of a lottery context.

In such a process, a player 1800 purchases a lottery ticket. If it is determined (1802) the lottery ticket is a winning ticket, funds for winning the lottery ticket are awarded (1804) to the player. However, if it is determined that the lottery ticket is not a winning ticket, the lottery ticket is submitted (1806) to a game world controller of a lottery SWig system as described herein. A second chance drawing is then provided (1808) to the player providing a second chance for the player to win at the lottery. If the second chance lottery drawing results in a loss for the player, the game world controller awards (1810) loyalty program points to the player.

Figure 19:
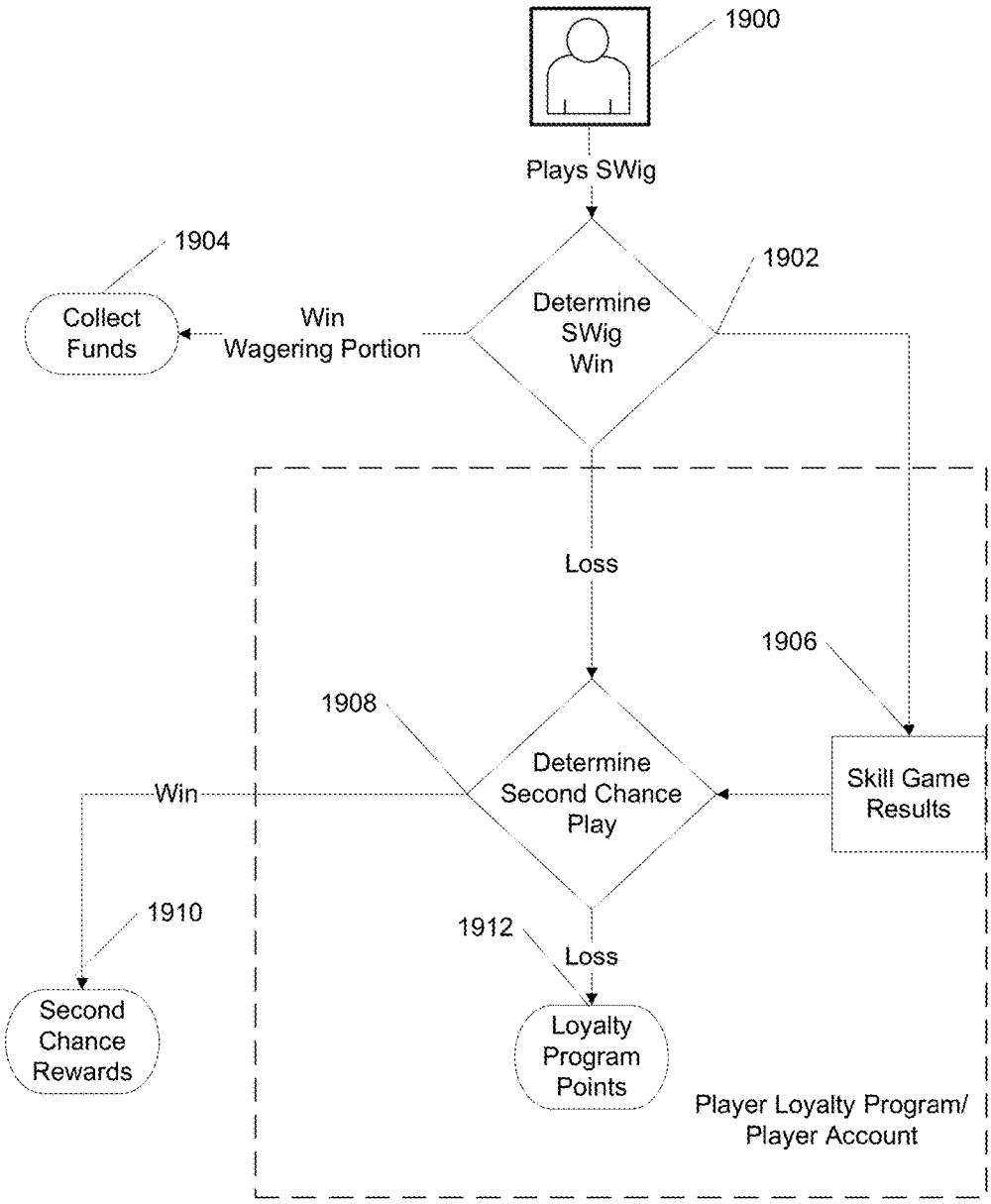
FIG. 19 is an illustration of another process of a lottery SWig system providing a second chance in accordance with an embodiment.

FIG. 19 is an illustration of another process of a lottery SWig system providing a second chance in accordance with an embodiment. As illustrated in FIG. 19, a player within a gaming establishment may provide credits for virtual or online play during the course of playing a SWig of a lottery SWig system. Examples of credits include, but are not limited to: virtual credits/quarters for use in an online arcade; virtual currency for specific games; play time for the SWig in which the second chance credits were earned; functional or cosmetic in-game items; and sponsored credits.

In such a process, a first SWig is provided by a lottery SWig system to a player 1900 who plays the first SWig as described herein. If a game world controller of a lottery SWig system determines (1902) that the player has won the wagering portion of the first SWig, gambling game outcomes in the form of funds are provided (1904) to the player. If the game world controller determines that the player has experienced a net loss in the gambling game portion of the first SWig, the game world controller player provides the player with a second chance opportunity to play a second chance SWig. The game world controller of the lottery SWig system provides second chance credits in the form of virtual credits or Quanta to award to the player as described herein for the player to use in the second chance SWig. If the game world controller of the lottery SWig system determines (1908) that the player has won the gambling game portion of the second chance SWig, the game world controller of the lottery SWig system provides (1910) the player with second chance rewards. If the game world controller of the lottery SWig system determines that the player has experienced a net loss in the gambling game portion of the second chance SWig, the game world controller of the lottery SWig system provides (1912) the player with loyalty program points.

In several embodiments, the second chance rewards provided (1910) to the player are provided in the form of a second chance lottery draw.

In many embodiments, the game world controller of a lottery SWig system provides skill game results 1906 in the form of game world credits that the player earned in the skill-based entertainment game portion of the first SWig.

In some embodiments, the second chance credits are real credits that may be exchanged for value in a real world currency, and the second chance SWig rewards may be in the form of credits having value in a real world currency or items having value in a real world currency.

In some embodiments, the second chance credits are virtual credits that may not be exchanged for value in a real world currency, and the second chance SWig rewards may have no value in a real world currency as well.

In various embodiments, the second chance credits are restricted virtual credits that cannot be exchanged for value in a real world currency while the second chance SWig rewards may be in the form of credits having value in a real world currency or items having value in a real world currency.

In several embodiments, the skill game results include skill-based entertainment game resources that provide an advantage to the player in the skill-based entertainment game of the second chance SWig as the player plays the second chance SWig.

In one embodiment, second chance credits may be associated with a player account, and bound to a specific game or gaming establishment operator.

In another embodiment, second chance credits may be sponsored by the casino or a third party with real credits, allowing continued wagering play.

One aspect of second chance credits is to maintain the operator-player relationship. Players may not remain in the same geographic location after leaving a gaming establishment. Since the player leaving a geographic location may be subject to different gaming regulations, second chance offers may adjust based on their geolocation at time of play.

In another embodiment, second chance credits may only be used in specified locations.

In one embodiment, the skill portion of a SWig may influence the second chance credits awarded to the player. That is, a skilled player may receive more second chance credits than an unskilled player. Conversely, an unskilled player may receive more second chance credits than a skilled player.

Figure 20:
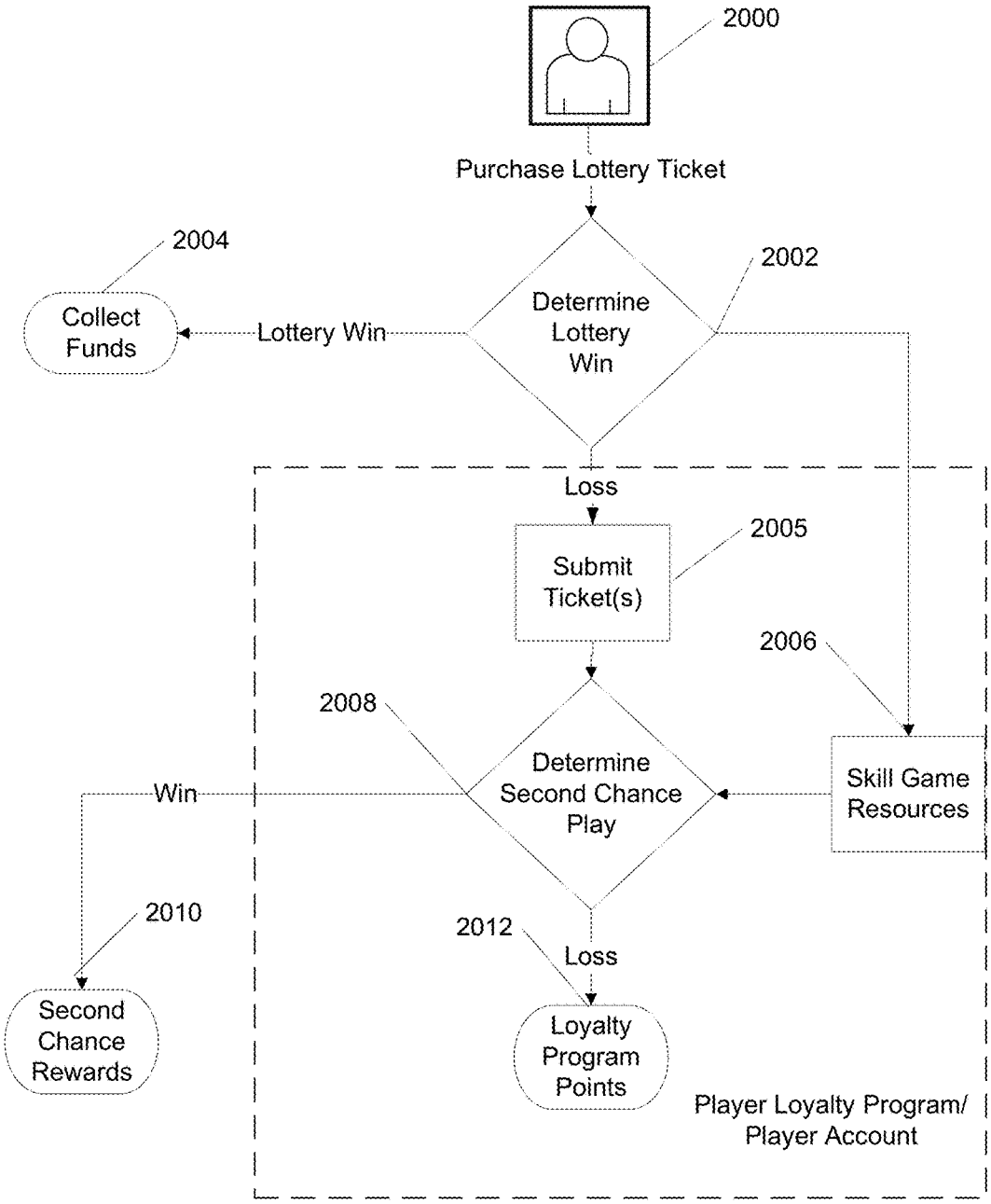
FIG. 20 is an illustration of another process of a lottery SWig system providing a second chance in accordance with an embodiment.

FIG. 20 is an illustration of another process of a lottery SWig system providing a second chance in accordance with an embodiment. As illustrated in FIG. 20, a player 2000 purchases a lottery ticket. If it is determined (2002) that the player has a lottery win, a lottery win in a form of funds are provided (2004) to the player. If the player has a loss in the lottery, the player submits the losing lottery ticket to a game world controller of a lottery SWig system as described herein. In response, the game world controller provides the player with a second chance opportunity to play a second chance SWig. The game world controller of the lottery SWig system provides second chance credits in the form of virtual credits or Quanta to award to the player as described herein for the player to use in the second chance SWig. If the game world controller of the lottery SWig system determines (2008) that the player has won the gambling game portion of the second chance SWig, the game world controller of the lottery SWig system provides (2010) the player with second chance SWig rewards. If the game world controller of the lottery SWig system determines that the player has experienced a net loss in the gambling game portion of the second chance SWig, the game world controller of the lottery SWig system provides (2012) the player with loyalty program points.

In some embodiments, the game world controller of the lottery SWig system provides skill-based entertainment game resources 2006 that provide an advantage to the player in the skill-based entertainment game portion of the second chance SWig as the player plays the second chance SWig.

In some embodiments, a second chance game is provided by the lottery SWig system is a skill-based entertainment game. If the game world controller of the skill wagering interleaved game system player wins the skill-based entertainment game through skillful play, the players is provided with second chance rewards 2010 in a form of a second chance lottery ticket that is an entry into a second chance lottery drawing. In such an embodiment, the lottery SWig system provides skill-based entertainment game resources 2006 that provide an advantage to the player in the skill-based entertainment game as the player plays the second chance skill-based entertainment game. In some embodiments, the skill-based entertainment game resources are of such a nature that event an unskilled player is assured of winning the skill-based entertainment game.

In some embodiments, the second chance credits are real credits that may be exchanged for value in a real world currency, and the second chance SWig rewards may be in the form of credits having value in a real world currency or items having value in a real world currency.

In some embodiments, the second chance credits are virtual credits that may not be exchanged for value in a real world currency, and the second chance SWig rewards may have no value in a real world currency as well.

In various embodiments, the second chance credits are restricted virtual credits that cannot be exchanged for value in a real world currency while the second chance SWig rewards may be in the form of credits having value in a real world currency or items having value in a real world currency.

In one embodiment, second chance credits may be associated with a player account, and bound to a specific game or gaming establishment operator.

In another embodiment, second chance credits may be sponsored by the casino or a third party with real credits, allowing continued wagering play.

One aspect of second chance credits is to maintain the operator-player relationship. Players may not remain in the same geographic location after leaving a gaming establishment. Since the player leaving a geographic location may be subject to different gaming regulations, second chance offers may adjust based on their geolocation at time of play.

In another embodiment, second chance credits may only be used in specified locations.

In one embodiment, an outcome in a skill-based entertainment game portion of a SWig may influence an amount of second chance credits awarded to the player. That is, a skilled player (as determined by the outcome in the skill-based entertainment game portion of the SWig) may receive more second chance credits than an unskilled player. Conversely, an unskilled player (as determined by the outcome in the skill-based entertainment game portion of the SWig) may receive more second chance credits than a skilled player.

CONCLUSION

While various example embodiments of the present disclosure have been described above, it should be understood that they have been presented by way of example, and not limitation. It will be apparent to persons skilled in the relevant art(s) that various changes in form and detail can be made therein. Thus, the present disclosure should not be limited by any of the above described example embodiments, but should be defined only in accordance with the following claims and their equivalents.

In addition, it should be understood that the figures are presented for example purposes only. The architecture of the example embodiments presented herein is sufficiently flexible and configurable, such that it may be utilized and navigated in ways other than that shown in the accompanying figures.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is not intended to be limiting as to the scope of the example embodiments presented herein in any way. It is also to be understood that the procedures recited in the claims need not be performed in the order presented.

What is claimed:

1. A skill wagering interleaved game system comprising:

a player's gaming device constructed to:

scan a code of a lottery ticket;

communicate, to an electromechanical gaming machine by a network, the scanned code of the lottery ticket;

provide a second chance skill-based game;

generate a user interface display that depicts a representation of the second chance skill-based; and the electromechanical gaming machine coupled to the player's gaming device by the network and constructed to receive credit from a player, comprising:

a real credit controller configured to determine a wager outcome of a gambling game for a wager of an amount of credit; and a game world controller coupled to the real credit controller, wherein the game world controller is configured to:

receive, from the player's gaming device, the scanned code of the lottery ticket;

determine the amount of credit for the wager using the scanned code of the lottery ticket;

trigger the wager of the amount of credit in the real credit controller;

receive, from the wager controller the wager outcome for the wager;

communicate to the player's gaming device by the network the wager outcome;

determine whether the second chance skill-based game should be provided; and communicate to the player's device via the network instructions to provide the second chance skill-based game.

2. The skill wagering interleaved game system of claim 1, wherein the wager outcome determines game world resources available in the second chance skill-based game.

3. The skill wagering interleaved game system of claim 1, wherein the game world controller is further constructed to provide a reward to a player based on a winning wager outcome.

4. The skill wagering interleaved game system of claim 1, wherein the game world controller is further constructed to provide player loyalty points to the player based on a losing wager outcome.

5. The skill wagering interleaved game system of claim 1, wherein the second chance skill-based game provides a second amount of credits based on the amount of credit used for the wager.

* * * * *